US009424817B2

(12) United States Patent
Ryan

(10) Patent No.: US 9,424,817 B2
(45) Date of Patent: Aug. 23, 2016

(54) FULLY-ADJUSTABLE CAPO FOR STRINGED MUSICAL INSTRUMENTS

(71) Applicant: Benjamin B. Ryan, Santa Barbara, CA (US)

(72) Inventor: Benjamin B. Ryan, Santa Barbara, CA (US)

( * ) Notice: Subject to any disclaimer, the term of this patent is extended or adjusted under 35 U.S.C. 154(b) by 0 days.

(21) Appl. No.: 14/997,010

(22) Filed: Jan. 15, 2016

(65) Prior Publication Data

US 2016/0133235 A1 May 12, 2016

Related U.S. Application Data

(63) Continuation of application No. 14/615,767, filed on Feb. 6, 2015, now Pat. No. 9,257,102, and a continuation-in-part of application No. 14/076,559, filed on Nov. 11, 2013, now Pat. No. 8,962,958, and a continuation of application No. 13/357,597, filed on Jan. 24, 2012, now Pat. No. 8,618,389.

(51) Int. Cl.
*G10D 3/04* (2006.01)

(52) U.S. Cl.
CPC ..... *G10D 3/043* (2013.01)

(58) Field of Classification Search
CPC ..... G10D 3/043
See application file for complete search history.

(56) References Cited

U.S. PATENT DOCUMENTS

| | | | |
|---|---|---|---|
| 1,094,038 | A | 4/1914 | Weaver et al. |
| 1,219,884 | A | 3/1917 | Thingstad |
| 1,553,057 | A | 9/1925 | Weaver |
| 1,785,311 | A | 12/1930 | Johnson |
| 1,823,683 | A | 9/1931 | Gardner, Jr. |
| 1,871,021 | A | 8/1932 | Zachrison |
| 2,669,151 | A | 2/1954 | Mario Maccaferri |
| 2,744,433 | A | 5/1956 | Rooms |
| 3,446,108 | A | 5/1969 | Mitchell, Jr. |
| 3,680,427 | A | 8/1972 | Valentino |

(Continued)

FOREIGN PATENT DOCUMENTS

KR 10-2001-0086958 A 9/2001

OTHER PUBLICATIONS

"The Spider Capo by Creative Tunings", Apr. 18, 2010, retrieved at <<http://www.guitarlicksandtips.com/2010/04/18/the-spider-capo/>>.

(Continued)

*Primary Examiner* — Robert W Horn
(74) *Attorney, Agent, or Firm* — Lyon & Harr, LLP; Richard T. Lyon

(57) ABSTRACT

A tuning apparatus for a musical instrument is provided. The apparatus includes a clamp, a plurality of string-contacting members, and a string-contacting member spacing adjustment mechanism. The clamp removably attaches to a desired longitudinal position on the instrument's neck. Each member is rotatably supported by the clamp and rotates thereon independently of the other members. Each member also adjustably impinges upon and urges a given string or course thereof on the instrument toward a user-selectable one of three different longitudinal positions on the neck's front surface, these positions including a home position, a home−1 position, and a home+1 position. The mechanism allows a user to adjust the location of the members as a group on the clamp so as to substantially center the plane of rotation of each member over a different string or course thereof, and to maintain substantially equal spacing between each different adjacent pair of members.

1 Claim, 29 Drawing Sheets

(56) References Cited

U.S. PATENT DOCUMENTS

| | | | |
|---|---|---|---|
| 3,704,646 | A | 12/1972 | Davis |
| 3,805,664 | A | 4/1974 | Starns |
| 3,818,793 | A | 6/1974 | Round |
| 3,915,051 | A | 10/1975 | Kincaid |
| 4,112,805 | A | 9/1978 | Carter |
| 4,183,279 | A | 1/1980 | Shabram, Jr. |
| 4,331,059 | A | 5/1982 | Marabotto |
| 4,334,457 | A | 6/1982 | Spoonts, III |
| 4,428,273 | A | 1/1984 | Favron |
| 4,622,880 | A | 11/1986 | Glemming |
| 4,926,732 | A | 5/1990 | Collins et al. |
| 5,101,706 | A | 4/1992 | Kilgore |
| 5,323,676 | A | 6/1994 | Kennedy |
| 5,497,690 | A | 3/1996 | Soupios |
| 5,623,110 | A | 4/1997 | Hoglund |
| 6,723,905 | B2 | 4/2004 | Gillis |
| 6,998,526 | B1 | 2/2006 | Sims |
| 7,012,181 | B2 | 3/2006 | Tran |
| 7,557,285 | B2 | 7/2009 | Ward |
| 7,563,969 | B2 | 7/2009 | Einhorn et al. |
| 7,812,233 | B1 | 10/2010 | Lee |
| D669,117 | S | 10/2012 | de Neufville |
| 8,618,389 | B2 * | 12/2013 | Ryan ..... G10D 3/043 84/317 |
| 8,962,958 | B2 * | 2/2015 | Ryan ..... G10D 3/043 84/318 |
| 9,257,102 | B2 * | 2/2016 | Ryan ..... G10D 3/043 |
| 2005/0145089 | A1 | 7/2005 | Davis |
| 2010/0077901 | A1 | 4/2010 | Artioli |
| 2014/0060283 | A1 | 3/2014 | Ryan |

OTHER PUBLICATIONS

"SpiderCapo(TM)", Sep. 19, 2011, retrieved at <<http://spidercapo.com/>>.

PCT Notification of Transmittal of the ISR and WO, ISR and WO, International Searching Authority, IS, PCT/US2013/022168, May 15, 2013.

Horn, R. W., U.S. Notice of Allowance, U.S. Appl. No. 13/357,597, Aug. 13, 2013, pp. 1-8.

Horn, R. W., U.S. Notice of Allowance, U.S. Appl. No. 13/357,597, Mar. 19, 2013, pp. 1-10.

Horn, R. W., U.S. Notice of Allowance, U.S. Appl. No. 14/076,559, Oct. 7, 2014, pp. 1-8.

Horn, R. W., U.S. Notice of Allowance, U.S. Appl. No. 14/615,767, Oct. 1, 2015, pp. 1-8.

* cited by examiner

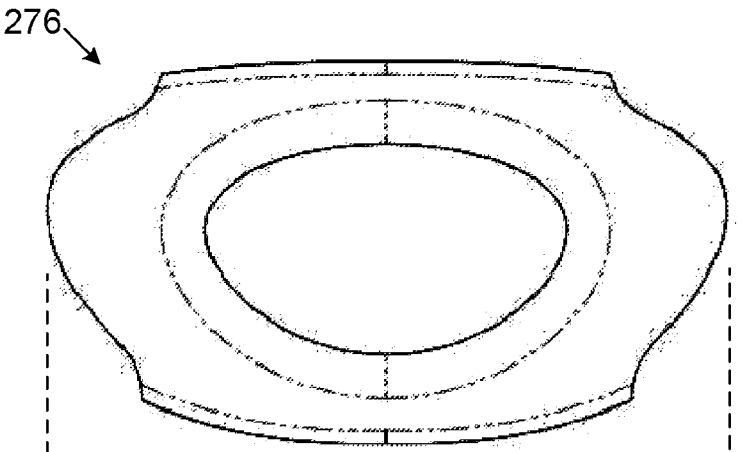
FIG. 40
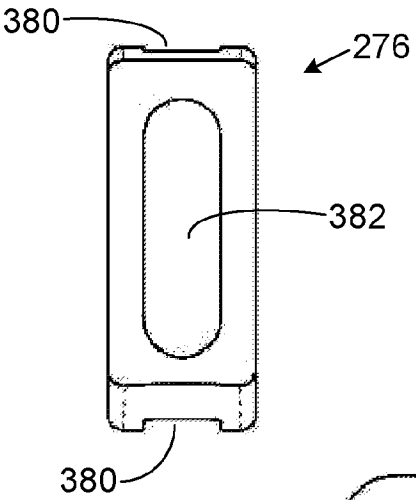
FIG. 41
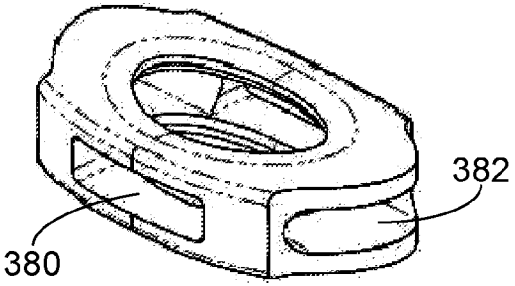
FIG. 42
FIG. 43

400
302
398

300

300
302
300
H
298

302
300
302
298
302

404
400
302
300
302
298
402
398
302
W1
298
398

400
302
Headstock Side
300
Bridge Side
302

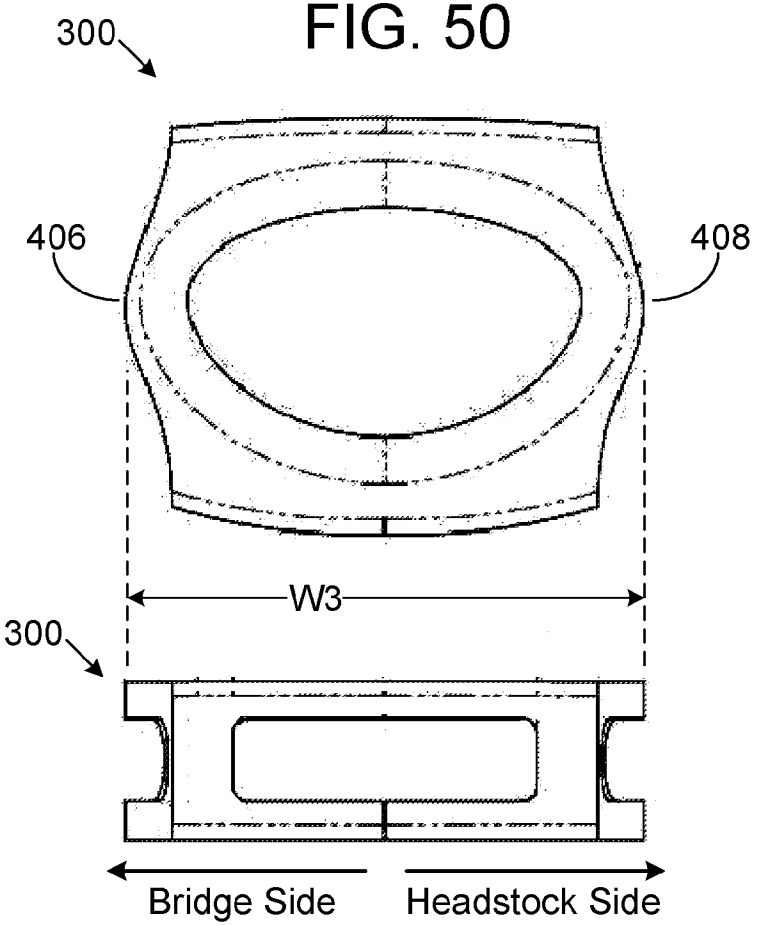
FIG. 50
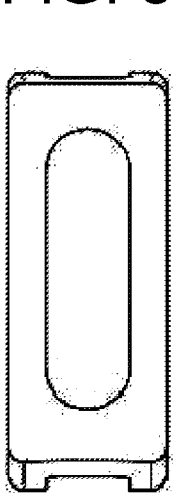
FIG. 51
FIG. 52
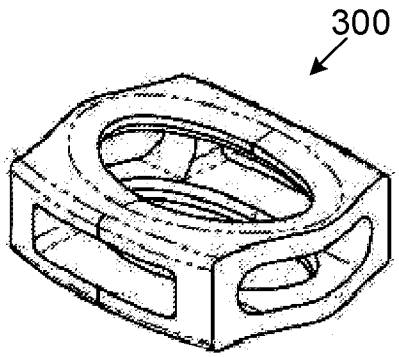
FIG. 53

FULLY-ADJUSTABLE CAPO FOR STRINGED MUSICAL INSTRUMENTS

CROSS-REFERENCE TO RELATED APPLICATIONS

This application is a continuation of U.S. application Ser. No. 14/615,767 which was filed Feb. 6, 2015, which is a continuation-in-part of U.S. application Ser. No. 14/076,559 which was filed Nov. 11, 2013 and subsequently issued as U.S. Pat. No. 8,962,958, which is a continuation of U.S. application Ser. No. 13/357,597 which was filed Jan. 24, 2012 and subsequently issued as U.S. Pat. No. 8,618,389. The disclosure of application Ser. Nos. 14/615,767, 14/076,559 and 13/357,597 is hereby incorporated by reference.

BACKGROUND

As is appreciated in the art of musical instruments, a capo (also formally known as either a "capodastro" or a "capotasto") can be attached to the neck of a stringed musical instrument in order to shorten the playable length (e.g., the effective length) of selected strings of the instrument without a user having to apply finger pressure to the selected strings. A capo can thus be used to alter the sound of selected strings of a stringed musical instrument by upwardly transposing the pitch of the sound the selected strings will generate whenever the user applies energy to them by either plucking them, or striking them, or strumming them, or bowing them, or the like.

SUMMARY

This Summary is provided to introduce a selection of concepts, in a simplified form, that are further described hereafter in the Detailed Description. This Summary is not intended to identify key features or essential features of the claimed subject matter, nor is it intended to be used as an aid in determining the scope of the claimed subject matter. Its sole purpose is to present some concepts of the claimed subject matter in a simplified form as a prelude to the more detailed description that is presented below.

Fully-adjustable capo embodiments described herein generally involve a tuning apparatus for a musical instrument, where the instrument includes an elongated neck having a front surface over which a plurality of strings is stretched. In one exemplary embodiment the tuning apparatus includes a clamp, a plurality of string-contacting members, and a string-contacting member spacing adjustment mechanism. The clamp is adapted to removably attach to a desired longitudinal position on the neck. Each of the string-contacting members is rotatably supported by the clamp and is adapted to rotate thereon independently of the other string-contacting members, where this rotation occurs along a plane that is substantially perpendicular to the front surface of the neck. Each of the string-contacting members is also adapted to adjustably impinge upon and urge either a given string or course of strings toward a user-selectable one of three different longitudinal positions on this front surface, where these positions include a home position, a home−1 position that is closer to a headstock end of the neck than the home position, and a home+1 position that is farther from the headstock end of the neck than the home position. The string-contacting member spacing adjustment mechanism is adapted to allow a user to slidably adjust the location of the string-contacting members as a group on the clamp so as to substantially center the plane of rotation of each of the string-contacting members over a different string or course of strings, and to maintain substantially equal spacing between each different adjacent pair of string-contacting members.

In another exemplary embodiment each of the string-contacting members rotates along a plane that is substantially parallel to either a given string or course of strings. Each of the string-contacting members includes a rocker arm and a rocker hammer. The rocker arm includes an arm substrate that includes an elongated upper portion. The rocker hammer is adapted to allow it to be slidably disposed onto this upper portion and also allow a user to change its longitudinal position on this upper portion at will, thus allowing the user to adjust the home−1 and home+1 positions.

In yet another exemplary embodiment each of the string-contacting members includes a rocker hammer that includes a hammer substrate and a durable and resiliently flexible string-contacting hammer element that is securely disposed onto the hammer substrate. The string-contacting hammer element includes a home+1 string-contacting surface, a home−1 string-contacting surface, and a bridge-side aperture and a headstock-side aperture both of which pass completely through the string-contacting hammer element from the left side to the right side thereof. The home+1 string-contacting surface is adapted to impinge upon the given string or course of strings and urge this string or course toward the home+1 position on the front surface of the neck whenever the string-contacting member is engaged into a home+1 rotational orientation. The home−1 string-contacting surface is adapted to impinge upon this string or course and urge this string or course toward the home−1 position on this front surface whenever the string-contacting member is engaged into a home−1 rotational orientation. The bridge-side aperture is disposed between the home+1 string-contacting surface and the bridge-side edge of the hammer substrate. The headstock-side aperture is disposed between the home−1 string-contacting surface and the headstock-side edge of the hammer substrate.

DESCRIPTION OF THE DRAWINGS

The specific features, aspects, and advantages of the fully-adjustable capo embodiments described herein will become better understood with regard to the following description, appended claims, and accompanying drawings where:

FIG. 40 is a diagram illustrating a standalone plan view, in simplified form, of the hammer substrate of FIG. 34.

FIG. 41 is a diagram illustrating a plan view, in simplified form, of the hammer substrate of FIG. 40 rotated right 90 degrees.

FIG. 42 is a diagram illustrating a plan view, in simplified form, of the bottom of the hammer substrate of FIG. 40.

FIG. 43 is a diagram illustrating a perspective view, in simplified form, of the hammer substrate of FIG. 40.

FIG. 50 is a diagram illustrating a standalone plan view, in simplified form, of the alternate hammer substrate of FIG. 44.

FIG. 51 is a diagram illustrating a plan view, in simplified form, of the alternate hammer substrate of FIG. 50 rotated right 90 degrees.

FIG. 52 is a diagram illustrating a plan view, in simplified form, of the bottom of the alternate hammer substrate of FIG. 50.

FIG. 53 is a diagram illustrating a perspective view, in simplified form, of the alternate hammer substrate of FIG. 50.

DETAILED DESCRIPTION

Figure 1:
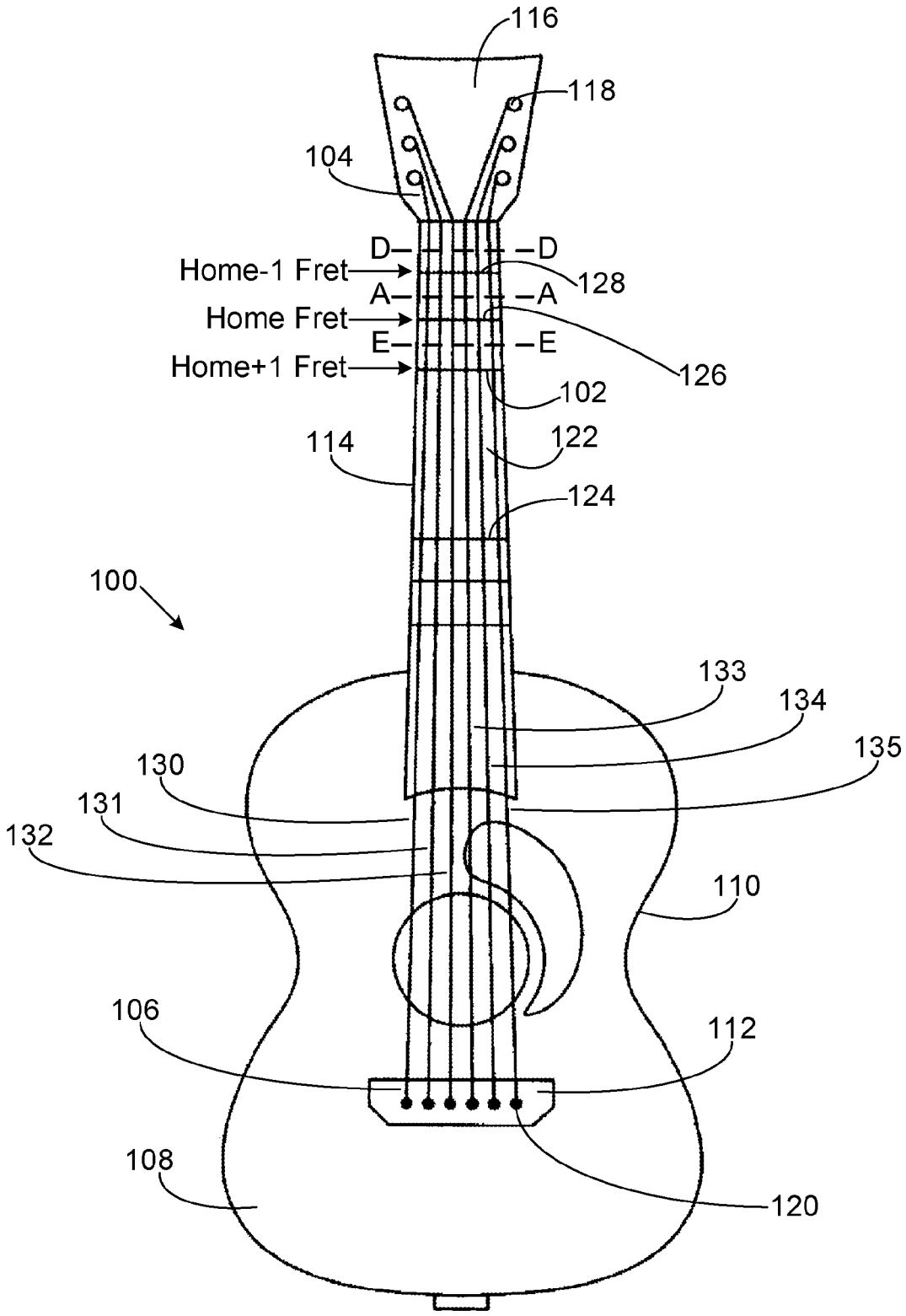
FIG. 1 is a diagram illustrating a front plan view, in simplified form, of an exemplary embodiment of a stringed musical instrument to which the fully-adjustable capo embodiments described herein can be removably attached by a user.

In the following description of fully-adjustable capo embodiments reference is made to the accompanying drawings which form a part hereof, and in which are shown, by way of illustration, specific embodiments in which the fully-adjustable capo can be practiced. It is understood that other embodiments can be utilized and structural changes can be made without departing from the scope of the fully-adjustable capo embodiments.

It is also noted that for the sake of clarity specific terminology will be resorted to in describing the fully-adjustable capo embodiments described herein and it is not intended for these embodiments to be limited to the specific terms so chosen. Furthermore, it is to be understood that each specific term includes all its technical equivalents that operate in a broadly similar manner to achieve a similar purpose. Reference herein to "one embodiment", or "another embodiment", or an "exemplary embodiment", or an "alternate embodiment", or "one implementation", or "another implementation", or an "exemplary implementation", or an "alternate implementation" means that a particular feature, a particular structure, or particular characteristics described in connection with the embodiment or implementation can be included in at least one embodiment of the fully-adjustable capo. The appearances of the phrases "in one embodiment", "in another embodiment", "in an exemplary embodiment", "in an alternate embodiment", "in one implementation", "in another implementation", "in an exemplary implementation", and "in an alternate implementation" in various places in the specification are not necessarily all referring to the same embodiment or implementation, nor are separate or alternative embodiments/implementations mutually exclusive of other embodiments/implementations. Yet furthermore, the order of process flow representing one or more embodiments or implementations of the fully-adjustable capo does not inherently indicate any particular order nor imply any limitations of the fully-adjustable capo.

The term "open position" is used herein to refer to a situation where a given string of a stringed musical instrument is not currently being impinged upon and urged (either by a user or by the fully-adjustable capo embodiments described herein) toward a front surface of an elongated neck of the instrument (e.g., the string is in its natural state). Furthermore, to the extent that the terms "includes," "including," "has," "contains," variants thereof, and other similar words are used in either this detailed description or the claims, these terms are intended to be inclusive, in a manner similar to the term "comprising", as an open transition word without precluding any additional or other elements.

1.0 Stringed Musical Instruments

The term "stringed musical instrument" (hereafter sometimes simply referred to as an instrument) is used herein to refer to any type of musical instrument having an elongated neck which includes a longitudinal axis and a front surface over which a plurality of strings is stretched. As is appreciated in the art of musical instruments, the front surface of the neck commonly includes a plurality of frets. A user can use finger pressure to temporarily impinge upon and urge one or more selected strings toward selected points on the front surface of the neck. In the case where the front surface of the neck includes frets, this finger pressure will result in the selected strings being temporarily pressed onto the frets that are adjacent to these selected points, which serves to shorten the playable length (herein also referred to as the "effective length") of the selected strings. This finger pressure will thus serve to upwardly transpose the pitch of the sound the selected strings will generate whenever the user applies energy to them by either plucking them, or striking them, or strumming them, or bowing them, or the like.

As is also appreciated in the art of musical instruments, there are many different types of stringed musical instruments having various numbers of strings. Popular examples of stringed musical instruments include the following. Bass guitars commonly have either four, or five, or six strings. Electric guitars and acoustic guitars commonly have either six or 12 strings. Banjos commonly have either four, or five, or six strings. Mandolins commonly have eight strings. Lutes commonly have either 13, or 15, or 24 strings. As is also appreciated in the art of musical instruments, the strings of a given stringed musical instrument can also be arranged into a plurality of courses where each of the courses includes a different and non-overlapping subset of the strings. By way of example but not limitation, the strings of a 12-string electric or acoustic guitar are commonly arranged into six courses (e.g., the 12 strings are arranged as six pairs of strings) as follows. The first course includes the first and second strings, the second course includes the third and fourth strings, the third course includes the fifth and sixth strings, the fourth course includes the seventh and eighth strings, the fifth course includes the ninth and tenth strings, and the sixth course includes the eleventh and twelfth strings.

As is also appreciated in the art of musical instruments, the elongated necks of the different types of stringed musical instruments can have different widths, thicknesses and cross-sectional shapes. The location of the frets on the front surface of the neck and the spacing between the various frets can be different on the different types of instruments. The spacing in-between the strings can also be different on the different types of instruments. The spacing between the left/right edge of the neck and the leftmost/rightmost string can also be different on the different types of instruments. The distance between any given string and the front surface of the neck can also be different on the different types of instruments (e.g., different types of instruments can have different actions).

FIG. 1 illustrates a front plan view, in simplified form, of an exemplary embodiment of a stringed musical instrument to which the fully-adjustable capo embodiments described herein can be removably attached by a user. The instrument exemplified in FIG. 1 is an acoustic guitar 100 which is generally configured as follows. The guitar 100 includes a soundboard 108, a resonant chamber 110, a bridge 112, an elongated neck 114, a headstock 116, and a prescribed number of strings (six in the illustrated embodiment, namely strings 130-135) each having a first end 104 and a second end 106. The bridge 112 is commonly rigidly attached to the soundboard 108. The soundboard 108 is rigidly attached to the resonant chamber 110. One end of the neck 114 is rigidly attached to the soundboard 108 and resonant chamber 110. The other end of the neck is rigidly attached to the headstock 116. The headstock 116 includes the prescribed number of tuning pegs 118, where each of the tuning pegs is rotatably attached to a different prescribed position on the headstock. The bridge 112 includes the prescribed number of anchor pegs 120 (or any like bridge fastening mechanisms), where each of the anchor pegs is rigidly attached to a different prescribed position on the bridge.

As exemplified in FIG. 1, the first end 104 of each of the strings 130-135 on the acoustic guitar 100 is securely attached to a different tuning peg 118, and the second end 106 of each of the strings is securely attached to a different anchor peg 120. The user can rotate selected tuning pegs 118 in order to stretch each of the strings 130-135 to a prescribed tension between the bridge 112 and headstock 116. The user can thus individually tune the strings 130-135 of the guitar 100 by rotating the tuning peg 118 each string is attached to and thus adjusting the amount of tension that is applied to the string. The elongated neck 114 of the guitar 100 includes a front surface 122 which may include a plurality of frets (e.g., frets 124, 126, 128 and 102) each having a raised edge, where the frets are sequentially disposed in different prescribed positions along a longitudinal axis of the neck on the front surface of the neck, and each of the frets is substantially perpendicular to this axis. The frets 124, 126, 128 and 102 serve to divide the front surface 122 of the neck 114 into sections.

Referring again to FIG. 1, the headstock 116, tuning pegs 118, elongated neck 114, frets (e.g., fret 124), bridge 112 and anchor pegs 120 are arranged such that the strings 130-135 have the following spatial relationships on the acoustic guitar 100. The strings 130-135 are disposed in substantially parallel spaced relation to the longitudinal axis of the neck 114. The strings 130-135 are also disposed in spaced relation to the front surface 122 of the neck 114. The distance between any given string and the front surface 122 of the neck 114 is known as the "action." The raised edge of each of the frets (e.g., fret 124) is in transverse relation to each of the strings 130-135. Each of the strings 130-135 is separated from the raised edge of each of the frets (e.g., fret 124) by a prescribed distance when each of the strings is in an open position (e.g., when none of the strings are currently being impinged upon and urged toward the front surface 122 of the neck 114). The user can change the note a given string (e.g., string 130) will generate by urging the string toward the front surface 122 of the neck 114 between a selected pair of adjacent frets (e.g., frets 126 and 102).

As is appreciated in the art of musical instruments, the strings of a stringed musical instrument are predominately tuned in what is known as a "standard tuning" where, generally speaking, the strings are individually tuned by rotating the tuning pegs as just described such that the sound generated by each of the strings is a prescribed tonal interval away from the sound generated by the adjacent strings. As such, the user of the instrument generally learns to play it using conventional fingering patterns to generate standard chords, standard scales and standard harmonic patterns. Whenever the instrument is tuned in the standard tuning, the user needs to use finger pressure to impinge upon and urge selected strings toward selected points on the front surface of the neck in order to play a specific chord or scale.

As is also appreciated in the art of musical instruments, the strings of a stringed musical instrument can also be tuned in various other ways such as what are commonly referred to as "alternative tunings" and "open tunings". Generally speaking, in the alternative and open tunings the tonal intervals between one or more pairs of adjacent strings are modified from the prescribed tonal intervals used in the standard tuning. Thus, the alternative and open tunings can be employed to produce noticeable variations in the sounds and harmonies that are generated by the instrument. Whenever the instrument is tuned in an alternative or open tuning, the user can play a specific chord with all the strings in the open position (e.g., the user does not need to use finger pressure to impinge upon and urge any of the strings toward the front surface of the neck in order to play a specific chord). However, since the tonal intervals between the various strings are modified from the prescribed tonal intervals used in the standard tuning, the user needs to use fingering patterns which are different from the conventional fingering patterns in order to generate the standard chords, standard scales and standard harmonic patterns. Additionally, different fingering patterns are associated with each of the different alternative and open tunings. In recent years there has been a substantial increase in the interest in alternative and open tunings from the perspective of both users of stringed musical instruments and listeners.

Various methods can be employed to change the tuning of the strings of an instrument from the standard tuning to a desired alternative or open tuning. One such method is to use the tuning pegs of the instrument to modify the amount of tension that is applied to selected strings as just described. Another such method is to employ the fully-adjustable capo embodiments described herein. More particularly and as will be described in more detail hereafter, in the aforementioned case where the front surface of the elongated neck of the instrument includes frets, the fully-adjustable capo embodiments can be removably attached to a desired longitudinal position on the elongated neck of the instrument such that a shaft of the fully-adjustable capo embodiments is substantially parallel to and approximately midway between a selected pair of adjacent frets on this front surface. The particular fret in the selected pair that is closest to the bridge of the instrument is hereafter referred to as a "home fret." The other fret in the selected pair (e.g., the particular fret in the selected pair that is closest to the headstock of the instrument) is hereafter referred to as a "home−1 fret." The particular fret on this front surface that is adjacent to the home fret on a side thereof that is opposite the home−1 fret is hereafter referred to as a "home+1 fret." By way of example but not limitation and referring again to FIG. 1, the fully-adjustable capo embodiments (not shown) can be removably attached to the neck 114 of the acoustic guitar 100 such that the shaft of the fully-adjustable capo embodiments is in the position indicated by line A-A. In this particular case fret 126 would be the home fret, fret 128 would be the home−1 fret, and fret 102 would be the home+1 fret.

2.0 Fully-Adjustable Capo for Stringed Musical Instruments

The fully-adjustable capo embodiments described herein generally involve an accessory/auxiliary tuning apparatus for a stringed musical instrument having a plurality of strings. The apparatus is generally applicable to either changing the tuning of any individual string on demand, or changing the tuning of any combination of two or more strings at the same time on demand, where these tuning changes occur without having to use the instrument's tuning pegs to modify the amount of tension that is applied to any of the strings (e.g., without having to modify the actual tuning of any of the strings).

More particularly and as will be described in more detail hereafter, once the fully-adjustable capo embodiments described herein have been removably attached to a desired longitudinal position on the elongated neck of the instrument such that the shaft of the fully-adjustable capo embodiments is substantially parallel to and approximately midway between a selected pair of adjacent frets on the front surface of the neck, the user of the instrument can configure the fully-adjustable capo embodiments on demand to shorten the effective length of either any individual string, or any combination of two or more strings at the same time, where this shortening takes place on each of the strings independently and within a span of three contiguous frets. In other words, the user can configure the fully-adjustable capo embodiments to adjustably and releasably depress any individual string onto any desired fret within the span of three contiguous frets. The user can also configure the fully-adjustable capo embodiments to adjustably and releasably depress any combination of two or more strings at the same time either onto any desired single fret within the span of three contiguous frets, or onto any combination of desired frets within this span. This ability to shorten the effective length of any selected combination of two or more strings at the same time onto a plurality of different frets allows entire chords to be generated by the fully-adjustable capo embodiments.

The fully-adjustable capo embodiments described herein are advantageous for various reasons including, but not limited to, the following. As will be appreciated from the more detailed description that follows, the fully-adjustable capo embodiments generally allow the user to enhance their musical performance and related enjoyment in various ways when playing the instrument. The fully-adjustable capo embodiments ensure reliable and consistent positioning thereof on the instrument's neck, and against the instrument's strings and the front surface of the neck. The fully-adjustable capo embodiments are cost effective, durable, and aesthetically pleasing. The fully-adjustable capo embodiments are easy to use, and are effective in various instrument playing scenarios such as practicing, teaching, and live performance, among others. The fully-adjustable capo embodiments can be repeatedly securely attached to and removed from the neck without damaging it or its finish (e.g., without scratching, nicking or denting the neck), and without damaging any other part of the instrument. Similarly, the fully-adjustable capo embodiments can be repeatedly used to change the tuning of the strings without any wear or damage occurring to the instrument or strings.

As will also be appreciated from the more detailed description that follows, the user of a stringed musical instrument can quickly and securely attach the fully-adjustable capo embodiments described herein to the instrument's neck with ease, simplicity and integrity whenever they want to change the tuning of the instrument's strings from the standard tuning to an alternate or open tuning. Once the fully-adjustable capo embodiments have been attached to the neck, the user can use the fully-adjustable capo embodiments to easily, reliably and quickly switch from the standard tuning to any one of a very large number of alternative and open tunings on demand, or switch from one particular alternative or open tuning to another on demand, or switch from a particular alternative or open tuning back to the standard tuning on demand, all without having to change the actual tuning of the strings. By way of example but not limitation, in an exemplary situation where the fully-adjustable capo embodiments are attached to the neck of a six string guitar, the user can use the fully-adjustable capo embodiments to easily, reliably and quickly switch between $2^{24}$=16,777,216 different possible tunings on the guitar. The user can also easily and quickly remove the fully-adjustable capo embodiments from the neck at will.

As will also be appreciated from the more detailed description that follows, when the fully-adjustable capo embodiments described herein are used to implement a selected alternative or open tuning on a stringed musical instrument, the user of the instrument can continue to play it in the selected tuning using the aforementioned conventional fingering patterns they already know (or using simple variations thereof). In other words, the fully-adjustable capo embodiments eliminate the need for the user to have to learn new chord and scale fingering patterns for each of the different alternative or open tunings they are interested in using on the instrument. Thus, the fully-adjustable capo embodiments allow the user to experiment with the instrument and easily generate a vast array of pleasing and harmonically complex new sounds and musical arrangements, which are quite different from the sounds and arrangements that can be generated using just the standard tuning, without having to change the actual tuning of the instrument's strings or learn new chord and scale fingering patterns. The fully-adjustable capo embodiments thus allow the user to conveniently add new tonal dimensions to their existing musical repertoire and express new musical ideas.

As will also be appreciated from the more detailed description that follows, the fully-adjustable capo embodiments described herein have an ergonomic design that maximizes the user's accessibility to the various strings and frets of their instrument, and minimizes any encumbrance the user might experience when the fully-adjustable capo embodiments are attached to the instrument's neck. In other words, the fully-adjustable capo embodiments do not impede or interfere with the user's hands or their ability to reach any desired fret (with the exception of the aforementioned home fret) on any string, regardless of which if any strings are currently being impinged upon and urged toward the front surface of the instrument's neck by the fully-adjustable capo embodiments. The fully-adjustable capo embodiments are also expandable, universally adjustable, and universally configurable, which makes the fully-adjustable capo embodiments compatible with a wide variety of different types of stringed musical instruments (including, but not limited to, the various exemplary types of instruments described heretofore) and all of the different types of strings that can be used on these instruments.

Figure 2:
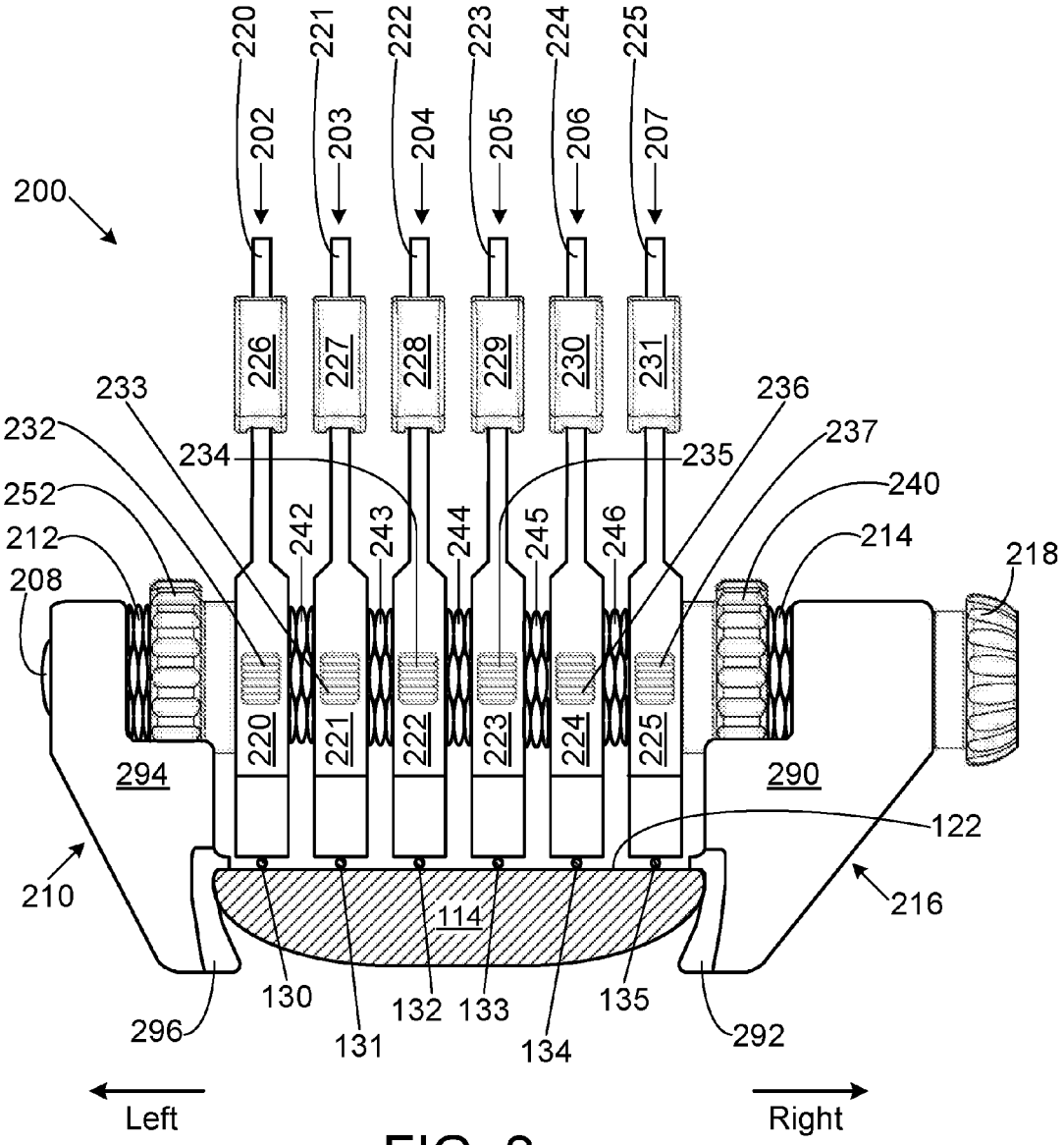
FIG. 2 is a diagram illustrating a front plan view, in simplified form, of one embodiment of the fully-adjustable capo that includes a clamp, a plurality of string-contacting members, and a string-contacting member spacing adjustment mechanism, where each of the string-contacting members is in a home rotational orientation and is impinging upon and urging a given string of the stringed musical instrument toward a home position on a front surface of an elongated neck of the instrument.

FIGS. 2-43 and 54-81 illustrate one embodiment, in simplified form, of the aforementioned tuning apparatus for a stringed musical instrument (hereafter simply referred to as a "tuning apparatus"). More particularly, FIG. 2 illustrates a front plan view, in simplified form, of one embodiment of the tuning apparatus 200 that includes a clamp, a plurality of string-contacting members (six in the illustrated embodiment, namely string-contacting members 202-207), and a string-contacting member spacing adjustment mechanism, where each of the string-contacting members is in a home rotational orientation and is impinging upon and urging a given string 130-135 of the instrument toward a home position on a front surface 122 of the elongated neck 114 of the instrument. The clamp is herein also referred to as a "neck-gripping means". Each of the string-contacting members 202-207 is herein also referred to as a "string-depressing means". The string-contacting member spacing adjustment mechanism is herein also referred to as a "string-contacting member spacing control means".

As exemplified in FIG. 2, the clamp of the tuning apparatus 200 includes a screw 208, a left jaw 210, a shaft (not shown), a right jaw 216, and a jaw-tightening member 218. Each of the string-contacting members 202-207 of the tuning apparatus 200 is slidably and rotatably disposed onto a center longitudinal section of the shaft and includes a rocker arm 220-225, a rocker hammer 226-231, and a ratchet mechanism that includes a pair of ratchet release levers (e.g., levers 232-237) along with additional components which will be described in more detail hereafter. The string-contacting member spacing adjustment mechanism of the tuning apparatus 200 includes a left wave spring 212, a left knob 252, a right knob 240, a right wave spring 214, and a number of member-spacing wave springs (five in the illustrated embodiment, namely member-spacing wave springs 242-246), where this number is one less than the total number of string-contacting members 202-207. The left wave spring 212 is slidably and rotatably disposed onto the shaft between the left jaw 210 and the left knob 252. The right wave spring 214 is slidably and rotatably disposed onto the shaft between the right jaw 216 and the right knob 240. A different one of the member-spacing wave springs 242-246 is slidably and rotatably disposed onto the shaft between each different adjacent pair of string-contacting members (e.g., member-spacing wave spring 242 is slidably and rotatably disposed onto the shaft between adjacent string-contacting members 202 and 203, member-spacing wave spring 243 is slidably and rotatably disposed onto the shaft between adjacent string-contacting members 203 and 204, member-spacing wave spring 244 is slidably and rotatably disposed onto the shaft between adjacent string-contacting members 204 and 205, member-spacing wave spring 245 is slidably and rotatably disposed onto the shaft between adjacent string-contacting members 205 and 206, and member-spacing wave spring 246 is slidably and rotatably disposed onto the shaft between adjacent string-contacting members 206 and 207). It is noted that the left wave spring 212, the member-spacing wave springs 242-246, and the right wave spring 214 are each shown in a semi-compressed state in FIG. 2.

Figure 3:
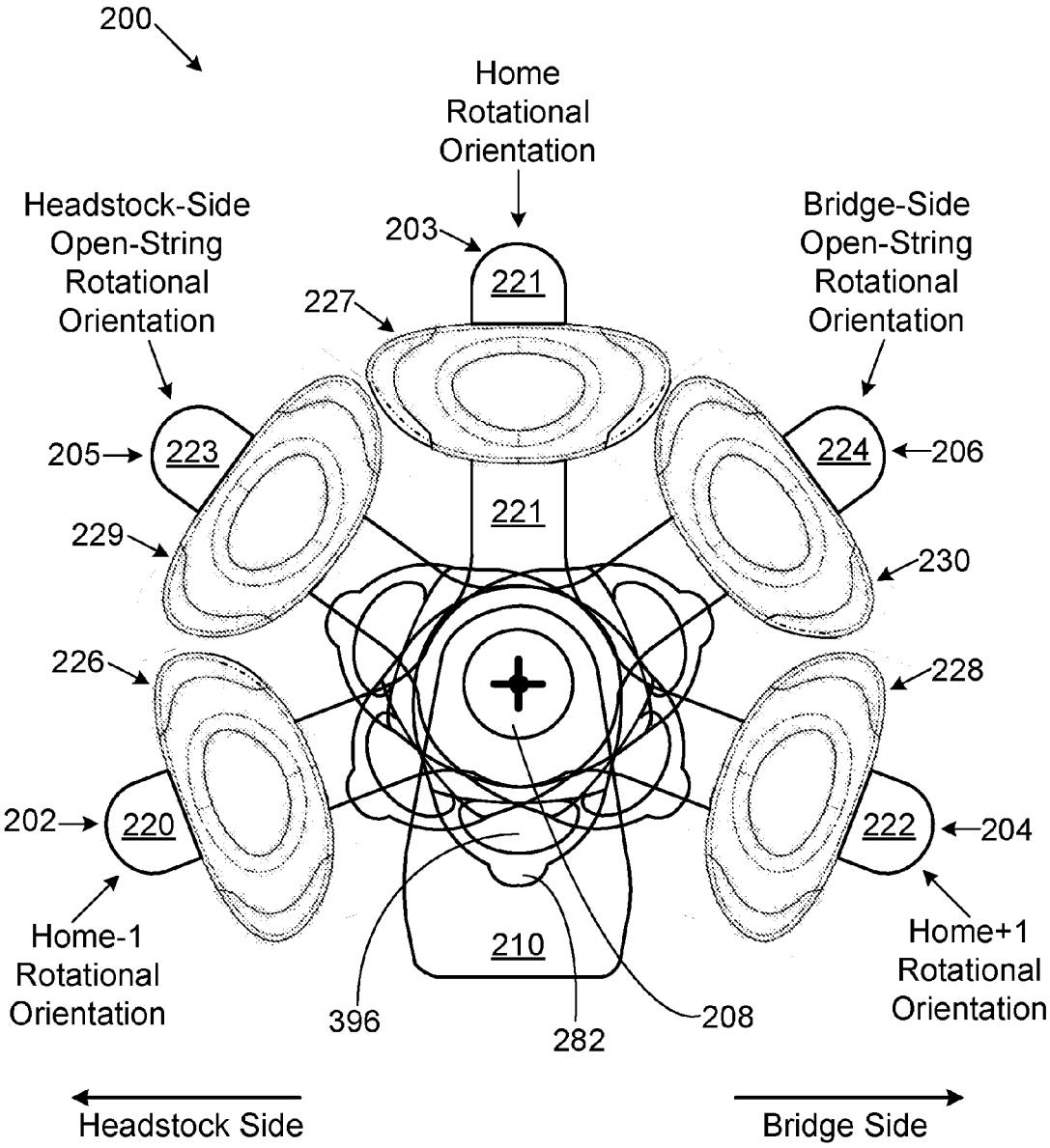
FIG. 3 is diagram illustrating a partially-transparent plan view, in simplified form, of the fully-adjustable capo of FIG. 2 rotated right 90 degrees, where some of the string-contacting members are in a home−1 rotational orientation, some of the string-contacting members are in a headstock-side open-string rotational orientation, some of the string-contacting members are in the home rotational orientation, some of the string-contacting members are in a bridge-side open-string rotational orientation, and some of the string-contacting members are in a home+1 rotational orientation.
Figure 4:
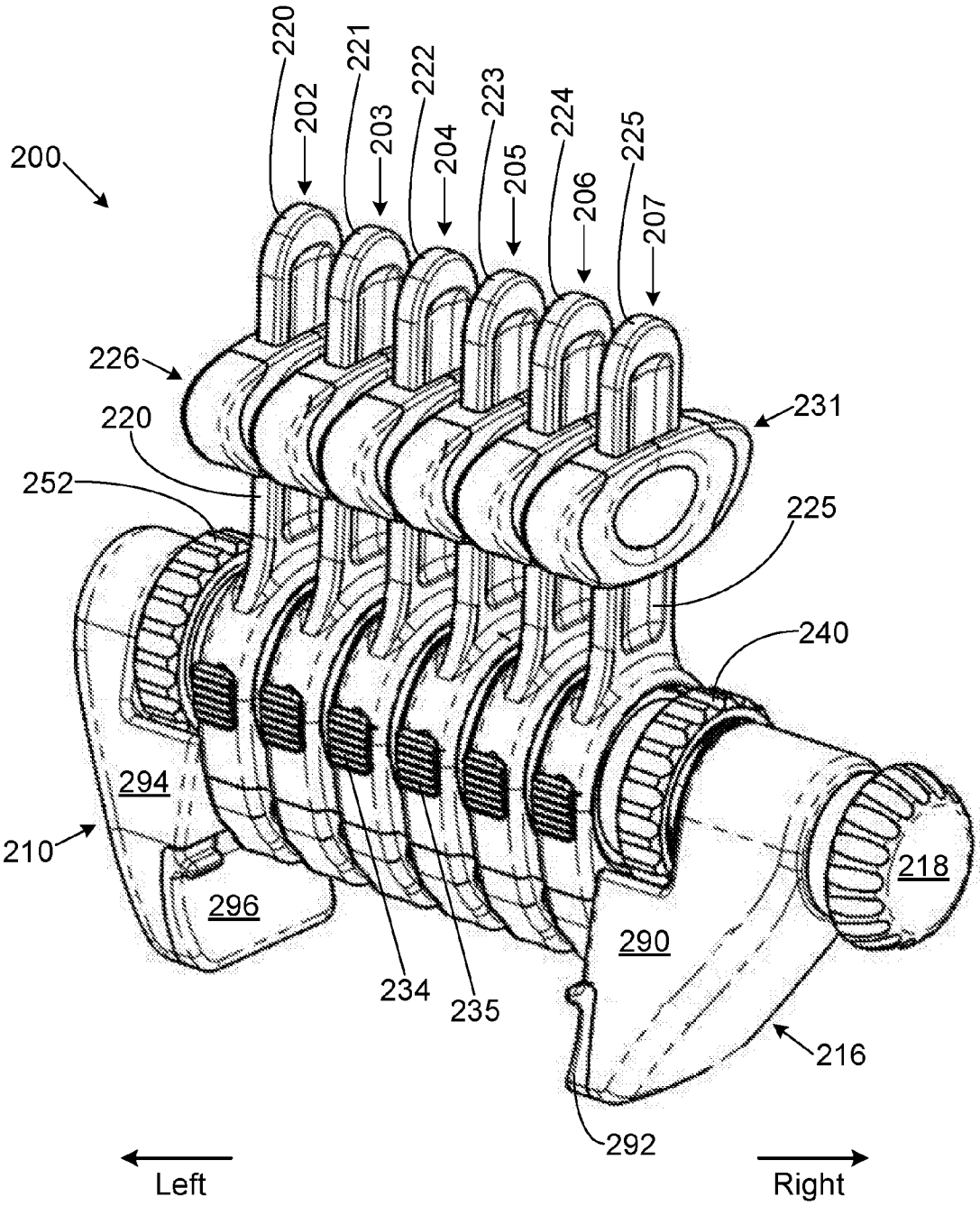
FIG. 4 is a diagram illustrating a perspective view, in simplified form, of the fully-adjustable capo of FIG. 2.
Figure 5:
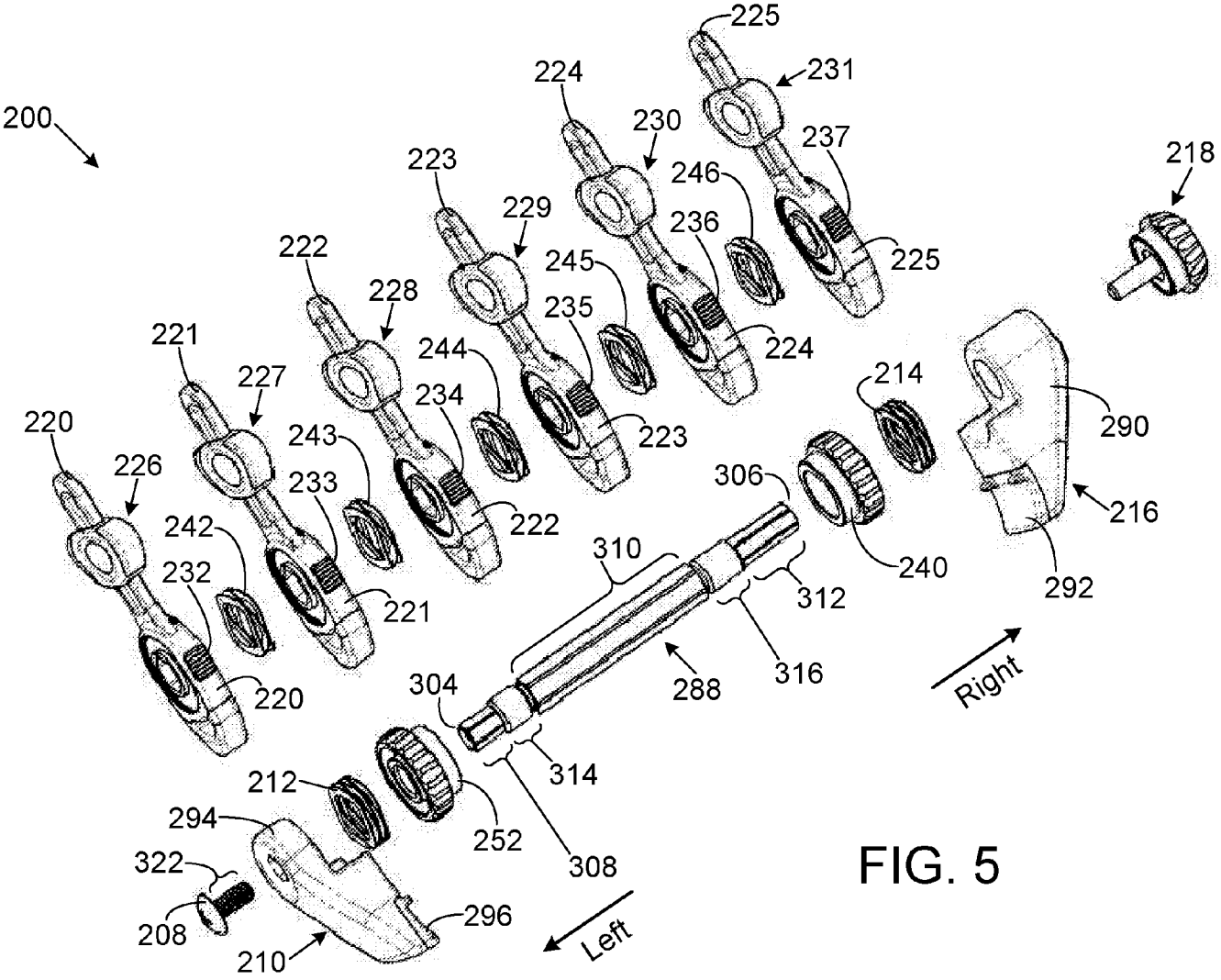
FIG. 5 is a diagram illustrating a partially-exploded perspective view, in simplified form, of the fully-adjustable capo of FIG. 2.

FIG. 3 illustrates a partially-transparent plan view, in simplified form, of the tuning apparatus 200 of FIG. 2 rotated right 90 degrees, where some of the string-contacting members are in a home−1 rotational orientation (e.g., member 202), some of the string-contacting members are in a headstock-side open-string rotational orientation (e.g., member 205), some of the string-contacting members are in the home rotational orientation (e.g., member 203), some of the string-contacting members are in a bridge-side open-string rotational orientation (e.g., member 206), and some of the string-contacting members are in a home+1 rotational orientation (e.g., member 204). FIG. 4 illustrates a perspective view, in simplified form, of the tuning apparatus 200 of FIG. 2. FIG. 5 illustrates a partially-exploded perspective view, in simplified form, of the tuning apparatus 200 of FIG. 2 which exposes the shaft 288 of the clamp. It is noted that the left wave spring 212, the member-spacing wave springs 242-246, and the right wave spring 214 are each shown in an uncompressed state in FIG. 5.

Figure 10:
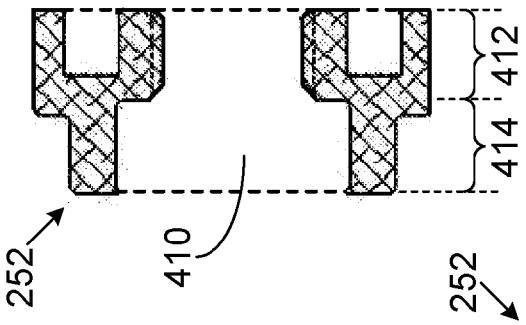
FIG. 10 is a diagram illustrating a cross-sectional view, in simplified form, of the left knob taken along line B-B of FIG. 9.
Figure 8:
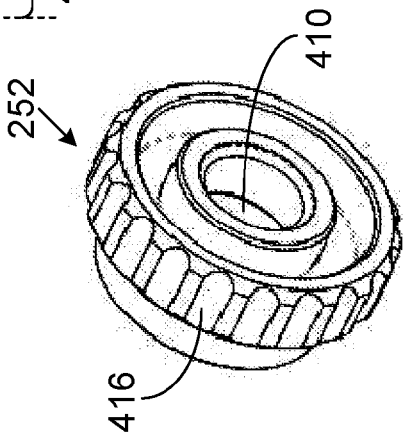
FIGS. 7 and 8 are diagrams illustrating two different perspective views, in simplified form, of the left knob of FIG. 6.
Figure 9:
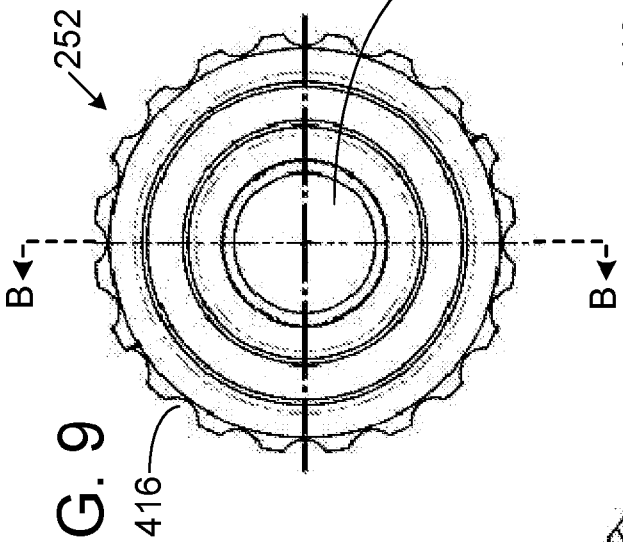
FIG. 9 is a diagram illustrating a partially-transparent plan view, in simplified form, of the left knob of FIG. 6 rotated right 90 degrees.
Figure 7:
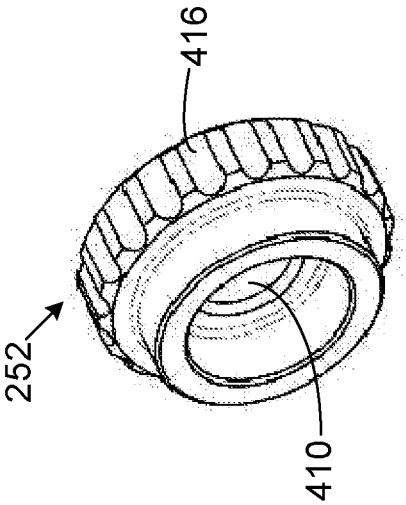
Figure 6:
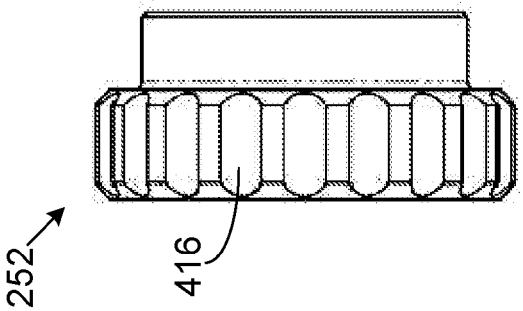
FIG. 6 is a diagram illustrating a standalone front plan view, in simplified form, of an exemplary embodiment of the left knob of the string-contacting member spacing adjustment mechanism of FIG. 2.

FIG. 6 illustrates a standalone front plan view, in simplified form, of an exemplary embodiment of the left knob 252 of the string-contacting member spacing adjustment mechanism of FIG. 2. FIGS. 7 and 8 illustrate two different perspective views, in simplified form, of the left knob 252 of FIG. 6. FIG. 9 illustrates a partially-transparent plan view, in simplified form, of the left knob 252 of FIG. 6 rotated right 90 degrees. FIG. 10 illustrates a cross-sectional view, in simplified form, of the left knob 252 taken along line B-B of FIG. 9. As exemplified in FIGS. 2, 4 and 5, the right knob 240 of the string-contacting member spacing adjustment mechanism is structurally the same as the left knob 252 thereof.

Figure 12:
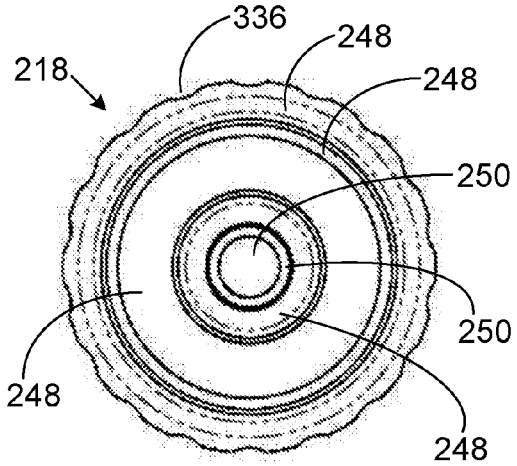
FIG. 12 is a diagram illustrating a partially-transparent plan view, in simplified form, of the jaw-tightening member of FIG. 11 rotated right 90 degrees.
Figure 11:
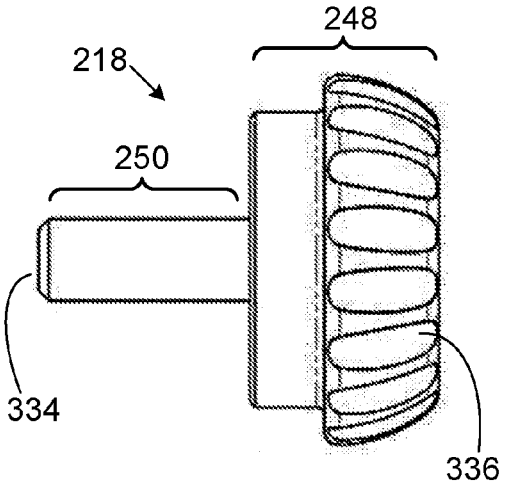
FIG. 11 is a diagram illustrating a standalone front plan view, in simplified form, of an exemplary embodiment of a jaw-tightening member of the clamp of FIG. 2.
Figure 13:
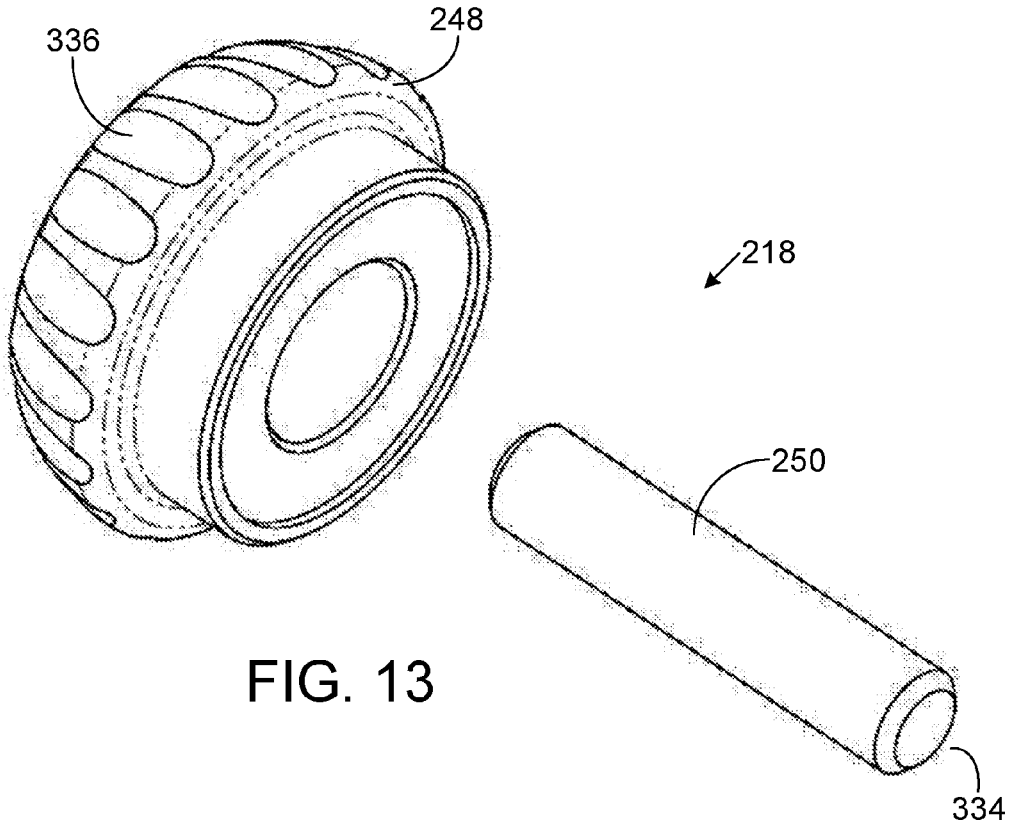
FIG. 13 is a diagram illustrating an exploded perspective view, in simplified form, of the jaw-tightening member of FIG. 11.
Figure 18:
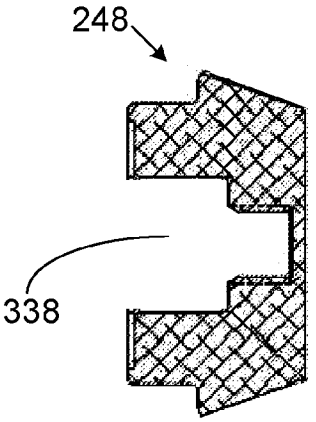
FIG. 18 is a diagram illustrating a cross-sectional view, in simplified form, of the knob taken along line C-C of FIG. 17.
Figure 17:
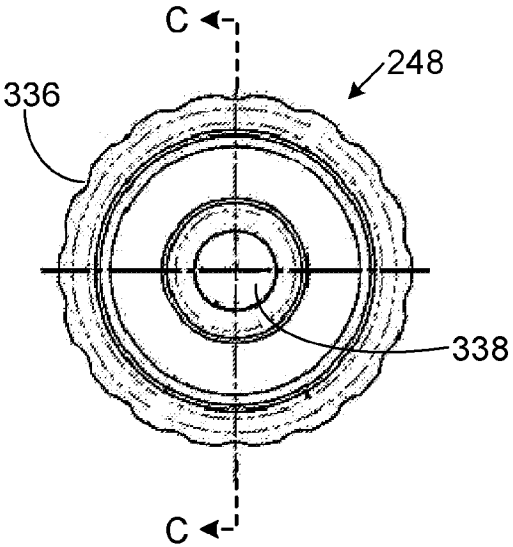
FIG. 17 is a diagram illustrating a partially-transparent plan view, in simplified form, of the knob of FIG. 14 rotated left 90 degrees.
Figure 14:
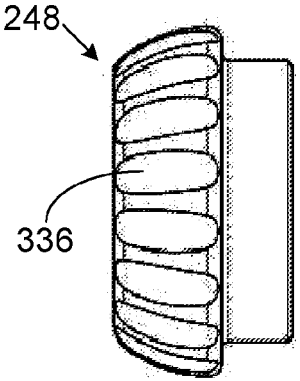
FIG. 14 is a diagram illustrating a standalone plan view, in simplified form, of an exemplary embodiment of a knob of the jaw-tightening member of FIG. 11 rotated right 180 degrees.
Figure 16:
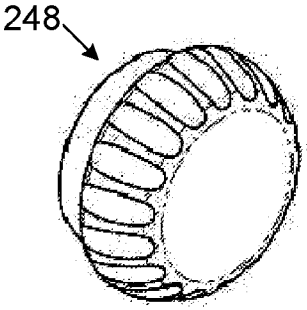
FIGS. 15 and 16 are diagrams illustrating two different perspective views, in simplified form, of the knob of FIG. 14.
Figure 15:
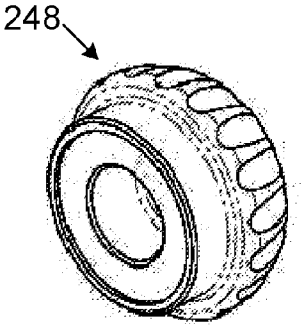
Figure 20:
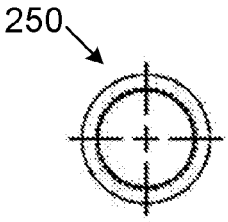
FIG. 20 is a diagram illustrating a plan view, in simplified form, of the treaded shaft of FIG. 19 rotated right 90 degrees.
Figure 19:
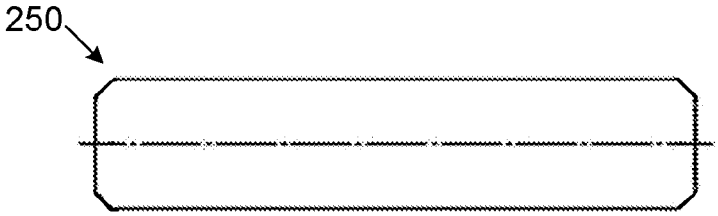
FIG. 19 is a diagram illustrating a standalone front plan view, in simplified form, of an exemplary embodiment of a treaded shaft (threads not shown) of the tightening member of FIG. 11.

FIG. 11 illustrates a standalone front plan view, in simplified form, of an exemplary embodiment of the jaw-tightening member 218 of the clamp of FIG. 2, where this member 218 includes a knob 248 and a threaded shaft 250 (threads not shown). FIG. 12 illustrates a partially-transparent plan view, in simplified form, of the jaw-tightening member 218 of FIG. 11 rotated right 90 degrees. FIG. 13 illustrates an exploded perspective view, in simplified form, of the jaw-tightening member 218 of FIG. 11. FIG. 14 illustrates a standalone plan view, in simplified form, of an exemplary embodiment of the knob 248 of the jaw-tightening member 218 of FIG. 11 rotated right 180 degrees. FIGS. 15 and 16 illustrate two different perspective views, in simplified form, of the knob 248 of FIG. 14. FIG. 17 illustrates a partially-transparent plan view, in simplified form, of the knob 248 of FIG. 14 rotated left 90 degrees. FIG. 18 illustrates a cross-sectional view, in simplified form, of the knob 248 taken along line C-C of FIG. 17. FIG. 19 illustrates a standalone front plan view, in simplified form, of an exemplary embodiment of the treaded shaft 250 (threads not shown) of the jaw-tightening member 218 of FIG. 11. FIG. 20 illustrates a plan view, in simplified form, of the treaded shaft 250 of FIG. 19 rotated right 90 degrees.

Figure 21:
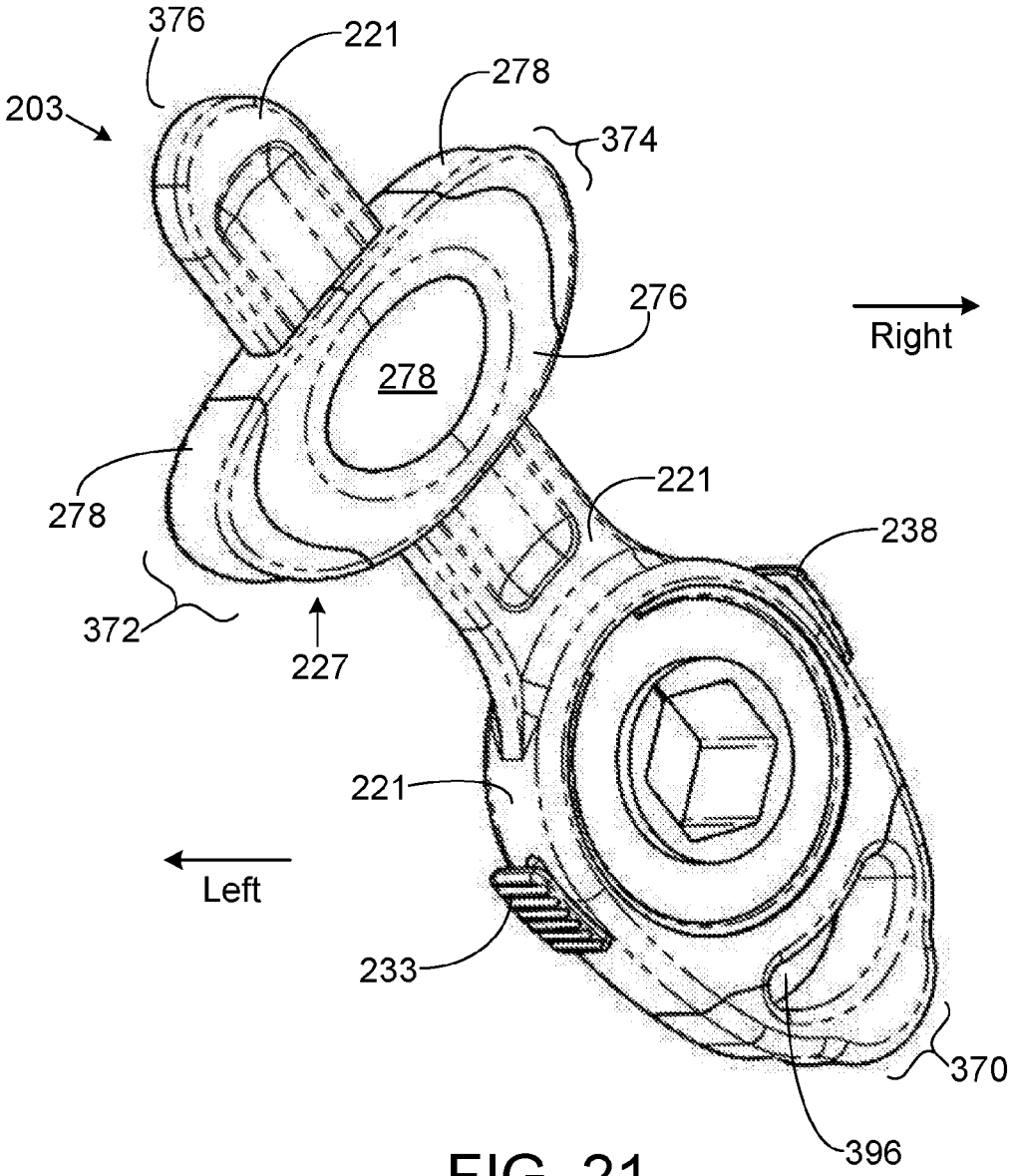
FIG. 21 is a diagram illustrating a standalone perspective view, in simplified form, of one embodiment of one of the string-contacting members of FIG. 2.
Figure 22:
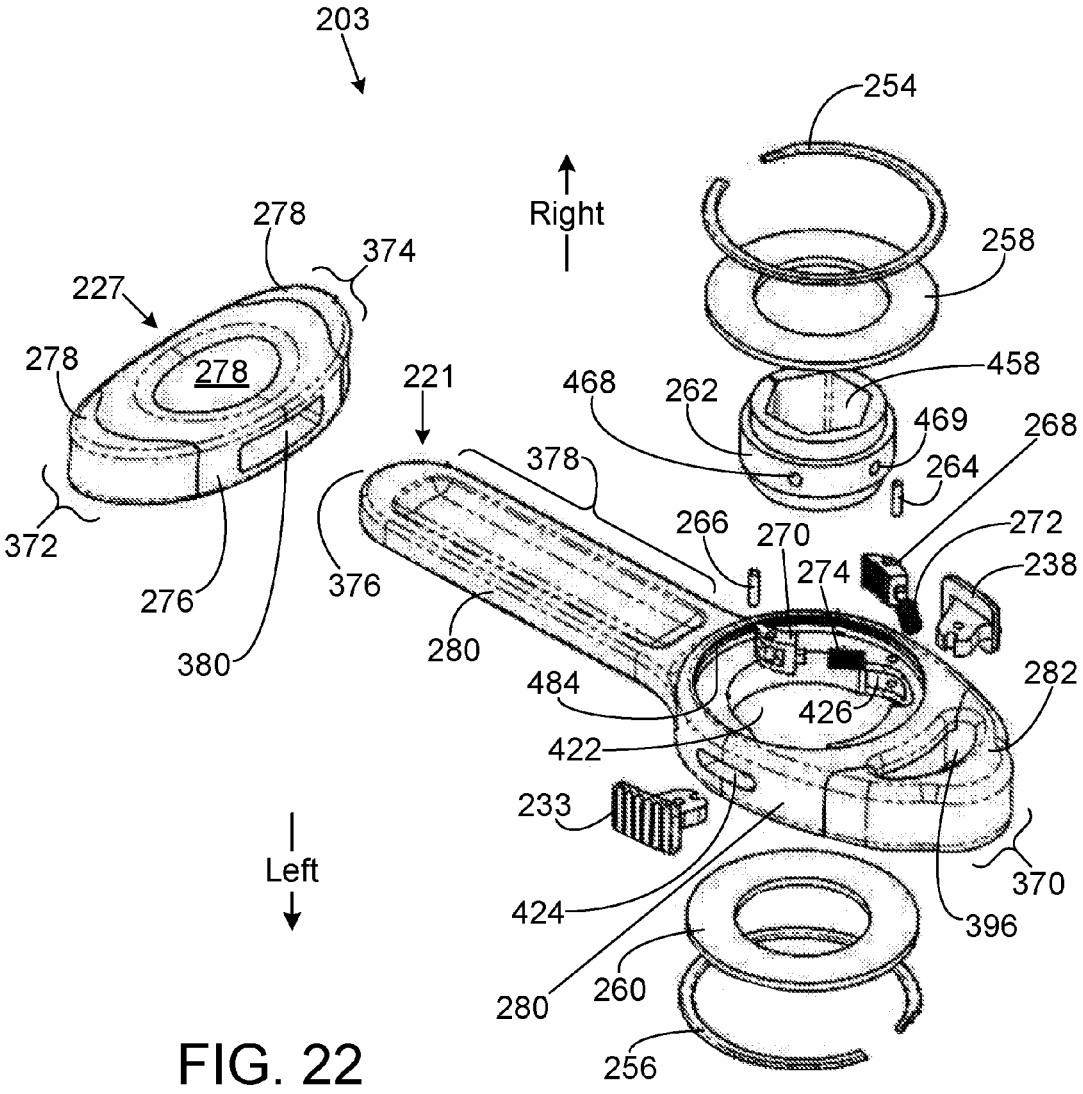
FIG. 22 is a diagram illustrating a partially-exploded perspective view, in simplified form, of the string-contacting member of FIG. 21, where this string-contacting member includes a rocker arm, a rocker hammer, and a ratchet mechanism that is installed within the rocker arm, where the ratchet mechanism includes a pair of spiral internal retaining rings, a pair of ratchet covers, a ratchet hub, a pair of dowel pins, a pair of ratchet pawls, a pair of compression springs, and a pair of ratchet release levers. In one implementation of the fully-adjustable capo embodiments described herein the ratchet mechanism may also include an externally-threaded ball-nose spring plunger.
Figure 26:
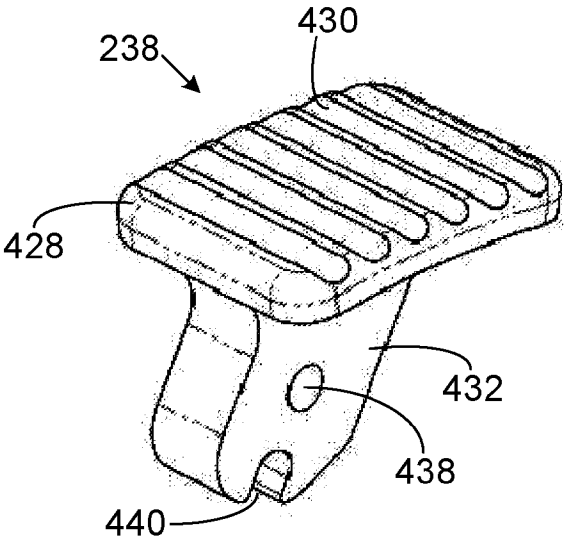
FIG. 26 is a diagram illustrating a perspective view, in simplified form, of the ratchet release lever of FIG. 23.
Figure 24:
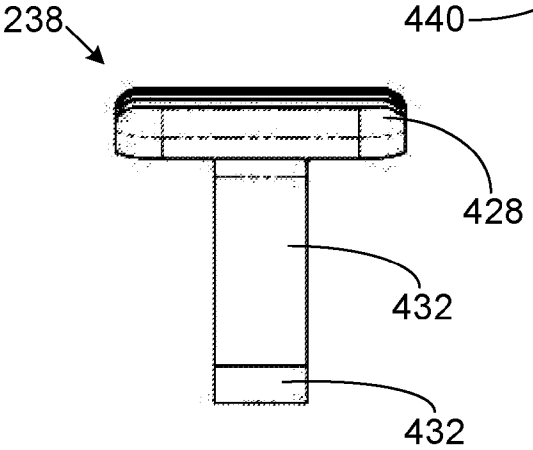
FIG. 24 is a diagram illustrating a plan view, in simplified form, of the ratchet release lever of FIG. 23 rotated right 90 degrees.
Figure 25:
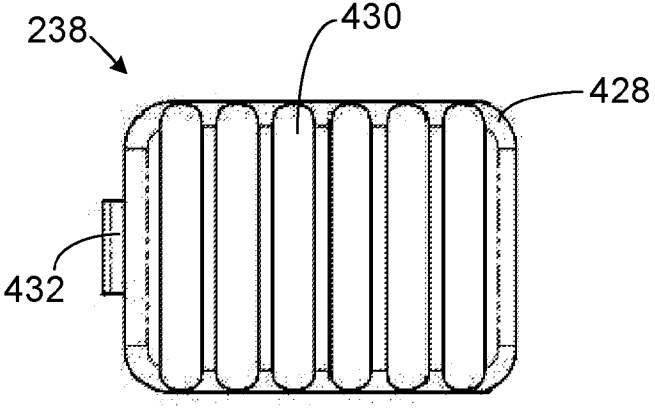
FIG. 25 is a diagram illustrating a plan view, in simplified form, of the top of the ratchet release lever of FIG. 23.
Figure 23:
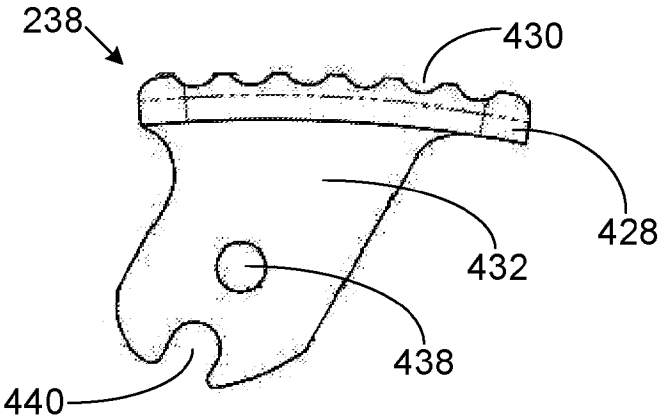
FIG. 23 is a diagram illustrating a standalone plan view, in simplified form, of an exemplary embodiment of one of the ratchet release levers of FIG. 22.
Figure 27:
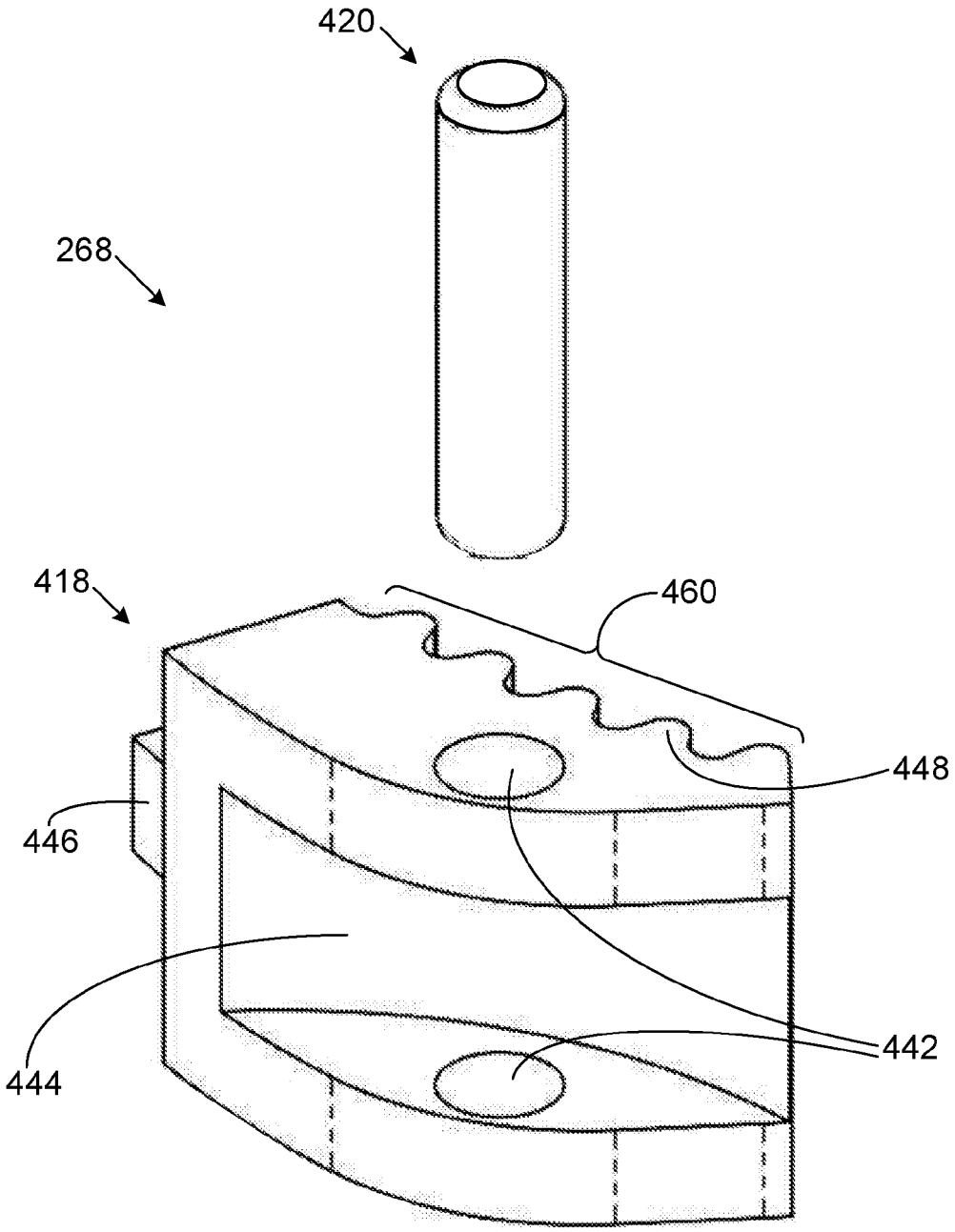
FIG. 27 is a diagram illustrating an enlarged standalone exploded perspective view, in simplified form, of an exemplary embodiment of one of the ratchet pawls of FIG. 22, where this ratchet pawl includes a pawl member and a pawl dowel pin.
Figure 28:
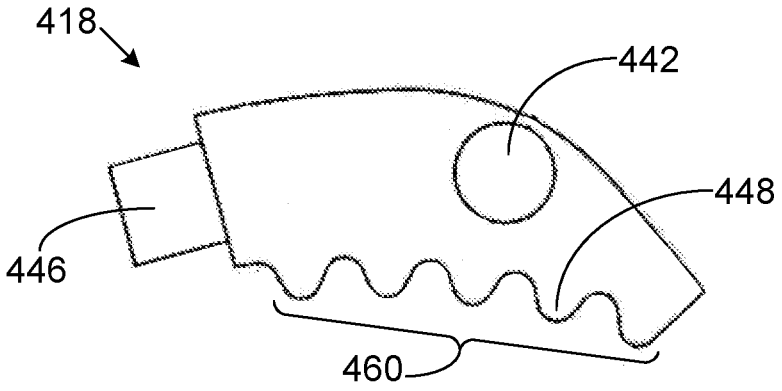
FIG. 28 is a diagram illustrating a standalone plan view, in simplified form, of an exemplary embodiment of the pawl member of FIG. 27.
Figure 29:
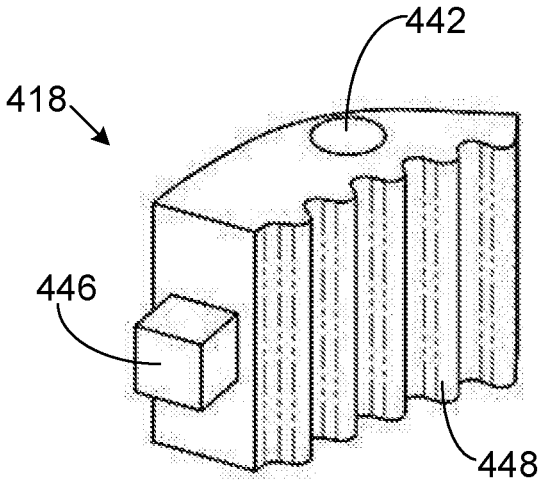
FIG. 29 is a diagram illustrating a perspective view, in simplified form, of the pawl member of FIG. 28.
Figure 33:
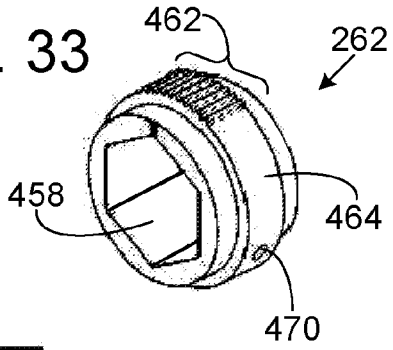
FIG. 33 is a diagram illustrating a perspective view, in simplified form, of the ratchet hub of FIG. 30.
Figure 31:
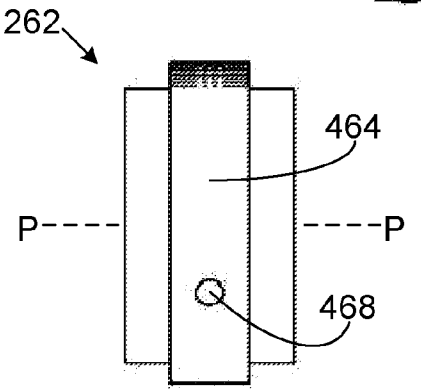
FIG. 31 is a diagram illustrating a plan view, in simplified form, of the ratchet hub of FIG. 30 rotated right 90 degrees.
Figure 30:
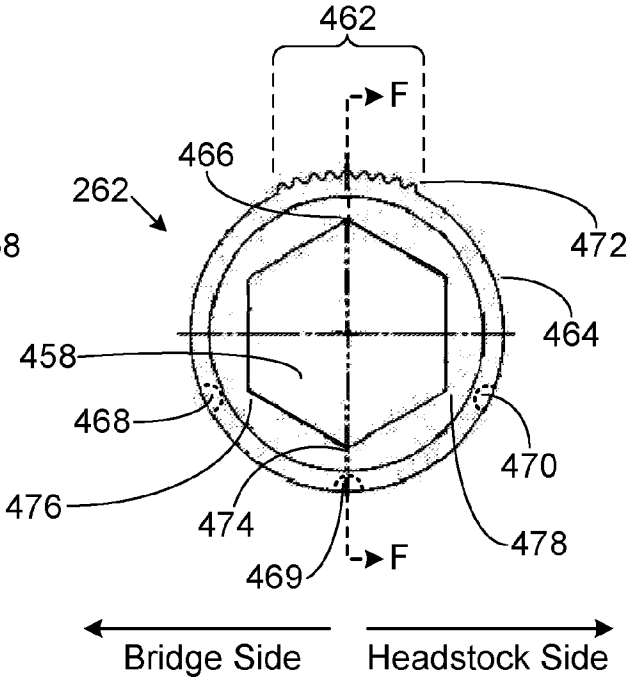
FIG. 30 is a diagram illustrating a standalone transparent plan view, in simplified form, of an exemplary embodiment of the ratchet hub of FIG. 22.
Figure 32:
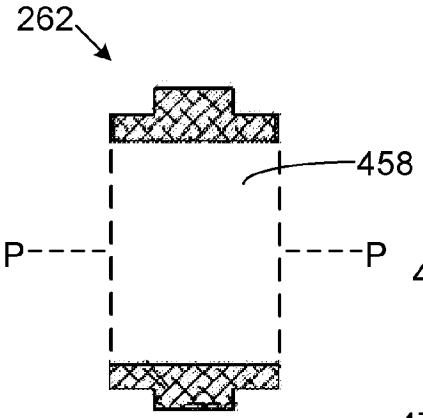
FIG. 32 is a diagram illustrating a cross-sectional view, in simplified form, of the ratchet hub taken along line F-F of FIG. 30.

FIG. 21 illustrates a standalone perspective view, in simplified form, of one embodiment of one of the string-contacting members (e.g., member 203) of FIG. 2. FIG. 22 illustrates a partially-exploded perspective view, in simplified form, of the string-contacting member 203 of FIG. 21, where this string-contacting member 203 includes a rocker arm 221, a rocker hammer 227, and a ratchet mechanism that is installed within the rocker arm, where the ratchet mechanism includes a pair of spiral internal retaining rings 254 and 256, a pair of ratchet covers 258 and 260, a ratchet hub 262, a pair of lever dowel pins 264 and 266, a pair of ratchet pawls 268 and 270, a pair of compression springs 272 and 274, and a pair of ratchet release levers 233 and 238. In one implementation of the tuning apparatus described herein, the ratchet mechanism may also include an externally-threaded ball-nose spring plunger (not shown). FIG. 23 illustrates a standalone plan view, in simplified form, of an exemplary embodiment of one of the ratchet release levers (e.g., lever 238) of FIG. 22. FIG. 24 illustrates a plan view, in simplified form, of the ratchet release lever 238 of FIG. 23 rotated right 90 degrees. FIG. 25 illustrates a plan view, in simplified form, of the top of the ratchet release lever 238 of FIG. 23. FIG. 26 illustrates a perspective view, in simplified form, of the ratchet release lever 238 of FIG. 23. FIG. 27 illustrates an enlarged standalone exploded perspective view, in simplified form, of an exemplary embodiment of one of the ratchet pawls (e.g., ratchet pawl 268) of FIG. 22, where this ratchet pawl 268 includes a pawl member 418 and a pawl dowel pin 420. FIG. 28 illustrates a standalone plan view, in simplified form, of an exemplary embodiment of the pawl member 418 of FIG. 27. FIG. 29 illustrates a perspective view, in simplified form, of the pawl member 418 of FIG. 28. FIG. 30 illustrates a standalone transparent plan view, in simplified form, of an exemplary embodiment of the ratchet hub 262 of FIG. 22. FIG. 31 illustrates a plan view, in simplified form, of the ratchet hub 262 of FIG. 30 rotated right 90 degrees. FIG. 32 illustrates a cross-sectional view, in simplified form, of the ratchet hub 262 taken along line F-F of FIG. 30. FIG. 33 illustrates a perspective view, in simplified form, of the ratchet hub 262 of FIG. 30.

Figures 34, 35, 36, 37, 38, 39:
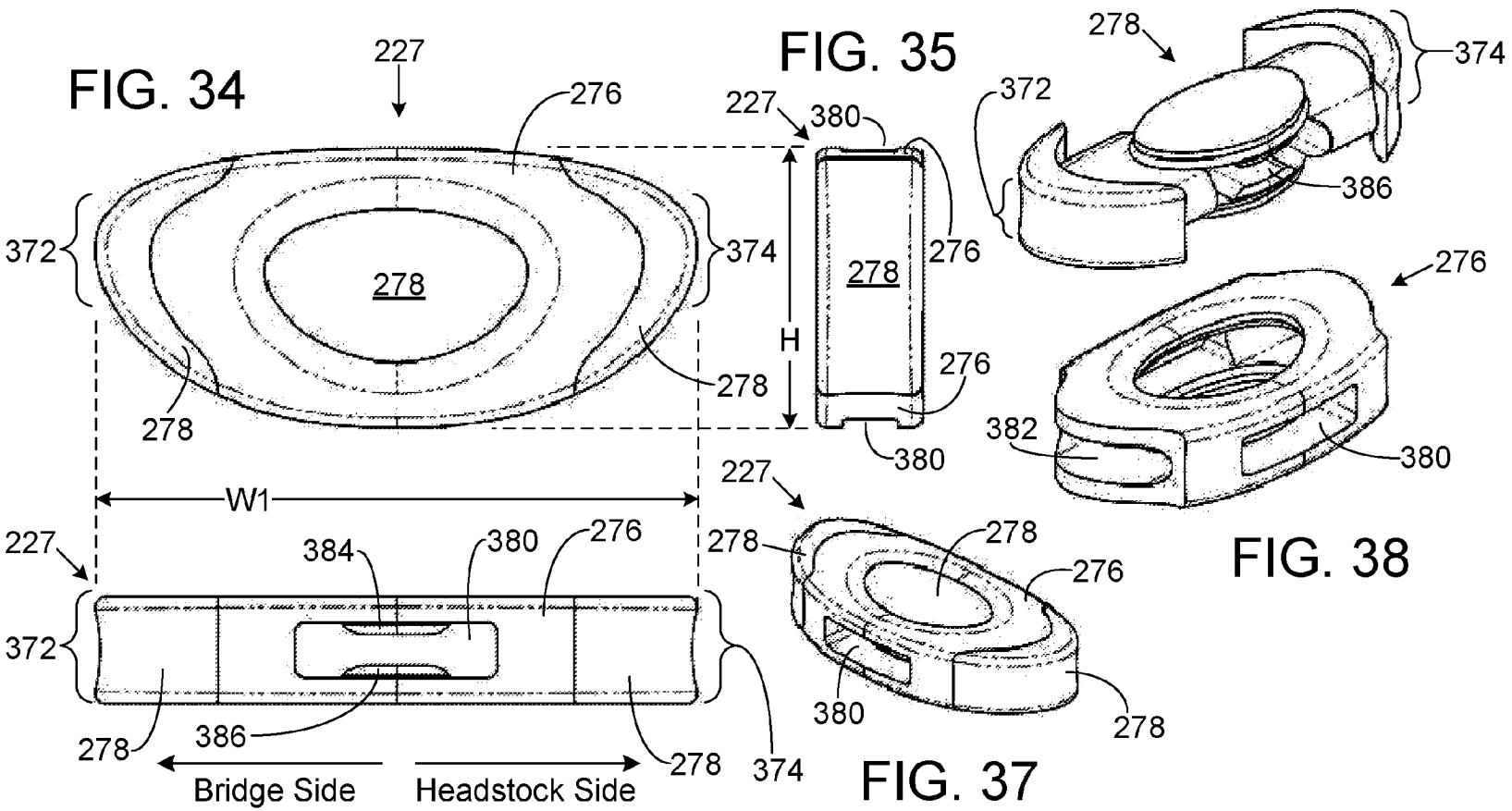
FIG. 34 is a diagram illustrating a standalone plan view, in simplified form, of an exemplary embodiment of the rocker hammer of FIG. 22, where this embodiment of the rocker hammer includes a hammer substrate and a string-contacting hammer element that is securely disposed onto the hammer substrate.
FIG. 35 is a diagram illustrating a plan view, in simplified form, of the rocker hammer of FIG. 34 rotated right 90 degrees.
FIG. 36 is a diagram illustrating a plan view, in simplified form, of the bottom of the rocker hammer of FIG. 34.
FIG. 37 is a diagram illustrating a perspective view, in simplified form, of the rocker hammer of FIG. 34.
FIG. 38 is a diagram illustrating a standalone perspective view, in simplified form, of an exemplary embodiment of the hammer substrate of the rocker hammer of FIG. 34 before the string-contacting hammer element has been securely disposed onto the hammer substrate.
FIG. 39 is a diagram illustrating a standalone perspective view, in simplified form, of an exemplary embodiment of the string-contacting hammer element that is securely disposed onto the hammer substrate.

FIG. 34 illustrates a standalone plan view, in simplified form, of an exemplary embodiment of the rocker hammer 227 of FIG. 22, where this embodiment of the rocker hammer includes a hammer substrate 276 and a string-contacting hammer element 278 that is securely disposed onto the hammer substrate. FIG. 35 illustrates a plan view, in simplified form, of the rocker hammer 227 of FIG. 34 rotated right 90 degrees. FIG. 36 illustrates a plan view, in simplified form, of the bottom of the rocker hammer 227 of FIG. 34. FIG. 37 illustrates a perspective view, in simplified form, of the rocker hammer 227 of FIG. 34. FIG. 38 illustrates a standalone perspective view, in simplified form, of an exemplary embodiment of the hammer substrate 276 of the rocker hammer 227 of FIG. 34 before the string-contacting hammer element 278 has been securely disposed onto the hammer substrate. FIG. 39 illustrates a standalone perspective view, in simplified form, of an exemplary embodiment of the string-contacting hammer element 278 that is securely disposed onto the hammer substrate 276. FIG. 40 illustrates a standalone plan view, in simplified form, of the hammer substrate 276 of FIG. 34. FIG. 41 illustrates a plan view, in simplified form, of the hammer substrate 276 of FIG. 40 rotated right 90 degrees. FIG. 42 illustrates a plan view, in simplified form, of the bottom of the hammer substrate 276 of FIG. 40. FIG. 43 illustrates a perspective view, in simplified form, of the hammer substrate 276 of FIG. 40.

Figure 54:
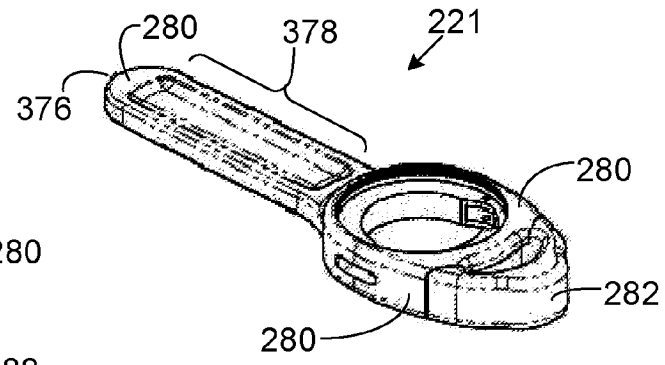
FIG. 54 is a diagram illustrating a standalone perspective view, in simplified form, of an exemplary embodiment of the rocker arm of FIG. 22, where this embodiment of the rocker arm includes an arm substrate and a string-contacting arm element that is securely disposed onto the bottom of the arm substrate.
Figure 55:
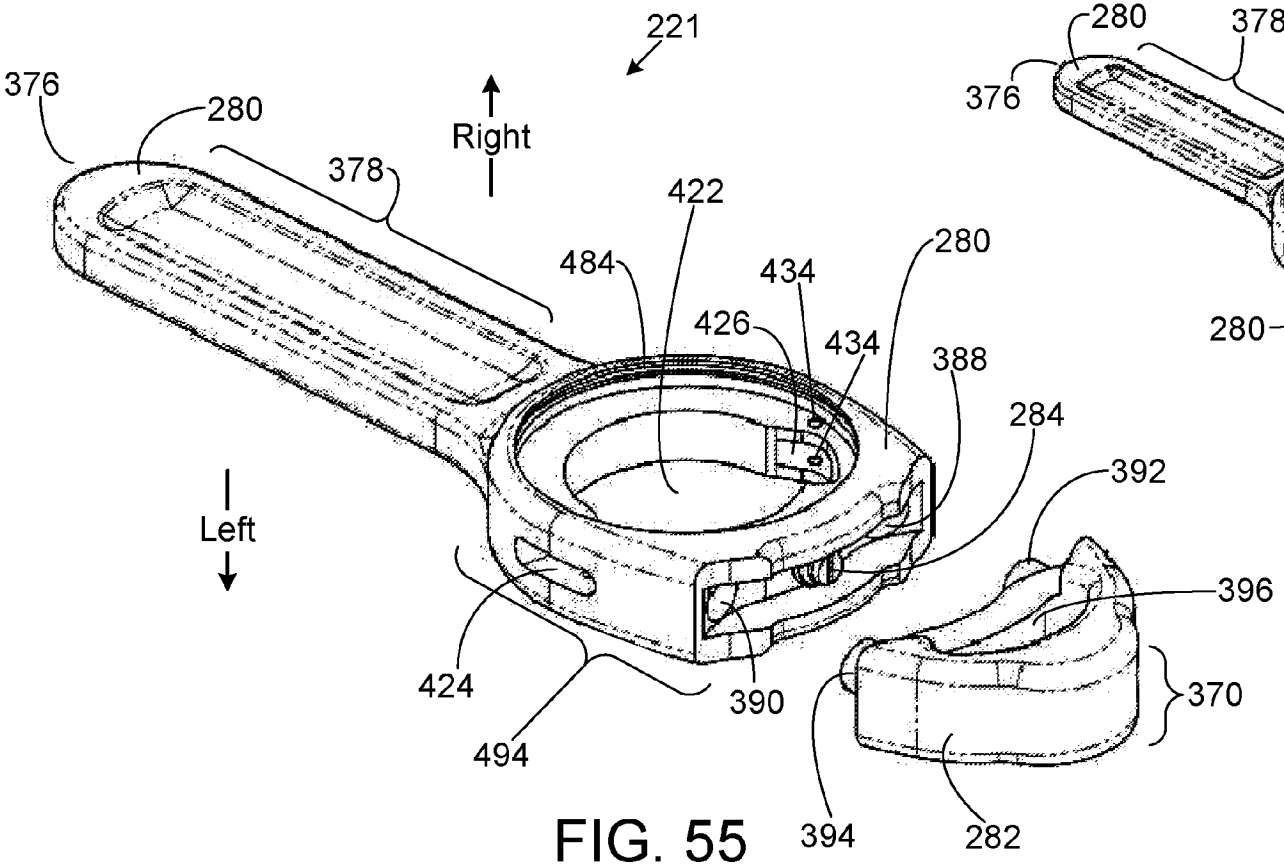
FIG. 55 is a diagram illustrating an enlarged partially-exploded perspective view, in simplified form, of the rocker arm of FIG. 54, where the string-contacting arm element is shown separated from the bottom of the arm substrate, thus exposing the screw-head end of the externally-threaded ball-nose spring plunger which is rotatably and threadably attached to a threaded plunger-accepting aperture (not shown) on the bottom of the arm substrate.
Figure 57:
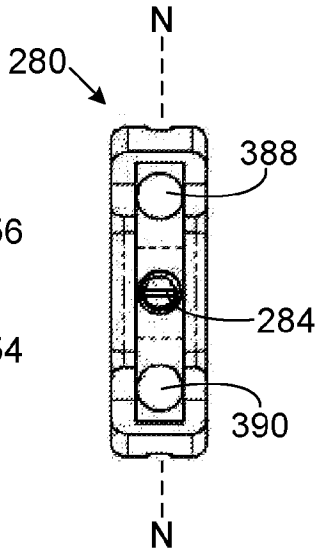
FIG. 57 is a diagram illustrating a plan view, in simplified form, of the arm substrate and the externally-threaded ball-nose spring plunger of FIG. 56 rotated left 90 degrees.
Figure 56:
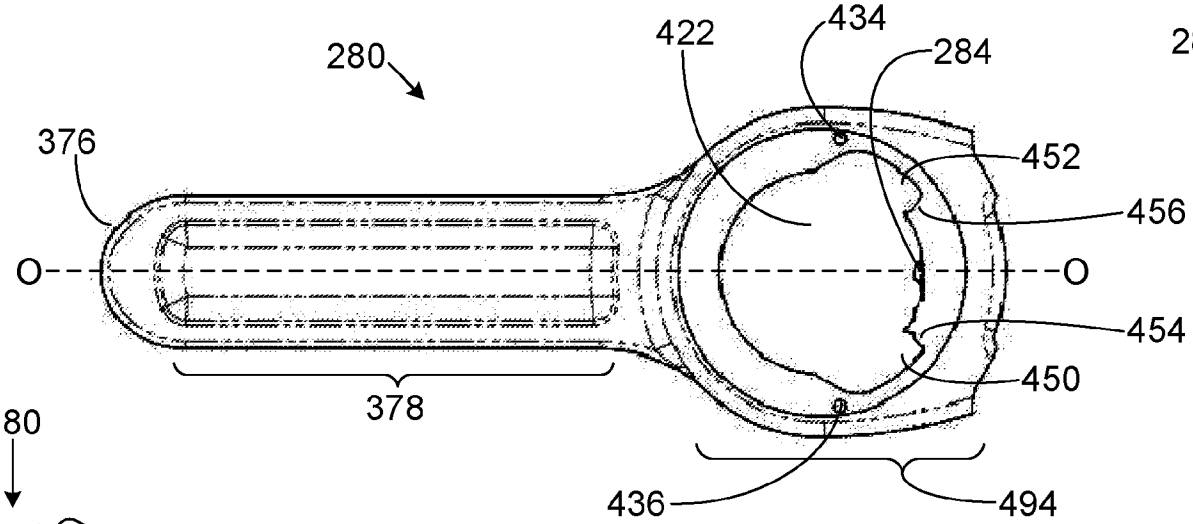
FIG. 56 is a diagram illustrating a plan view, in simplified form, of an exemplary embodiment of the arm substrate and the ball end of the externally-threaded ball-nose spring plunger of FIG. 55, where one end of this plunger is rotatably and threadably attached to the threaded plunger-accepting aperture (not shown) on the bottom of the arm substrate.
Figure 58:
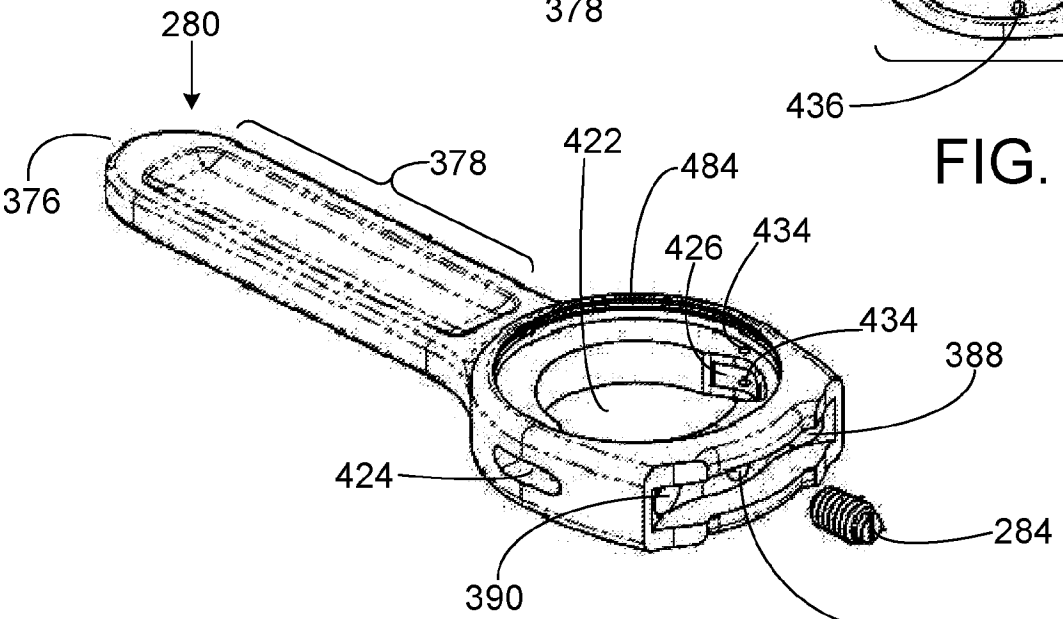
FIG. 58 is a diagram illustrating an exploded perspective view, in simplified form, of the arm substrate and the externally-threaded ball-nose spring plunger of FIG. 56.
Figure 60:
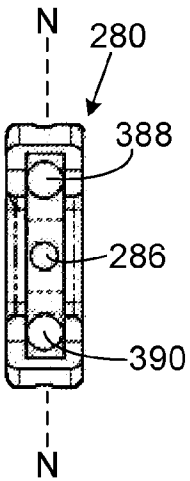
FIG. 60 is a diagram illustrating a plan view, in simplified form, of the arm substrate of FIG. 59 rotated left 90 degrees.
Figure 59:
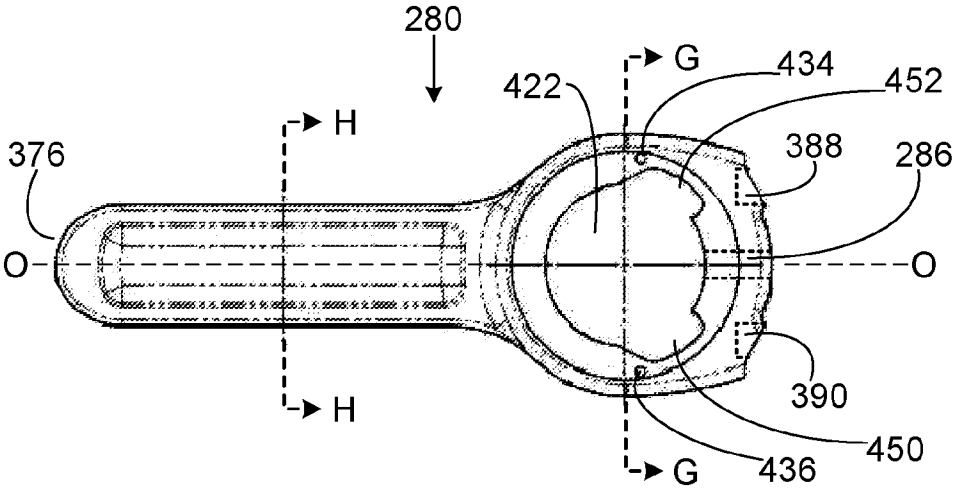
FIG. 59 is a diagram illustrating a partially-transparent plan view, in simplified form, of the arm substrate of FIG. 55.
Figure 61:
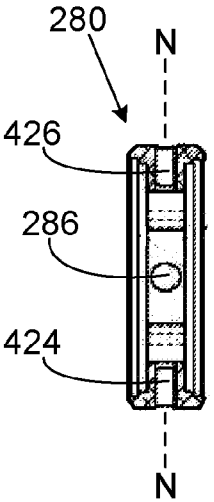
FIG. 61 is a diagram illustrating a partially-cross-sectional plan view, in simplified form, of the arm substrate taken along line G-G of FIG. 59.
Figure 62:
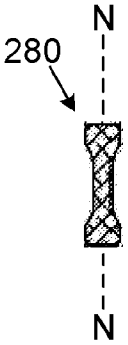
FIG. 62 is a diagram illustrating a cross-sectional view, in simplified form, of the arm substrate taken along line H-H of FIG. 59.

FIG. 54 illustrates a standalone perspective view, in simplified form, of an exemplary embodiment of the rocker arm 221 of FIG. 22, where this embodiment of the rocker arm includes an arm substrate 280 and a string-contacting arm element 282 that is securely disposed onto the bottom of the arm substrate. FIG. 55 illustrates an enlarged partially-exploded perspective view, in simplified form, of the rocker arm 221 of FIG. 54, where the string-contacting arm element 282 is shown separated from the bottom of the arm substrate 280, thus exposing the screw-head end of the externally-threaded ball-nose spring plunger 284 which is rotatably and threadably attached to a threaded plunger-accepting aperture (not shown) on the bottom of the arm substrate. FIG. 56 illustrates a plan view, in simplified form, of an exemplary embodiment of the arm substrate 280 and the ball end of the externally-threaded ball-nose spring plunger 284 of FIG. 55. FIG. 57 illustrates a plan view, in simplified form, of the arm substrate 280 and the externally-threaded ball-nose spring plunger 284 of FIG. 56 rotated left 90 degrees. FIG. 58 illustrates an exploded perspective view, in simplified form, of the arm substrate 280 and the externally-threaded ball-nose spring plunger 284 of FIG. 56. FIG. 59 illustrates a partially-transparent plan view, in simplified form, of the arm substrate 280 of FIG. 55. FIG. 60 illustrates a plan view, in simplified form, of the arm substrate 280 of FIG. 59 rotated left 90 degrees. FIG. 61 illustrates a partially-cross-sectional plan view, in simplified form, of the arm substrate 280 taken along line G-G of FIG. 59. FIG. 62 illustrates a cross-sectional view, in simplified form, of the arm substrate 280 taken along line H-H of FIG. 59.

Figure 65:
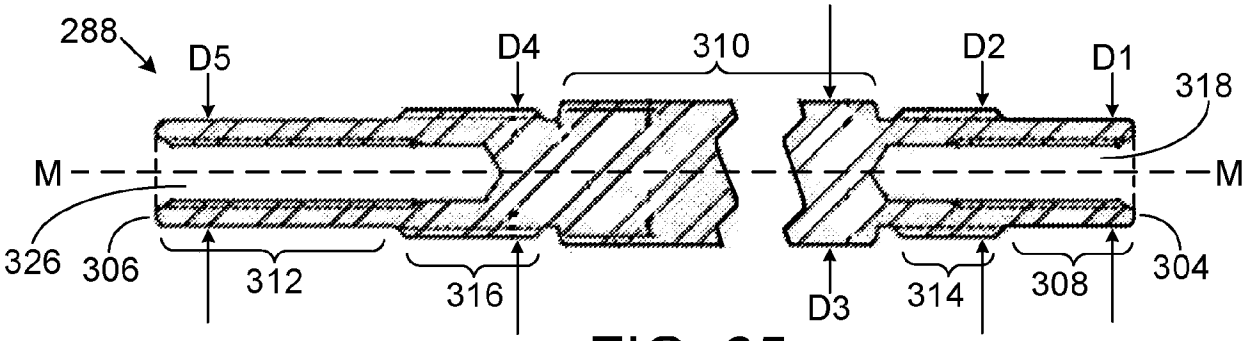
FIG. 65 is a diagram illustrating a cross-sectional view, in simplified form, of the shaft taken along line J-J of FIG. 64.
Figure 64:
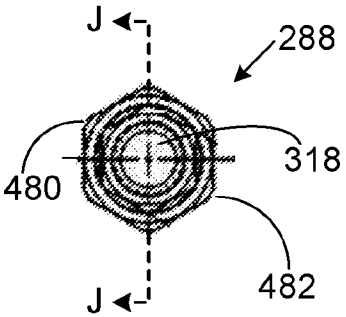
FIG. 64 is a diagram illustrating a plan view, in simplified form, of the left end of the shaft of FIG. 63.
Figure 63:
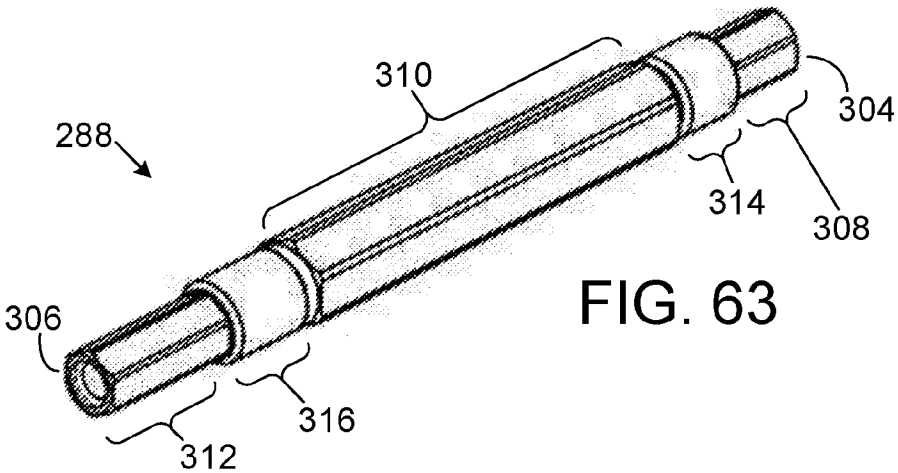
FIG. 63 is a diagram illustrating a standalone perspective view, in simplified form, of an exemplary embodiment of a shaft of the clamp of FIG. 2.

FIG. 63 illustrates a standalone perspective view, in simplified form, of an exemplary embodiment of the shaft 288 of the clamp of FIG. 5 rotated right 180 degrees. FIG. 64 illustrates a plan view, in simplified form, of the left end of the shaft 288 of FIG. 63. FIG. 65 illustrates a cross-sectional view, in simplified form, of the shaft 288 taken along line J-J of FIG. 64.

Figure 68:
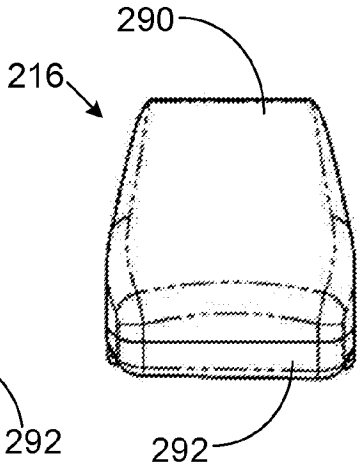
FIG. 68 is a diagram illustrating a plan view, in simplified form, of the right jaw of FIG. 66 rotated left 90 degrees.
Figure 66:
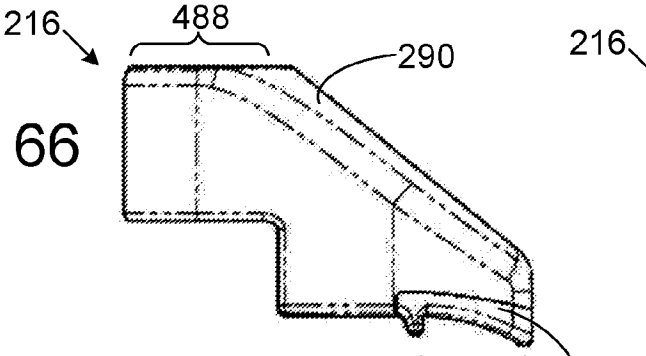
FIG. 66 is a diagram illustrating a standalone plan view, in simplified form, of an exemplary embodiment of a right jaw of the clamp of FIG. 2, where this embodiment of the right jaw includes a right jaw substrate and a right neck-contacting element that is securely disposed onto the left side of a lower portion of the right jaw substrate.
Figure 67:
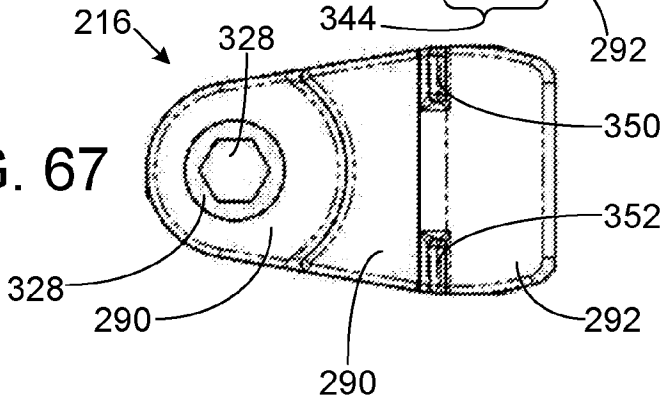
FIG. 67 is a diagram illustrating a plan view, in simplified form, of the bottom of the right jaw of FIG. 66.
Figure 69:
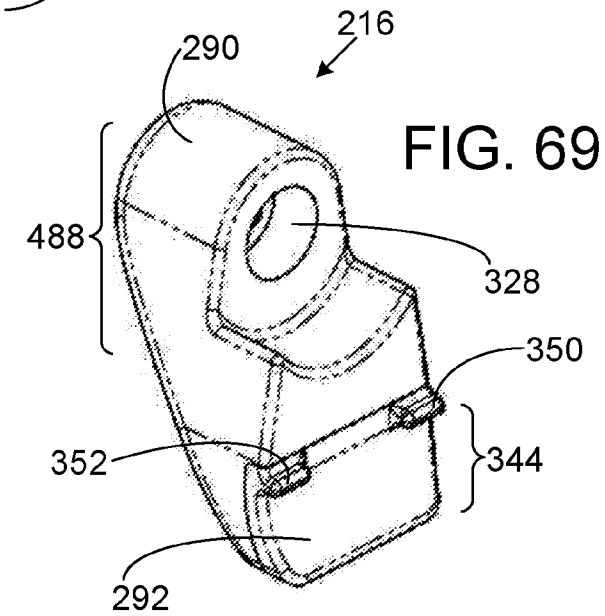
FIG. 69 is a diagram illustrating a perspective view, in simplified form, of the right jaw of FIG. 66.
Figure 70:
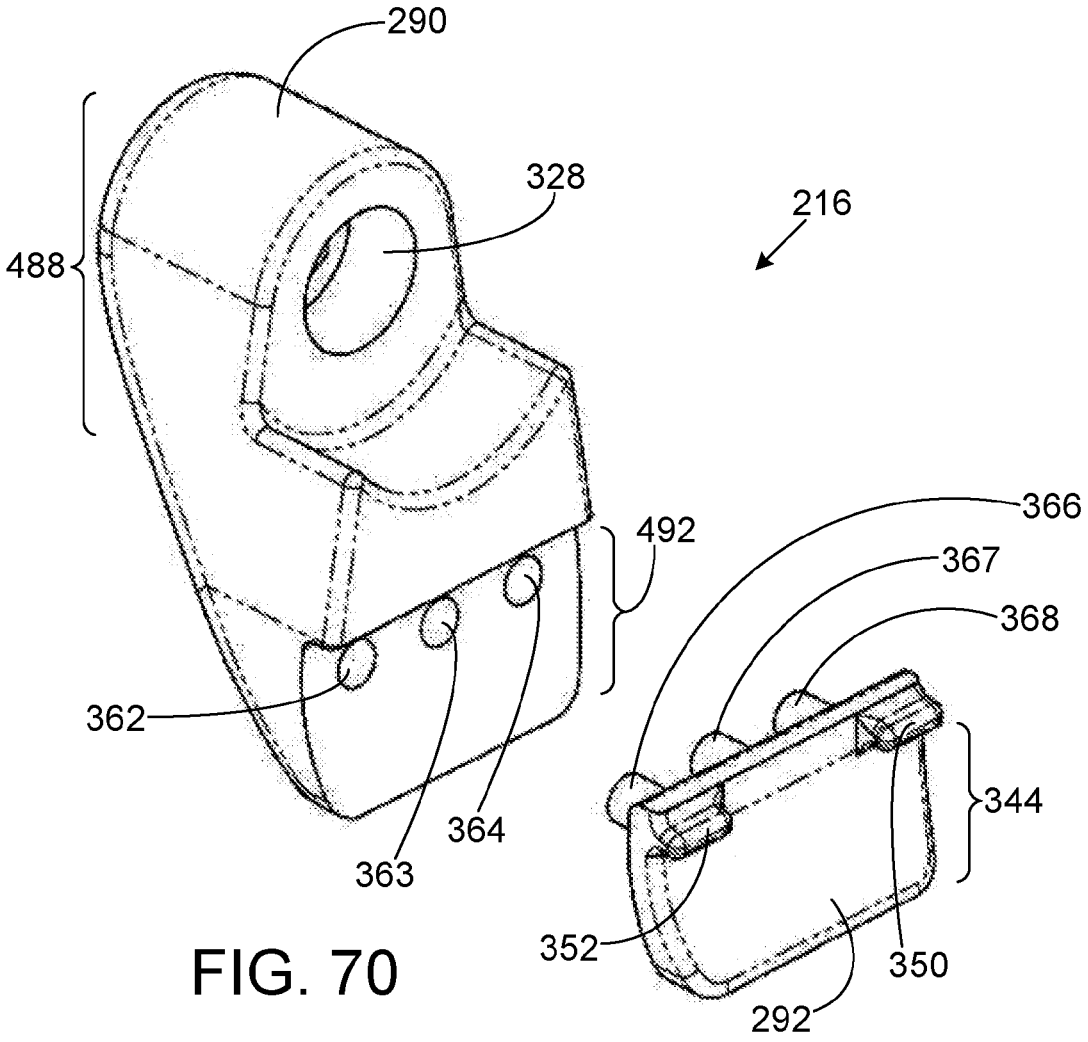
FIG. 70 is a diagram illustrating an enlarged exploded perspective view, in simplified form, of the right jaw of FIG. 69, where the right neck-contacting element is shown separated from the right jaw substrate.
Figure 73:
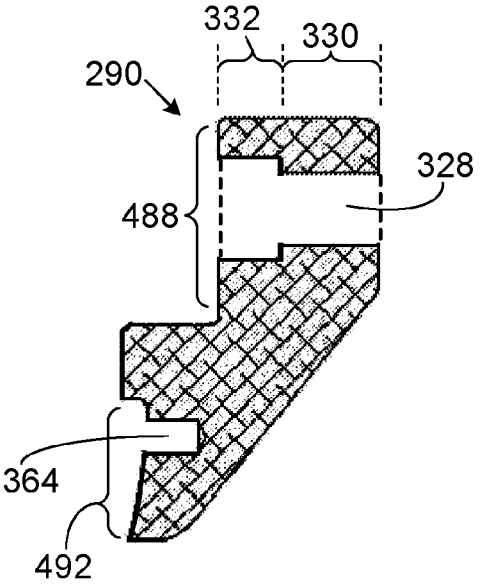
FIG. 73 is a diagram illustrating a cross-sectional view, in simplified form, of the right jaw substrate taken along line K-K of FIG. 72.
Figure 72:
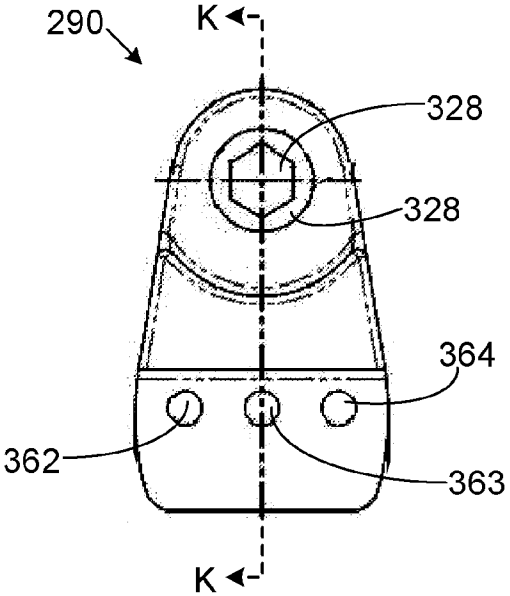
FIG. 72 is a diagram illustrating a plan view, in simplified form, of the right jaw substrate of FIG. 71 rotated left 90 degrees.
Figure 71:
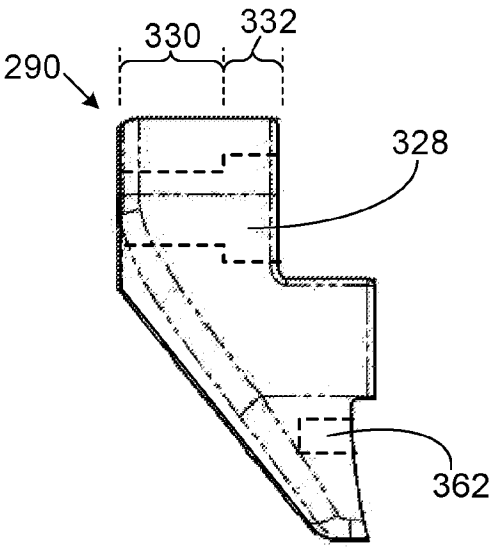
FIG. 71 is a diagram illustrating a standalone partially-transparent plan view, in simplified form, of the right jaw substrate of FIG. 66.

FIG. 66 illustrates a standalone plan view, in simplified form, of an exemplary embodiment of the right jaw 216 of the clamp of FIG. 2, where this embodiment of the right jaw includes a right jaw substrate 290 and a right neck-contacting element 292 that is securely disposed onto a left side of a lower portion of the right jaw substrate. FIG. 67 illustrates a plan view, in simplified form, of the bottom of the right jaw 216 of FIG. 66. FIG. 68 illustrates a plan view, in simplified form, of the right jaw 216 of FIG. 66 rotated left 90 degrees. FIG. 69 illustrates a perspective view, in simplified form, of the right jaw 216 of FIG. 66. FIG. 70 illustrates an enlarged exploded perspective view, in simplified form, of the right jaw 216 of FIG. 69, where the right neck-contacting element 292 is shown separated from the right jaw substrate 290. FIG. 71 illustrates a standalone partially-transparent plan view, in simplified form, of the right jaw substrate 290 of FIG. 66. FIG. 72 illustrates a plan view, in simplified form, of the right jaw substrate 290 of FIG. 71 rotated left 90 degrees. FIG. 73 illustrates a cross-sectional view, in simplified form, of the right jaw substrate 290 taken along line K-K of FIG. 72.

Figure 76:
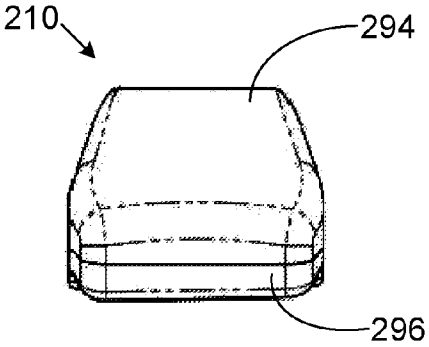
FIG. 76 is a diagram illustrating a plan view, in simplified form, of the left jaw of FIG. 74 rotated left 90 degrees.
Figure 77:
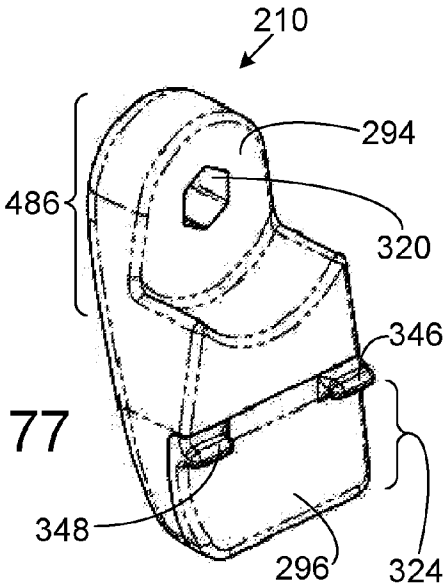
FIG. 77 is a diagram illustrating a perspective view, in simplified form, of the left jaw of FIG. 74.
Figure 74:
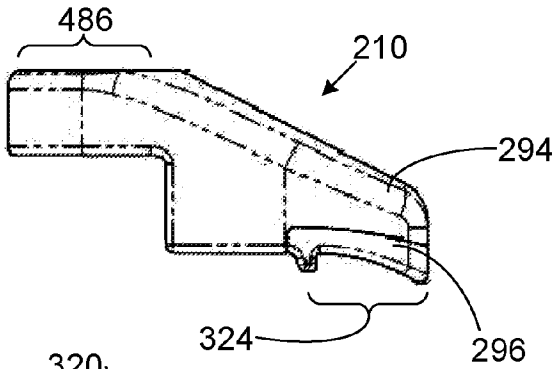
FIG. 74 is a diagram illustrating a standalone plan view, in simplified form, of an exemplary embodiment of a left jaw of the clamp of FIG. 2, where this embodiment of the left jaw includes a left jaw substrate and a left neck-contacting element that is securely disposed onto the right side of a lower portion of the left jaw substrate.
Figure 75:
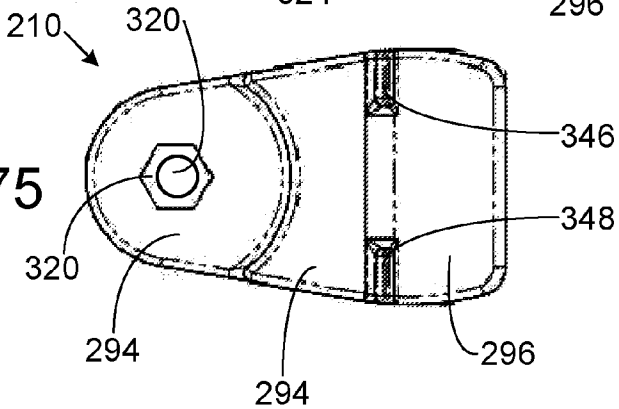
FIG. 75 is a diagram illustrating a plan view, in simplified form, of the bottom of the left jaw of FIG. 74.
Figure 78:
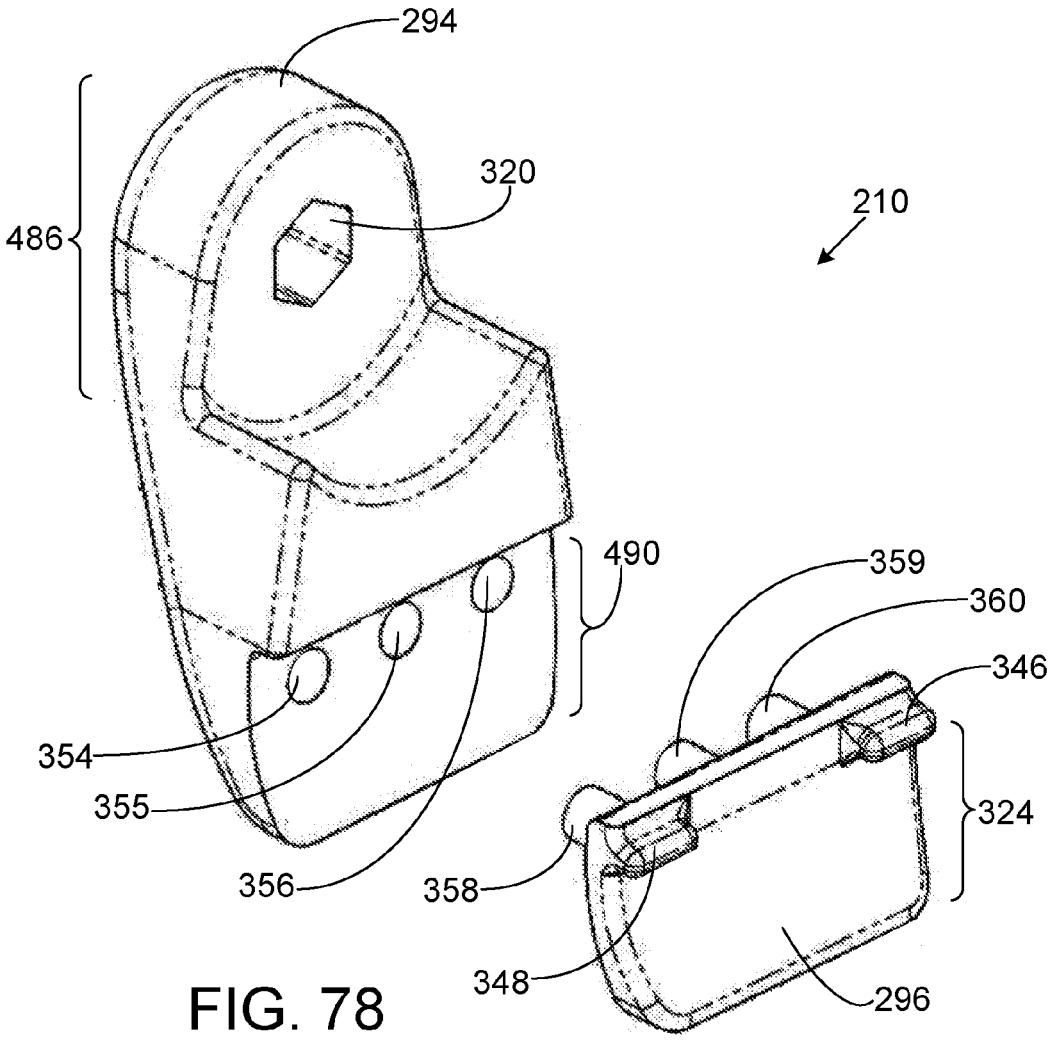
FIG. 78 is a diagram illustrating an enlarged exploded perspective view, in simplified form, of the left jaw of FIG. 77, where the left neck-contacting element is shown separated from the left jaw substrate.
Figure 81:
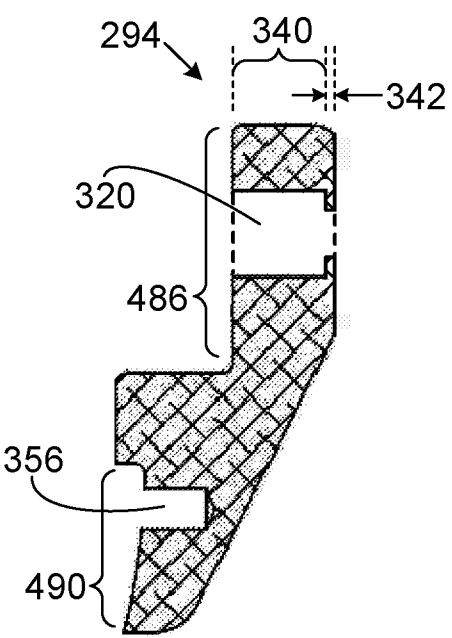
FIG. 81 is a diagram illustrating a cross-sectional view, in simplified form, of the left jaw substrate taken along line L-L of FIG. 80.
Figure 80:
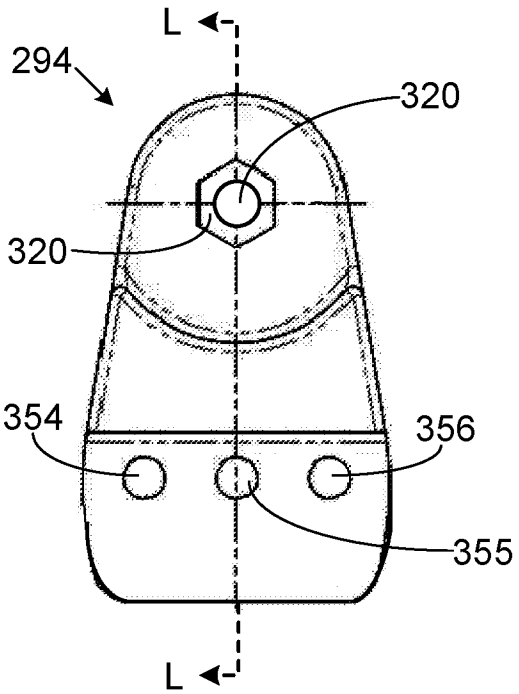
FIG. 80 is a diagram illustrating a plan view, in simplified form, of the left jaw substrate of FIG. 79 rotated left 90 degrees.
Figure 79:
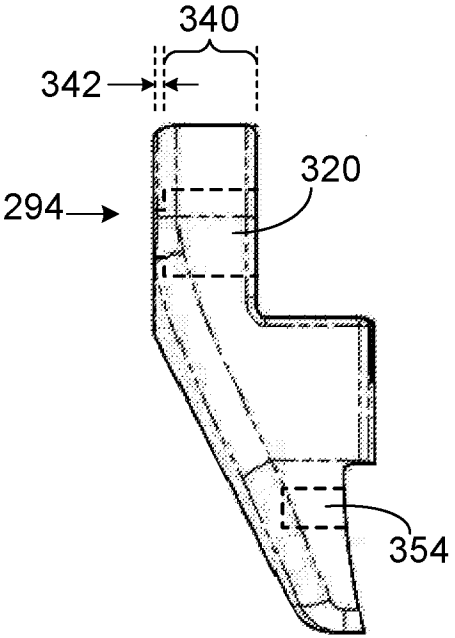
FIG. 79 is a diagram illustrating a standalone partially-transparent plan view, in simplified form, of the left jaw substrate of FIG. 74.

FIG. 74 illustrates a standalone plan view, in simplified form, of an exemplary embodiment of the left jaw 210 of the clamp of FIG. 2, where this embodiment of the left jaw includes a left jaw substrate 294 and a left neck-contacting element 296 that is securely disposed onto the right side of a lower portion of the left jaw substrate. FIG. 75 illustrates a plan view, in simplified form, of the bottom of the left jaw 210 of FIG. 74. FIG. 76 illustrates a plan view, in simplified form, of the left jaw 210 of FIG. 74 rotated left 90 degrees. FIG. 77 illustrates a perspective view, in simplified form, of the left jaw 210 of FIG. 74. FIG. 78 illustrates an enlarged exploded perspective view, in simplified form, of the left jaw 210 of FIG. 77, where the left neck-contacting element 296 is shown separated from the left jaw substrate 294. FIG. 79 illustrates a standalone partially-transparent plan view, in simplified form, of the left jaw substrate 294 of FIG. 74. FIG. 80 illustrates a plan view, in simplified form, of the left jaw substrate 294 of FIG. 79 rotated left 90 degrees. FIG. 81 illustrates a cross-sectional view, in simplified form, of the left jaw substrate 294 taken along line L-L of FIG. 80.

Referring again to FIGS. 1 and 2, the clamp of the tuning apparatus 200 is adapted to removably attach to a desired longitudinal position on the elongated neck 114 of the instrument. In other words, the neck-gripping means serves to removably attach the fully-adjustable capo to the neck 114. One possible example, among many others, of such a desired longitudinal position is indicated by line A-A in FIG. 1. Each of the string-contacting members 202-207 is rotatably supported by the clamp and is adapted to rotate thereon independently of the other string-contacting members. In other words, each of the string-depressing means rotates on the neck-gripping means independently of the other string-depressing means. This rotation occurs along a plane that is substantially parallel to the longitudinal axis of the neck 114, and hence is substantially parallel to either a given string (e.g., string 131) or a course of strings (not shown).

Referring again to FIGS. 1 and 2, each of the string-contacting members 202-207 is further adapted to adjustably impinge upon and urge the given string (e.g., string 131) or course of strings toward a user-selectable one of three-different longitudinal positions on the front surface 122 of the elongated neck 114. In other words, each of the string-depressing means generally serves to adjustably impinge upon and urge either a given string or a course of strings of the instrument toward a user-selectable one of three different longitudinal positions on the front surface 122 of the neck 114. As will now be described in more detail, the first of these positions is a home position. The second of these positions is a home−1 position that is closer to the headstock 116 end of the neck 114 than the home position. The third of these positions is a home+1 position that is farther from the headstock 116 end of the neck 114 than the home position. In an exemplary embodiment of the tuning apparatus 200 described herein, in the aforementioned case where the tuning apparatus is removably attached to the longitudinal position on the neck 114 indicated by line A-A, the home position for each of the string-contacting members 202-207 can generally also be indicated by line A-A. An exemplary home−1 position for each of the string-contacting members 202-207 can be indicated by line D-D. An exemplary home+1 position for each of the string-contacting members 202-207 can be indicated by line E-E.

Referring again to FIG. 2 and as exemplified in FIGS. 5 and 63-65, the shaft 288 of the clamp includes a left end 304, a right end 306, a leftmost longitudinal section 308 one end of which forms the left end 304, a center longitudinal section 310, a rightmost longitudinal section 312 one end of which forms the right end 306, a left-center longitudinal section 314 that is disposed between the right end of the leftmost longitudinal section 308 and the left end of the center longitudinal section 310, and a right-center longitudinal section 316 that is disposed between the left end of the rightmost longitudinal section 312 and the right end of the center longitudinal section 310. The leftmost longitudinal section 308 has a prescribed diameter D1 and a prescribed leftmost regular convex polygonal cross-sectional shape. The left-center longitudinal section 314 has a prescribed diameter D2 that is slightly larger than D1, a circular cross-sectional shape, and is threaded (threads not shown). The center longitudinal section 310 has a prescribed diameter D3 that is slightly larger than D2, and a prescribed center regular convex polygonal cross-sectional shape. The right-center longitudinal section 316 has a prescribed diameter D4 that is slightly smaller than D3, a circular cross-sectional shape, and is threaded (threads not shown). The rightmost longitudinal section 312 has a prescribed diameter D5 that is slightly smaller than D4, and a prescribed rightmost regular convex polygonal cross-sectional shape. The shaft 288 also has a longitudinal axis M-M.

Referring again to FIGS. 5 and 63-65, in the exemplary embodiment of the shaft 288 that is illustrated in these FIGS. the leftmost regular convex polygonal cross-sectional shape of the leftmost longitudinal section 308, the center regular convex polygonal cross-sectional shape of the center longitudinal section 310, and the rightmost regular convex polygonal cross-sectional shape of the rightmost longitudinal section 312 are a hexagon and are radially substantially aligned with each other such that the corresponding edges of each of these longitudinal sections are substantially aligned along a common set of radial axes and the corresponding faces of each of these cross-sectional shapes are substantially parallel to each other. It is noted that alternate embodiments of the shaft (not shown) are also possible where other types of regular convex polygonal cross-sectional shapes (e.g., an octagon, among others) are employed for these longitudinal sections 308/310/312, and where different regular convex polygonal cross-sectional shapes are employed for two or more of these longitudinal sections. In the exemplary embodiment of the shaft 288 that is illustrated in FIGS. 5 and 63-65 the diameter D2 of the left-center longitudinal section 314 and the diameter D4 of the right-center longitudinal section 316 are the same, and the diameter D1 of the leftmost longitudinal section 308 and the diameter D5 of the rightmost longitudinal section 312 are the same. It is noted that alternate embodiments of the shaft (not shown) are also possible where diameters D2 and D4 are different, and/or diameters D1 and D5 are different.

Referring again to FIGS. 2, 5 and 63-65, and as exemplified in FIGS. 3 and 74-81, the left end 304 of the shaft 288 is rigidly disposed onto an upper portion 486 of the left jaw substrate 294 of the left jaw 210. It will be appreciated that this rigid disposal can be implemented in various ways. For example, in the exemplary embodiment of the shaft 288 illustrated in FIGS. 5 and 63-65, and the exemplary embodiment of the left jaw 210 illustrated in FIGS. 3, 5 and 74-81, this rigid disposal is implemented as follows. The left end 304 of the shaft 288 includes a first threaded aperture 318 having a longitudinal axis that is substantially aligned with the longitudinal axis M-M of the shaft 288. The upper portion 486 of the left jaw substrate 294 includes a first shaft-accepting aperture 320 that horizontally passes completely through the upper portion 486 of the left jaw substrate from the left side to the right side thereof and is tiered as follows. As exemplified in FIGS. 75 and 77-81, the right side 340 of the first shaft-accepting aperture 320 has the leftmost regular convex polygonal cross-sectional shape and the left side 342 of the first shaft-accepting aperture has a circular cross-sectional shape, where the size and radial orientation of these shapes are adapted to allow the upper portion 486 of the left jaw substrate 294 to be slidably disposed onto the left end 304 of the shaft 288 such that the left jaw 210 maintains a prescribed radial alignment on the shaft, and a threaded shaft 322 of the aforementioned screw 208 is able to pass into the left side 342 of the first shaft-accepting aperture (e.g., the right side 340 of the first shaft-accepting aperture 320 has a diameter that is slightly larger than D1). It is noted that one end of threaded shaft 322 is adapted to be rotatably and threadably attached to the first threaded aperture 318. It is also noted that as the upper portion 486 of the left jaw substrate 294 is being slidably disposed onto the left end 304 of the shaft 288 the left wave spring 212 may be adjustably compressed against the left side of the left knob 252 as exemplified in FIG. 2. After the upper portion 486 of the left jaw substrate 294 has been slidably disposed onto the left end 304 of the shaft 288, the left jaw 210 is rigidly and removably secured to the left end of the shaft 288 using the screw 208. It is also noted that alternate embodiments of the tuning apparatus described herein (not shown) are also possible where, rather than using the screw, the left jaw can be rigidly secured to the left end of the shaft using various other methods such as a conventional epoxy or glue, among other possible methods.

Referring again to FIGS. 2, 5 and 63-65, and as exemplified in FIGS. 66-73, an upper portion 488 of the right jaw substrate 290 of the right jaw 216 is adapted to allow it to be slidably and removably disposed onto the right end 306 of the shaft 288 such that the right jaw is substantially aligned with the left jaw 210, and a pair of diametrically opposed edges on the center longitudinal section 310 of the shaft 288 (e.g., edges 480 and 482) are oriented on a plane that is substantially perpendicular to the front surface 122 of the elongated neck 114 of the instrument whenever the clamp of the tuning apparatus 200 described herein is removably attached to the neck. It will be appreciated that this slidable and removable disposal can be implemented in various ways. For example, in the exemplary embodiment of the shaft 288 illustrated in FIGS. 5 and 63-65, and the exemplary embodiment of the right jaw 216 illustrated in FIGS. 5 and 66-73, this slidable and removable disposal is implemented as follows. The upper portion 488 of the right jaw substrate 290 includes a second shaft-accepting aperture 328 that horizontally passes completely through the upper portion 488 of the right jaw substrate from the left side to the right side thereof and is tiered as follows. As exemplified in FIGS. 67 and 69-73, the right side 330 of the second shaft-accepting aperture 328 has the rightmost regular convex polygonal cross-sectional shape and the left side 332 of the second shaft-accepting aperture has a circular cross-sectional shape, where the size and radial orientation of these shapes are adapted to allow the upper portion 488 of the right jaw substrate 290 to be slidably and removably disposed onto the right end 306 of the shaft 288 such that the right jaw 216 is substantially aligned with the left jaw 210, and a portion of the right side of the right-center longitudinal section 316 is able to pass into the left side 332 of the second shaft-accepting aperture (e.g., the right side 330 of the second shaft-accepting aperture 328 has a diameter that is slightly larger than D5, and the left side 332 of the second shaft-accepting aperture has a diameter that is slightly larger than D4). It is noted that as the upper portion 488 of the right jaw substrate 290 is being slidably and removably disposed onto the right end 306 of the shaft 288 the right wave spring 214 may be adjustably compressed against the right side of the right knob 240 as exemplified in FIG. 2.

As illustrated in FIGS. 5, 67, 72, 75, 77 and 78, and referring again to FIGS. 2, 64, 73 and 81, the radial orientation of the leftmost regular convex polygonal cross-sectional shape of the right side 340 of the first shaft-accepting aperture 320, and the radial orientation of the rightmost regular convex polygonal cross-sectional shape of the right side 330 of the second shaft-accepting aperture 328, are adapted to ensure that a pair of diametrically opposed edges on the center longitudinal section 310 of the shaft 288 (e.g., edges 480 and 482) are oriented on a plane that is substantially perpendicular to the front surface 122 of the elongated neck 114 of the instrument whenever the clamp of the tuning apparatus 200 described herein is removably attached to the neck.

Generally speaking and referring again to FIGS. 2, 5, and 63-73, and as exemplified in FIGS. 12-19, the jaw-tightening member 218 is rotatably and threadably attached to the right end 306 of the shaft 288, where the jaw-tightening member is adapted to user-adjustably push the right jaw 216 toward both the right knob 240 and the left jaw 210 so as to securely grip the elongated neck 114 of the instrument when it is disposed between the left and right jaws. As will be appreciated from the more detailed description that follows, this gripping of the neck 114 by the left and right jaws 210 and 216 is controlled independently of the location of the string-contacting members 202-207 on the shaft 288 and the spacing between the string-contacting members. It will be appreciated that this rotatable and threadable attachment can be implemented in various ways. For example, in the exemplary embodiment of the jaw-tightening member 218 illustrated in FIGS. 5 and 12-19, the exemplary embodiment of the right jaw 216 illustrated in FIGS. 5 and 66-73, and the exemplary embodiment of the shaft 288 illustrated in FIGS. 5 and 63-65, this rotatable and threadable attachment is implemented as follows. The right end 306 of the shaft 288 includes a second threaded aperture 326 having a longitudinal axis that is substantially aligned with the longitudinal axis M-M of the shaft 288. The jaw-tightening member 218 includes the aforementioned knob 248 and threaded shaft 250 which is adapted to be rotatably and threadably attached to the second threaded aperture 326. One end of the threaded shaft 250 is rigidly disposed onto the knob 248. The other end 334 of the threaded shaft 250 is rotatably and threadably attached to the second threaded aperture 326 after the right jaw 216 has been slidably and removably disposed onto the right end 306 of the shaft 288. In the exemplary embodiment of the jaw-tightening member 218 illustrated in FIGS. 5 and 12-19 the knob 248 has a circular shape and a radially outer surface that includes a plurality of radially-spaced depressions (e.g., depression 336), and the one end of the threaded shaft 250 is rigidly disposed into a knob aperture 338 on the knob. These radially-spaced depressions 336 are advantageous in that they enhance the user's ability to grasp and rotate the jaw-tightening member 218. It will be appreciated that alternate embodiments of the jaw-tightening member (not shown) are also possible in which other shapes and styles can be employed for the knob, other types of features can be employed on the radially outer surface of the knob (e.g., this surface can be knurled), and other methods can be used to rigidly dispose the one end of the threaded shaft onto the knob.

Referring again to FIGS. 2, 5 and 66-81, the left neck-contacting element 296 that is securely disposed onto the right side of the lower portion of the left jaw substrate 294 is durable and resiliently flexible, and includes a left neck-contacting surface 324 which is adapted to conform to the shape of and snugly grip a left edge of the elongated neck 114 as exemplified in FIG. 2. Correspondingly, the right neck-contacting element 292 that is securely disposed onto the left side of the lower portion of the right jaw substrate 290 is durable and resiliently flexible, and includes a right neck-contacting surface 344 which is adapted to conform to the shape of and snugly grip a right edge of the neck 114 as also exemplified in FIG. 2. These left and right neck-contacting surfaces 324 and 344 operate cooperatively to maintain the shaft 288 in substantially parallel spaced relation to the front surface 122 of the neck 114, and maintain the shaft 288 in substantially perpendicular spaced relation to the plurality of strings 130-135, thus maintaining the plane of rotation of each of the string-contacting members 202-207 in substantially perpendicular relation to the front surface of the neck. The left neck-contacting surface 324 includes one or more right-facing tabs that project toward the right jaw 216 (two in the illustrated embodiment, namely a first right-facing tab 346 and a second right-facing tab 348). Correspondingly, the right neck-contacting surface 344 includes one or more left-facing tabs that project toward the left jaw 210 (two in the illustrated embodiment, namely a first left-facing tab 350 and a second left-facing tab 352).

In the exemplary embodiment of the left jaw substrate 294 that is illustrated in FIGS. 78-81 the right side of the lower portion 490 of the left jaw substrate includes one or more post-accepting apertures (three in the illustrated embodiment, namely post-accepting apertures 354-356). Correspondingly, in the exemplary embodiment of the left neck-contacting element 296 that is illustrated in FIG. 78 the left side of the left neck-contacting element includes a number of posts (three in the illustrated embodiment, namely posts 358-360), where this number equals the total number of post-accepting apertures 354-356, and the size, shape, location and longitudinal orientation of these posts 358-360 is adapted to allow them to mate with the post-accepting apertures 354-356. It is noted that the existence of these apertures 354-356 and their corresponding posts 358-360 is advantageous since they enhance the strength of the attachment between the left jaw substrate 294 and the left neck-contacting element 296. However, an alternate embodiment (not shown) of the left jaw substrate and the left neck-contacting element is also possible where the left jaw substrate does not include any post-accepting apertures and correspondingly, the left neck-contacting element does not include any posts. In an exemplary embodiment of the tuning apparatus described herein the left neck-contacting element 296 is implemented as a conventional overmold that is securely disposed onto the left jaw substrate 294 using a conventional overmolding process.

In the exemplary embodiment of the right jaw substrate 290 that is illustrated in FIGS. 70-73 the left side of the lower portion 492 of the right jaw substrate includes one or more post-accepting apertures (three in the illustrated embodiment, namely post-accepting apertures 362-364). Correspondingly, in the exemplary embodiment of the right neck-contacting element 292 that is illustrated in FIG. 70 the right side of the right neck-contacting element includes a number of posts (three in the illustrated embodiment, namely posts 366-368), where this number equals the total number of post-accepting apertures 362-364, and the size, shape, location and longitudinal orientation of these posts 366-368 is adapted to allow them to mate with the post-accepting apertures 362-364. It is noted that the existence of these apertures 362-364 and their corresponding posts 366-368 is advantageous since they enhance the strength of the attachment between the right jaw substrate 290 and the right neck-contacting element 292. However, an alternate embodiment (not shown) of the right jaw substrate and the right neck-contacting element is also possible where the right jaw substrate does not include any post-accepting apertures and correspondingly, the right neck-contacting element does not include any posts. In an exemplary embodiment of the tuning apparatus described herein the right neck-contacting element 292 is implemented as a conventional overmold that is securely disposed onto the right jaw substrate 290 using a conventional overmolding process.

Referring again to FIGS. 2 and 3, and as exemplified in FIGS. 21, 22, 34-43, 54 and 55 (among other FIGs. in the accompanying drawings), each of the string-contacting members 202-207 is implemented as a longitudinal cam. The arm substrate 280 of the rocker arm 221 of each of the string-contacting members (e.g., member 203) has a tip (e.g., tip 376) which is adapted to allow the user to use one or more fingers to change/adjust the rotational orientation of the string-contacting member at will. The arm substrate 280 also has an elongated upper portion 378 which is adapted to allow the rocker hammer 227 of the string-contacting member 203 to be slidably and removably disposed onto this upper portion 378, and also allow the user to change/adjust the longitudinal position of the rocker hammer on this upper portion 378 at will, as will be described in more detail hereafter. In the exemplary embodiment of the hammer substrate 276 of the rocker hammer 227 that is illustrated in the accompanying drawings, the hammer substrate includes an arm-accepting aperture 380 that vertically passes completely through the hammer substrate from the top to the bottom thereof. The hammer substrate 276 also includes a string-contacting aperture 382 that horizontally passes completely through the hammer substrate from the bridge side to the headstock side thereof. The string-contacting hammer element 278 of the rocker hammer 227 is durable and resiliently flexible, and is adapted to mate with these apertures 380 and 382 as follows. The string-contacting hammer element 278 passes through and out of the bridge side of the string-contacting aperture 382 in a manner that forms a home+1 string-contacting surface 372 whose function is described in more detail hereafter. The string-contacting hammer element 278 also passes through and out of the headstock side of the string-contacting aperture 382 in a manner that forms a home−1 string-contacting surface 374 whose function is also described in more detail hereafter. The string-contacting hammer element 278 also forms two pads that project into the arm-accepting aperture 380, namely a left-facing pad 384 and a right-facing pad 386, where size and shape of these pads 384 and 386 is adapted to allow them to mate with the right surface and left surface respectively of the elongated upper portion 378 of the arm substrate 280 when the rocker hammer 227 is slidably disposed onto this upper portion 378. In an exemplary embodiment of the tuning apparatus 200 described herein the string-contacting hammer element 278 is implemented as a conventional overmold that is securely disposed onto the hammer substrate 276 using a conventional overmolding process.

Referring again to FIGS. 1, 2, 21, 22 and 36, it will be appreciated that the durable and resiliently flexible nature of the string-contacting hammer element 278 results in the left-facing and right-facing pads 384 and 386 slidably gripping the right and left surfaces respectively of the elongated upper portion 378 of the arm substrate 280 in a manner that maintains the current longitudinal position of the rocker hammer 227 on this upper portion 378, and also allows the user to use one or more fingers to change/adjust the longitudinal position of the rocker hammer on this upper portion 378 at will. This ability of the user to alter the longitudinal position of the rocker hammer 227 on the upper portion 378 of the arm substrate 280 allows the user to individually adjust (e.g., fine-tune) the home−1 position for each of the string-contacting members 202-207 to be either closer to or farther away from the aforementioned home−fret 126, and similarly allows the user to individually adjust the home+1 position for each of the string-contacting members to be either closer to or farther away from the home fret. The user's ability to make such an adjustment on each of the string-contacting members 202-207 is advantageous for various reasons including the following. It allows the user to easily and quickly adapt the tuning apparatus 200 to accommodate instruments having a wide variety of actions and string gauges. It also allows the user to easily and quickly adapt the tuning apparatus 200 to accommodate variations in the spacing between adjacent frets, and variations in the dimensions of each of the frets, that can exist on a given instrument and between different instruments. It also allows the user to easily and quickly change the intonation of a given string or course of strings in both the home−1 and home+1 positions, regardless of where the tuning apparatus 200 is located on the elongated neck 114 of the instrument.

Referring again to FIGS. 2, 3, 21, 22, 54 and 55, and as exemplified in FIGS. 57, 58 and 60 (among other FIGs. in the accompanying drawings), in the exemplary embodiment of the arm substrate 280 that is illustrated in these FIGs. the bottom of the arm substrate includes one or more post-accepting apertures (two in the illustrated embodiment, namely post-accepting apertures 388 and 390) which are substantially centered along the plane of rotation N-N of the arm substrate 280 (which equates to the plane of rotation of each of the string-contacting members 202-207) and the longitudinal axis O-O thereof. Correspondingly, in the exemplary embodiment of the string-contacting arm element 282 that is illustrated in FIG. 55 the top of the string-contacting arm element includes a number of posts (two in the illustrated embodiment, namely posts 392 and 394), where this number equals the total number of post-accepting apertures 388 and 390, and the size, shape, location and longitudinal orientation of these posts 392 and 394 is adapted to allow them to mate with the post-accepting apertures 388 and 390. It is noted that the existence of these apertures 388 and 390 and their corresponding posts 392 and 394 is advantageous since they enhance the strength of the attachment between the arm substrate 280 and the string-contacting arm element 282. However, an alternate embodiment (not shown) of the arm substrate and the string-contacting arm element is also possible where the arm substrate does not include any post-accepting apertures and correspondingly, the string-contacting arm element does not include any posts. In an exemplary embodiment of the tuning apparatus 200 described herein the string-contacting arm element 282 is implemented as a conventional overmold that is securely disposed onto the arm substrate 280 using a conventional overmolding process. The string-contacting arm element 282 also includes an aperture 396 that passes completely through a middle portion of the string-contacting arm element from the left side to the right side thereof. As will be appreciated from the description of the string-contacting members 202-207 that is provided herein, the plane of rotation N-N of the arm substrate of each of the string-contacting members is also the plane of rotation of the string-contacting member itself.

As described heretofore and referring again to FIGS. 1 and 2, the front surface 122 of the elongated neck 114 can include a plurality of frets (e.g., frets 128, 126, 102 and 124) which are sequentially arranged on the front surface and are substantially perpendicular to the longitudinal axis of the neck. Generally speaking, in the fully-adjustable capo embodiments described herein one of the frets is considered to be a home fret. Another one of the frets is considered to be a home−1 fret, where the home−1 fret is adjacent to the home fret on the headstock 116 end of the neck 114. Yet another one of the frets is considered to be a home+1 fret, where the home+1 fret is adjacent to the home fret on a side thereof that is opposite the home−1 fret. More particularly, in the exemplary embodiment of the tuning apparatus 200 described herein where the tuning apparatus is removably attached to the longitudinal position on the neck indicated by line A-A, this position includes the shaft 288 of the clamp of the tuning apparatus being substantially parallel to and approximately midway between the home fret 126 and home−1 fret 128.

Referring again to FIGS. 1-3, 21, 22 and 55, the string-contacting arm element 282 that is securely disposed onto the bottom of the arm substrate 280 of the rocker arm 221 of each of the string-contacting members (e.g., member 203) is durable and resiliently flexible, and forms a home string-contacting surface (e.g., surface 370) which is pressure-sensitive and is adapted to impinge upon the aforementioned given string or course of strings and adjustably urge this string or course toward the home position on the front surface 122 of the elongated neck 114 (e.g., the position indicated by line A-A in FIG. 1) whenever the string-contacting member is in the home rotational orientation so as to depress the string or course onto the home fret (e.g., fret 126 in FIG. 1). By way of example but not limitation, in FIG. 3 string-contacting member 203 is illustrated to be in the home rotational orientation. By way of further example, in FIG. 2 all six of the string-contacting members 202-207 are illustrated to be in the home rotational orientation, where the home string-contacting surface of the string-contacting member of the rocker arm 220 of string-contacting member 202 is impinging upon string 130 and adjustably urging it toward the home position on the front surface of the neck 114, the home string-contacting surface of the string-contacting member of the rocker arm 221 of string-contacting member 203 is impinging upon string 131 and adjustably urging it toward this home position, the home string-contacting surface of the string-contacting member of the rocker arm 222 of string-contacting member 204 is impinging upon string 132 and adjustably urging it toward this home position, the home string-contacting surface of the string-contacting member of the rocker arm 223 of string-contacting member 205 is impinging upon string 133 and adjustably urging it toward this home position, the home string-contacting surface of the string-contacting member of the rocker arm 224 of string-contacting member 206 is impinging upon string 134 and adjustably urging it toward this home position, and the home string-contacting surface of the string-contacting member of the rocker arm 225 of string-contacting member 207 is impinging upon string 135 and adjustably urging it toward this home position. The existence of aperture 396 in the string-contacting arm element 282 is advantageous in that it enhances the pressure sensitivity of the home string-contacting surface 370 and the ability of this surface 370 to apply an appropriate amount of pressure to a given string or course of strings whenever a given string-contacting member is in the home rotational orientation.

Referring again to FIGS. 1-3, 21, 22, 34 and 36, and as described heretofore, the durable and resiliently flexible string-contacting hammer element 278 that is securely disposed onto the hammer substrate 276 of the rocker hammer 227 of each of the string-contacting members (e.g., member 203) includes both a home+1 string-contacting surface (e.g. surface 372) and a home−1 string-contacting surface (e.g., surface 374). The home−1 string-contacting surface is pressure-sensitive, and is adapted to impinge upon the given string or course of strings and user-adjustably urge this string or course toward the home−1 position on the front surface 122 of the elongated neck 114 (e.g., the position indicated by line D-D in FIG. 1) whenever the string-contacting member is retainably but releasably engaged into the home−1 rotational orientation so as to depress the string or course onto the home−1 fret (e.g., fret 128 in FIG. 1). By way of example but not limitation, in FIG. 3 string-contacting member 202 is illustrated to be in the home−1 rotational orientation. The home+1 string-contacting surface is also pressure-sensitive, and is adapted to impinge upon the given string or course of strings and user-adjustably urge this string or course toward the home+1 position on the front surface 122 of the neck 114 (e.g., the position indicated by line E-E in FIG. 1) whenever the string-contacting member is retainably but releasably engaged into the home+1 rotational orientation so as to depress the string or course onto the home+1 fret (e.g., fret 102 in FIG. 1). By way of example but not limitation, in FIG. 3 string-contacting member 204 is illustrated to be in the home+1 rotational orientation.

Referring again to FIGS. 1-3, 21, 22, 34, 36 and 55, the pressure-sensitive home string-contacting surface (e.g., surface 370) of each of the string-contacting members (e.g., member 203) will apply an appropriate amount of pressure to the given string or course of strings whenever the string-contacting member is in the home rotational orientation. The pressure-sensitive home+1 string-contacting surface (e.g. surface 372) of each of the string-contacting members will apply an appropriate amount of pressure to the given string or course of strings whenever the string-contacting member is in the home+1 rotational orientation, where this pressure can also be adjusted (e.g., fine-tuned) by the user as will be described in more detail hereafter. The pressure-sensitive home−1 string-contacting surface (e.g., surface 374) of each of the string-contacting members will apply an appropriate amount of pressure to the given string or course of strings whenever the string-contacting member is in the home−1 rotational orientation, where this pressure can also be adjusted (e.g., fine-tuned) by the user as will also be described in more detail hereafter. It will thus be appreciated that the tuning apparatus 200 ensures that the given string or course of strings remains securely "fretted" while the user is playing the instrument in any of a variety of playing styles (e.g., the given string/course will not "buzz"). It will also be appreciated that the pressure-sensitive nature of the home, home−1 and home+1 string-contacting surfaces results in the amount of pressure that is applied to the given string or course of strings being automatically adjusted so as to reliably depress the string/course onto a given fret without distorting the tuning of the string/course.

Referring again to FIGS. 2 and 5, and as will now be described in more detail, the string-contacting member spacing adjustment mechanism of the tuning apparatus 200 is adapted to allow the user to slidably adjust the location of the string-contacting members 202-207 as a group on the clamp of the tuning apparatus (more particularly, slidably adjust the location of the string-contacting members 202-207 as a group along the longitudinal axis M-M of the center longitudinal section 310 of the shaft 288 of the clamp) so as to substantially center the plane of rotation N-N of each of the string-contacting members (e.g., member 203) over a different string (e.g., string 131) or course of strings, and thus center the string-contacting member's pressure-sensitive home string-contacting surface (e.g., surface 370), home+1 string-contacting surface (e.g. surface 372), and home−1 string-contacting surface (e.g., surface 374) over the different string/course. The string-contacting member spacing adjustment mechanism is also adapted to automatically maintain substantially equal spacing between each different adjacent pair of string-contacting members 202-207. As described heretofore the string-contacting member spacing adjustment mechanism includes a left wave spring 212, a left knob 252, a right knob 240, a right wave spring 214, and a number of member-spacing wave springs (five in the illustrated embodiment, namely member-spacing wave springs 242-246), where this number is one less than the total number of string-contacting members 202-207. The aperture of the left wave spring 212 has a diameter that is larger than D1, thus allowing the left wave spring to be slidably and rotatably disposed onto the leftmost longitudinal section 308 of the shaft 288. The aperture of the right wave spring 214 has a diameter that is larger than D5, thus allowing the right wave spring to be slidably and rotatably disposed onto the rightmost longitudinal section 312 of the shaft 288. The aperture of each of the member-spacing wave springs 242-246 has a diameter that is larger than D3, thus allowing the member-spacing wave springs to be slidably and rotatably disposed onto the center longitudinal section 310 of the shaft 288. In an exemplary embodiment of the tuning apparatus 200 described herein, a conventional Lee Spring Company part number LW063060300S is used for the left and right wave springs 212 and 214, and a conventional Lee Spring Company part number LW063060180S is used for each of the member-spacing wave springs 242-246.

Referring again to FIGS. 2 and 5, and as exemplified in FIGS. 6-10, the left knob 252 includes a third shaft-accepting aperture 410 that horizontally passes completely through the left knob from the left side to the right side thereof and is tiered as follows. The left side 412 of the third shaft-accepting aperture 410 has a circular cross-sectional shape and is threaded (threads not shown), where the diameter of and threads on this left side 412 are adapted to allow it to be rotatably and threadably attached to the left-center longitudinal section 314 of the shaft 288. The right side 414 of the third shaft-accepting aperture 410 also has a circular cross-sectional shape, where the diameter of this right side 414 is larger than the diameter D3 of the center longitudinal section 310 of the shaft 288 so that the leftmost portion of this center longitudinal section 310 is able to slidably and rotatably pass into this right side 414 as the user tightens the left knob 252 onto the left-center longitudinal section 314 of the shaft 288. As described heretofore, the right knob 240 of the string-contacting member spacing adjustment mechanism is structurally the same as the left knob 252, where the diameter of and threads on the right side of the right knob's shaft accepting aperture are adapted to allow it to be rotatably and threadably attached to the right-center longitudinal section 316 of the shaft 288, and the diameter of the left side of the right knob's shaft accepting aperture is larger than the diameter D3 of the center longitudinal section 310 of the shaft 288 so that the rightmost portion of this center longitudinal section 310 is able to slidably and rotatably pass into this left side as the user tightens the right knob 240 onto the right-center longitudinal section 316 of the shaft 288. Given the foregoing, it will be appreciated that the user can adjust the location of the string-contacting members 202-207 as a group along the longitudinal axis M-M of the center longitudinal section 310 of the shaft 288 by selectively tightening or loosening the left knob 252 on the left-center longitudinal section 314 of the shaft 288, and/or selectively tightening or loosening the right knob 240 on the right-center longitudinal section 316 of the shaft 288.

In the exemplary embodiment of the left knob 252 illustrated in FIGS. 2, 5 and 6-10 the left knob (and thus the right knob 240) has a radially outer surface that includes a plurality of radially-spaced depressions (e.g., depression 416). These radially-spaced depressions are advantageous in that they enhance the user's ability to grasp and rotate (e.g., tighten or loosen) the left and right knobs. It will be appreciated that alternate embodiments of the left and right knobs (not shown) are also possible in which other types of features can be employed on the radially outer surface of these knobs (e.g., this surface can be knurled).

Referring again to FIGS. 2 and 3, the ratchet mechanism of each of the string-contacting members 202-207 is adapted to allow the user to retainably but releasably engage the string-contacting member into either the home−1 rotational orientation, the headstock-side open-string rotational orientation, the home rotational orientation, the bridge-side open-string rotational orientation, or the home+1 rotational orientation. Once a given string-contacting member (e.g., member 203) has been retainably but releasably engaged into either the home−1 or home+1 rotational orientations, the ratchet mechanism is also adapted to allow the user to adjust (e.g., either increase or decrease) the amount of pressure that the rocker hammer (e.g., 227) of the string-contacting member applies to the string (e.g., string 131) or course of strings over which the plane of rotation N-N of the string-contacting member is substantially centered.

Referring again to FIGS. 22, 55, 57, 58, 60 and 65, and as exemplified in FIGS. 56, 59 and 61, as described heretofore the ratchet mechanism includes a pair of spiral internal retaining rings 254 and 256, a pair of ratchet covers 258 and 260, a ratchet hub 262, a pair of lever dowel pins 264 and 266, a pair of ratchet pawls 268 and 270, a pair of compression springs 272 and 274, a pair of ratchet release levers 233 and 238, and an externally-threaded ball-nose spring plunger 284. As will be appreciated from the more detailed description that follows, the lower portion 494 of the arm substrate 280 of the rocker arm 221 of each of the string-contacting members generally includes a variety of apertures that are adapted to accept the installation of the ratchet mechanism. More particularly, the lower portion 494 of the arm substrate 280 includes a hub/pawl-accepting aperture 422 that passes completely through the lower portion of the arm substrate from the left side to the right side thereof, where the size and shape of this aperture 422 are adapted to accept the installation of the ratchet hub 262, the pair of ratchet pawls 268 and 270, and the pair of compression springs 272 and 274. The lower portion 494 of the arm substrate 280 also includes a pair of lever-accepting apertures, namely a bridge-side lever-accepting aperture 424 that passes from the bridge-side surface of the lower portion of the arm substrate into the hub/pawl-accepting aperture 422, and a headstock-side lever-accepting aperture 426 that passes from the headstock-side surface of the lower portion of the arm substrate into the hub/pawl-accepting aperture 422. These apertures 424 and 426 are described in more detail hereafter. The lower portion 494 of the arm substrate 280 also includes a pair of dowel-pin-accepting apertures, namely a bridge-side dowel-pin-accepting aperture 436 and a headstock-side dowel-pin-accepting aperture 434. The bridge-side dowel-pin-accepting aperture 436 is substantially parallel to the hub/pawl-accepting aperture 422, substantially orthogonal to the bridge-side lever-accepting aperture 424, passes completely through the lower portion 494 of the arm substrate 280 (and thus passes through the bridge-side lever-accepting aperture 424), and has a size and shape that are adapted to securely retain the lever dowel pin 266 after it is press-fit into the bridge-side dowel-pin-accepting aperture 436. Similarly, the headstock-side dowel-pin-accepting aperture 434 is substantially parallel to the hub/pawl-accepting aperture 422, substantially orthogonal to the headstock-side lever-accepting aperture 426, passes completely through the lower portion 494 of the arm substrate 280 (and thus passes through the headstock-side lever-accepting aperture 426), and has a size and shape that are adapted to securely retain the lever dowel pin 264 after it is press-fit into the headstock-side dowel-pin-accepting aperture 434. The bottom portion of the arm substrate 280 may include a threaded plunger-accepting aperture 286 (threads not shown) that passes from the bottom portion of the arm substrate into the hub/pawl-accepting aperture 422, and has a longitudinal axis that is substantially aligned with the longitudinal axis O-O of the arm substrate. The threaded plunger-accepting aperture 286 is adapted to be rotatably and threadably attached to the spring plunger 284, where the spring plunger is rotated within the threaded plunger-accepting aperture until the ball end of the spring plunger protrudes slightly into the hub/pawl-accepting aperture 422 as illustrated in FIG. 56. In an exemplary embodiment of the tuning apparatus described herein, a conventional McMaster-Carr Supply Company part number 3408A65 is used for the externally-threaded ball-nose spring plunger 284. The lever dowel pins 264 and 266 have a length which is adapted to make them substantially flush with the exterior surfaces of the dowel-pin-accepting apertures 434 and 436 after the just-described press-fitting. It is noted that in the various embodiments of the tuning apparatus described herein the longitudinal axis O-O of the arm substrate of each of the string-contacting members substantially intersects the longitudinal axis M-M of the shaft 288.

As illustrated in FIG. 22, the ratchet pawls 268 and 270 have the same size and structure, and the compression springs 272 and 274 also have the same size and structure. In an exemplary embodiment of the tuning apparatus described herein, a conventional Lee Spring Company part number C1008AB02M is used for the compression springs 272 and 274. As exemplified in FIGS. 27-29, each of the ratchet pawls (e.g., ratchet pawl 268) includes the aforementioned pawl member 418 and a pawl dowel pin 420. In an exemplary embodiment of the tuning apparatus 200 described herein, a conventional McMaster-Carr Supply Company part number 97395A351 is used for the pawl dowel pin 420. The pawl member 418 includes a pawl-dowel-pin-accepting aperture 442, a pawl-moving-member-accepting cavity 444, and a spring-engaging-member 446. The pawl member 418 also includes a hub-engaging section 460 that includes a prescribed number of pawl teeth (e.g., pawl tooth 448). The pawl-dowel-pin-accepting aperture 442 passes completely through the pawl member 418, and has a size and shape that are adapted to securely retain the pawl dowel pin 420 after it is press-fit into this aperture 442. The pawl dowel pin 420 has a length which is adapted to make the pin 420 substantially flush with the exterior surfaces of the pawl-dowel-pin-accepting aperture 442 after this press-fitting. The spring-engaging-member 446 is rigidly disposed onto one end of the pawl member 418, and has a size and shape that are adapted to retainably engage one end of one of the compression springs 272 and 274. The pawl-moving-member-accepting cavity 444 has a size and shape, and an orientation on the pawl member 418 that are adapted to slidably accept a pawl-moving member of one of the ratchet release levers 233 and 238.

As illustrated in FIG. 22, the ratchet release levers 233 and 238 have the same size and structure, and the lever dowel pins 264 and 266 also have the same size and structure. In an exemplary embodiment of the tuning apparatus described herein, a conventional McMaster-Carr Supply Company part number 97395A351 is used for the lever dowel pins 264 and 266. Referring again to FIGS. 55 and 56, and as exemplified in FIGS. 23-26, each of the ratchet release levers (e.g., release lever 238) includes a user-accessible portion 428 that is contoured to substantially match the shape of the bridge-side/headstock-side surface of the lower portion 494 of the arm substrate 280 surrounding the bridge-side and headstock-side lever-accepting apertures 424 and 426. The front of this user-accessible portion 428 (e.g., the user-accessible side of the ratchet release lever 238) includes a plurality of spaced longitudinal depressions (e.g., depression 430) that are substantially parallel to one another. These longitudinal depressions 430 are advantageous in that they enhance the user's ability to depress the ratchet release lever 238. Each of the ratchet release levers 238 also includes the aforementioned pawl-moving member 432 that is centrally and rigidly disposed onto the back of the user-accessible portion 428 of the release lever 238. The pawl-moving member 432 includes a lever aperture 438 that passes through the member 432 and has a diameter that is slightly larger than the diameter of lever dowel pins 264 and 266. The tip of the pawl-moving member 432 includes a cavity 440 having a size, shape and orientation that are adapted to rotatably engage with the pawl dowel pin 420 of one of the ratchet pawls 268 and 270 when this member 432 is slidably disposed into the cavity 440.

Referring again to FIGS. 22-26 and FIG. 56 (among other FIGs. in the accompanying drawings), the ratchet release levers 233 and 238 and lever dowel pins 264 and 266 are installed onto the lower portion 494 of the arm substrate 280 in the following manner. As illustrated in FIG. 22, the bridge-side lever-accepting aperture 424 on the lower portion 494 of the arm substrate 280 has a size, shape and orientation that are adapted to allow the pawl-moving member 432 of the ratchet release lever 233 to be slidably and rotatably installed within the bridge-side lever-accepting aperture 424 such that the lever aperture 438 on the pawl-moving member 432 is aligned with the bridge-side dowel-pin-accepting aperture 436. After this installation has been completed, the lever dowel pin 266 is press-fit into the bridge-side dowel-pin-accepting aperture 436 and accordingly through the lever aperture 438. Similarly, the headstock-side lever-accepting aperture 426 on the lower portion 494 of the arm substrate 280 has a size, shape and orientation that are adapted to allow the pawl-moving member 432 of the ratchet release lever 238 to be slidably and rotatably installed within the headstock-side lever-accepting aperture 426 such that the lever aperture 438 on the pawl-moving member 432 is aligned with the headstock-side dowel-pin-accepting aperture 434. After this installation has been completed, the lever dowel pin 264 is press-fit into the headstock-side dowel-pin-accepting aperture 434 and accordingly through the lever aperture 438.

Referring again to FIGS. 22-29, 56 and 59 (among other FIGs. in the accompanying drawings), after the ratchet release levers 233 and 238 and the lever dowel pins 264 and 266 have been installed onto the lower portion 494 of the arm substrate 280, the ratchet pawls 268 and 270 and compression springs 272 and 274 are installed onto the lower portion of the arm substrate in the following manner. As illustrated in FIGS. 56 and 59, the hub/pawl-accepting aperture 422 on the lower portion 494 of the arm substrate 280 includes a bridge-side cavity 450 and a headstock-side cavity 452. The bridge-side cavity 450 has a size and shape that are adapted to allow one end of the compression spring 274 to be disposed against a spring-retaining surface 454 of the cavity 450, the other end of the spring 274 to be retainably and removably engaged onto the spring-engaging-member 446 of the pawl member 418 of the ratchet pawl 270, and the spring 274 to be partially compressed while the pawl dowel pin 420 of the ratchet pawl 270 is rotatably and retainably engaged with the cavity 440 of the tip of the pawl-moving member 432 of the ratchet release lever 233. Similarly, the headstock-side cavity 452 has a size and shape that are adapted to allow one end of the compression spring 272 to be disposed against a spring-retaining surface 456 of the cavity 452, the other end of the spring 272 to be retainably and removably engaged onto the spring-engaging-member 446 of the pawl member 418 of the ratchet pawl 268, and the spring 272 to be partially compressed while the pawl dowel pin 420 of the ratchet pawl 268 is rotatably and retainably engaged with the cavity 440 of the tip of the pawl-moving member 432 of the ratchet release lever 238. It will be appreciated that after this installation of the ratchet pawls 268 and 270 and compression springs 272 and 274 into the bridge-side and headstock-side cavities 450 and 452, spring 274 and ratchet pawl 270 are retained within the bridge-side cavity 450 by the pressure exerted by spring 274 against the ratchet pawl 270 and the spring-retaining surface 454; similarly, spring 272 and ratchet pawl 268 are retained within the headstock-side cavity 452 by the pressure exerted by spring 272 against the ratchet pawl 268 and the spring-retaining surface 456. It is noted that after the just-described installation of the ratchet pawls 268 and 270 and compression springs 272 and 274, the pawl teeth 448 of the pawl members 418 of the ratchet pawls 268 and 270 are oriented toward the center of the hub/pawl-accepting aperture 422.

Referring again to FIGS. 2, 22, 27 and 63-65, and as exemplified in FIGS. 30-33, the ratchet hub 262 includes a fourth shaft-accepting aperture 458 that is substantially centered along the central axis P-P of the ratchet hub and horizontally passes completely through the ratchet hub from the left side to the right side thereof. The fourth shaft-accepting aperture 458 has the aforementioned center regular convex polygonal cross-sectional shape, where the size of this shape is adapted to allow the ratchet hub 262 to be slidably and removably disposed onto the center longitudinal section 310 of the shaft 288 (e.g., the fourth shaft-accepting aperture 458 has a diameter that is slightly larger than D3). The ratchet hub 262 also includes a pawl-engaging section 462. As illustrated in FIG. 30, the pawl-engaging section 462 is substantially centered on a first edge 466 of the fourth shaft-accepting aperture 458. In an exemplary embodiment of the tuning apparatus 200 described herein described herein, the ratchet hub 262 of each of the string-contacting members 202-207 is slidably and removably disposed onto the center longitudinal section 310 such that the first edge 466 is substantially aligned with the aforementioned plane that is substantially perpendicular to front surface 122 of the elongated neck 114 of the instrument whenever the clamp of the tuning apparatus 200 described herein is removably attached to the neck, and such that the pawl-engaging section 462 is as far as possible from the front surface 122. It will be appreciated that since the shaft-accepting aperture 458 has the center regular convex polygonal cross-sectional shape of the center longitudinal section 310, the pawl-engaging section 462 of the ratchet hub 262 of each of the string-contacting members 202-207 will maintain a substantially constant radial orientation about the longitudinal axis M-M of the shaft 288 regardless of how the string-contacting member is rotated. The pawl-engaging section 462 includes a prescribed number of hub teeth (e.g., hub tooth 472) that are adapted to retainably but releasably engage with the pawl teeth 448 of the ratchet pawls 268 and 270, where the number of hub teeth 472 is greater than the number of pawl teeth 448. In the exemplary embodiment of the ratchet hub 262 and ratchet pawls 268 and 270 illustrated in the accompanying drawings, the number of hub teeth 472 is nine and the number of pawl teeth 448 is five.

Referring again to FIGS. 22, 30-33 and 55-57, the ratchet hub 262 may also include three semispheric cavities 468-470 that are disposed in different radial positions on the outermost radial surface 464 of the ratchet hub, namely, a bridge-side open-string semispheric cavity 468, a home semispheric cavity 469, and a headstock-side open-string semispheric cavity 470. Since these semispheric cavities 468-470 interoperate with the externally-threaded ball-nose spring plunger 284 as will be described in more detail hereafter, the ratchet hub 262 will include these semispheric cavities whenever the ratchet mechanism includes the externally-threaded ball-nose spring plunger and the arm substrate 280 includes the threaded plunger-accepting aperture 286. As illustrated in FIGS. 22, 31 and 33, each of the three semispheric cavities 468-470 is substantially centered on the outermost radial surface 464 of the ratchet hub 262 along the central axis P-P thereof. Each of the three semispheric cavities 468-470 has a size which is adapted to retainably but releasably engage the ball end of the externally-threaded ball-nose spring plunger 284. As illustrated in FIG. 30, the home semispheric cavity 469 is substantially centered on a second edge 474 of the fourth shaft-accepting aperture 458 that is diametrically opposed to the first edge 466 thereof. It is noted that the bridge-side and headstock-side open-string semispheric cavities 468 and 470 can be located in various radial locations on the outermost radial surface 464 of the ratchet hub 262. In the exemplary embodiment of the ratchet hub 262 illustrated in FIGS. 22, 30, 31 and 33, the bridge-side open-string semispheric cavity 468 is substantially centered on a third edge 476 of the fourth shaft-accepting aperture 458 which is adjacent to the second edge 474 thereof on the bridge side of the ratchet hub; the headstock-side open-string semispheric cavity 470 is substantially centered on a forth edge 478 of the fourth shaft-accepting aperture 458 which is adjacent to the second edge 474 thereof on the headstock side of the ratchet hub.

As illustrated in FIG. 22 and referring again to FIG. 55, after the ratchet release levers 233 and 238, the lever dowel pins 264 and 266, the ratchet pawls 268 and 270, and the compression springs 272 and 274 have been installed onto the lower portion 494 of the arm substrate 280, the ratchet hub 262 is rotatably disposed into the hub/pawl-accepting aperture 422. Then, the ratchet cover 258 is removably disposed onto the right side of the ratchet hub 262 and the spiral internal retaining ring 254 is disposed onto the right side of the ratchet cover 258, where the spiral internal retaining ring 254 is removably engaged into a circular groove 484 that is disposed along the right side of the lower portion 494 of the arm substrate 280. Similarly, the ratchet cover 260 is removably disposed onto the left side of the ratchet hub 262 and the spiral internal retaining ring 256 is disposed onto the left side of the ratchet cover 260, where the spiral internal retaining ring 256 is removably engaged into a circular groove (not shown) that is disposed along the left side of the lower portion of the arm substrate 280. It will be appreciated that the spiral internal retaining rings 254 and 256 and the ratchet covers 258 and 260 serve to hold the ratchet hub 262 inside the hub/pawl-accepting aperture 422 while the ratchet hub is being rotated there-within. In an exemplary embodiment of the tuning apparatus 200 described herein, a conventional McMaster-Carr Supply Company part number 91663A550 is used for the spiral internal retaining rings 254 and 256.

Referring again to FIGS. 3, 22, 30 and 56, whenever the user rotates a given string-contacting member (e.g., member 203) into the home rotational orientation, the arm substrate 280 of the string-contacting member is rotated about the ratchet hub 262 and the ball end of the externally-threaded ball-nose spring plunger 284 locates into the home semi-spheric cavity 469 on the ratchet hub, thus serving to retainably but releasably engage the string-contacting member into the home rotational orientation. The ball end of the spring plunger 284 can subsequently be dislocated out of the semispheric cavity 469 whenever the user rotates the string-contacting member out of the home rotational orientation. For example, whenever the user further rotates the string-contacting member into the bridge-side open-string rotational orientation, the arm substrate 280 of the string-contacting member is further rotated about the ratchet hub 262 and the ball end of the spring plunger 284 locates into the headstock-side open-string semispheric cavity 470 on the ratchet hub, thus serving to retainably but releasably engage the string-contacting member into the bridge-side open-string rotational orientation. The ball end of the spring plunger 284 can subsequently be dislocated out of the semispheric cavity 470 whenever the user rotates the string-contacting member out of the bridge-side open-string rotational orientation. Similarly, whenever the user further rotates the string-contacting member into the headstock-side open-string rotational orientation, the arm substrate 280 of the string-contacting member is further rotated about the ratchet hub 262 and the ball end of the spring plunger 284 locates into the bridge-side open-string semispheric cavity 468 on the ratchet hub, thus serving to retainably but releasably engage the string-contacting member into the headstock-side open-string rotational orientation. The ball end of the spring plunger 284 can subsequently be dislocated out of the semispheric cavity 468 whenever the user rotates the string-contacting member out of the headstock-side open-string rotational orientation.

Referring again to FIGS. 2, 3, 22, 27, 30 and 56, whenever the user rotates a given string-contacting member (e.g., member 203) past the bridge-side open-string rotational orientation and into the home+1 rotational orientation, the arm substrate 280 of the string-contacting member is rotated about the ratchet hub 262 and the teeth 448 on one side of the hub-engaging section 460 of the ratchet pawl 268 begin to engage with the teeth 472 on the headstock side of the pawl-engaging section 462 of the ratchet hub, thus serving to retainably but releasably engage the string-contacting member into the home+1 rotational orientation. The user can subsequently disengage/release the string-contacting member from the home+1 rotational orientation by depressing the ratchet release lever 238 which urges the ratchet pawl 268 toward the spring-retaining surface 456 on the arm substrate 280, thus compressing the compression spring 272 and disengaging the teeth 448 on the hub-engaging section 460 of the ratchet pawl 268 from the teeth 472 on the pawl-engaging section 462 of the ratchet hub 262. Whenever the user rotates the string-contacting member past the headstock-side open-string rotational orientation and into the home−1 rotational orientation, the arm substrate 280 of the string-contacting member is rotated about the ratchet hub 262 and the teeth 448 on one side of the hub-engaging section 460 of the ratchet pawl 270 begin to engage with the teeth 472 on the bridge side of the pawl-engaging section 462 of the ratchet hub, thus serving to retainably but releasably engage the string-contacting member into the home−1 rotational orientation. The user can subsequently disengage/release the string-contacting member from the home−1 rotational orientation by depressing the ratchet release lever 233 which urges the ratchet pawl 270 toward the spring-retaining surface 454 on the arm substrate 280, thus compressing the compression spring 274 and disengaging the teeth 448 on the hub-engaging section 460 of the ratchet pawl 270 from the teeth 472 on the pawl-engaging section 462 of the ratchet hub 262.

Given the foregoing, it will be appreciated that the fully-adjustable capo embodiments described herein are universally adjustable and universally configurable to accommodate a wide variety of different types of stringed musical instruments. Examples of this universal adjustability and configurability include, but are not limited to, the following. As exemplified in FIG. 2, the tuning apparatus 200 can be configured such that the number of string-contacting members 202-207 equals the total number of strings 130-135 on the instrument. For example, in the case where the instrument is a four-string bass guitar, the tuning apparatus would be configured with four string-contacting members. In the case where the instrument is a five-string bass guitar, the tuning apparatus would be configured with five string-contacting members. In the case where the instrument is either a six-string bass guitar or a six-string acoustic guitar, the tuning apparatus would be configured with six string-contacting members. In each of these cases the user can selectively tighten or loosen the left and right knobs of the string-contacting member spacing adjustment mechanism of the tuning apparatus in order to substantially center the plane of rotation of each of the string-contacting members over a different string or course of strings as described heretofore.

As also described heretofore, the strings of a given stringed musical instrument can also be arranged into a plurality of courses, where each of the courses includes a different and non-overlapping subset of the strings. In this situation the tuning apparatus can be configured such that the number of string-contacting members equals the total number of courses on the instrument, and the user can selectively tighten or loosen the left and right knobs of the string-contacting member spacing adjustment mechanism in order to substantially center the plane of rotation of each of the string-contacting members over a different course. For example, in the case where the instrument is either a 12-string electric or acoustic guitar having six course of strings each of which includes a different and non-overlapping pair of strings, the tuning apparatus would be configured with six string-contacting members.

The fully-adjustable capo embodiments described herein can be easily and quickly adjusted by the user to accommodate instruments having a variety of different neck shapes (e.g., V-shaped necks, C-shaped necks, and U-shaped necks), different neck widths and different neck radii. The fully-adjustable capo embodiments can also be easily and quickly attached to different longitudinal positions on the instrument's neck to accommodate instruments having different fret locations and spacings. The fully-adjustable capo embodiments can also be easily adapted to accommodate instruments having different spacings between the strings/courses by using the string-contacting member spacing adjustment mechanism as needed. The fully-adjustable capo embodiments can also be easily adapted to accommodate instruments having different spacings between the left/right edge of the neck and the leftmost/rightmost string by using the string-contacting member spacing adjustment mechanism as needed. The user can also adjust the placement of the fully-adjustable capo embodiments on the instrument's neck in relation to the home fret, home−1 fret, and home+1 fret.

Referring again to FIGS. 1-3, 22, 27, 30, it will be appreciated that since there is a plurality of teeth 448 on the hub-engaging section 460 of the ratchet pawls 268 and 270, and there is also a plurality of teeth 472 on the pawl-engaging section 462 of the ratchet hub 262, each of the string-contacting members 202-207 is able to apply a range of different pressures onto the string or course of strings that the string-contacting member impinges upon while it is in either the home+1 or home−1 rotational orientations. As such, once a given string-contacting member is engaged in the home−1 rotational orientation, the user can adjust the amount of pressure the string-contacting member applies to the string/course it is impinging upon by either further rotating the string-contacting member toward the front surface 122 of the elongated neck 114 of the instrument (thus causing the ratchet pawl 270 to sequentially engage with one or more additional teeth 472 on the ratchet hub 262 and slightly increasing the amount of pressure that is applied to the string/course), or using the ratchet release lever 233 to release the string-contacting member from its current engagement and allowing it to move slightly away from the front surface 122 (thus causing the ratchet pawl 270 to sequentially disengage with one or more teeth 472 on the ratchet hub 262 and slightly decreasing the amount of pressure that is applied to the string/course). Similarly, once a given string-contacting member is engaged in the home+1 rotational orientation, the user can adjust the amount of pressure the string-contacting member applies to the string/course it is impinging upon by either further rotating the string-contacting member toward the front surface 122 of the neck 114 (thus causing the ratchet pawl 268 to sequentially engage with one or more additional teeth 472 on the ratchet hub 262 and slightly increasing the amount of pressure that is applied to the string/course), or using the ratchet release lever 238 to release the string-contacting member from its current engagement and allowing it to move slightly away from the front surface 122 (thus causing the ratchet pawl 268 to sequentially disengage with one or more teeth 472 on the ratchet hub 262 and slightly decreasing the amount of pressure that is applied to the string/course). This ability to individually adjust the amount of pressure that the string-contacting members 202-207 apply to the strings/courses 130-135 allows the user to easily and quickly adapt the fully-adjustable capo embodiments described herein to accommodate instruments having a wide variety of actions and string gauges.

It is noted that the fully-adjustable capo embodiments described herein can be made from a wide variety of different materials. For example, the jaw-tightening member, the shaft, the right jaw substrate of the right jaw, the left jaw substrate of the left jaw, the arm substrate of the string-contacting members, the hammer substrate of the string-contacting members, the left and right knobs, and the ratchet covers and ratchet release levers of the ratchet mechanism can each be made from any of a variety of rigid and durable materials such as aluminum, or brass, or other types of metals, or metal alloys, or ceramic, or plastic, or plastic composites, among other types of rigid and durable materials. The right neck-contacting element of the right jaw, the left neck-contacting element of the left jaw, and the string-contacting arm and hammer elements of the string-contacting members can each be made from any of a variety of flexible but relatively stiff materials such as nitrile butadiene rubber (NBR), or the like. The ratchet hub and pawl members of the ratchet mechanism can each be made from any of a variety of rigid and durable materials such as steel, or titanium, or the like.

2.1 Alternate Rocker Hammer

Figures 44, 45, 46, 47, 48, 49:
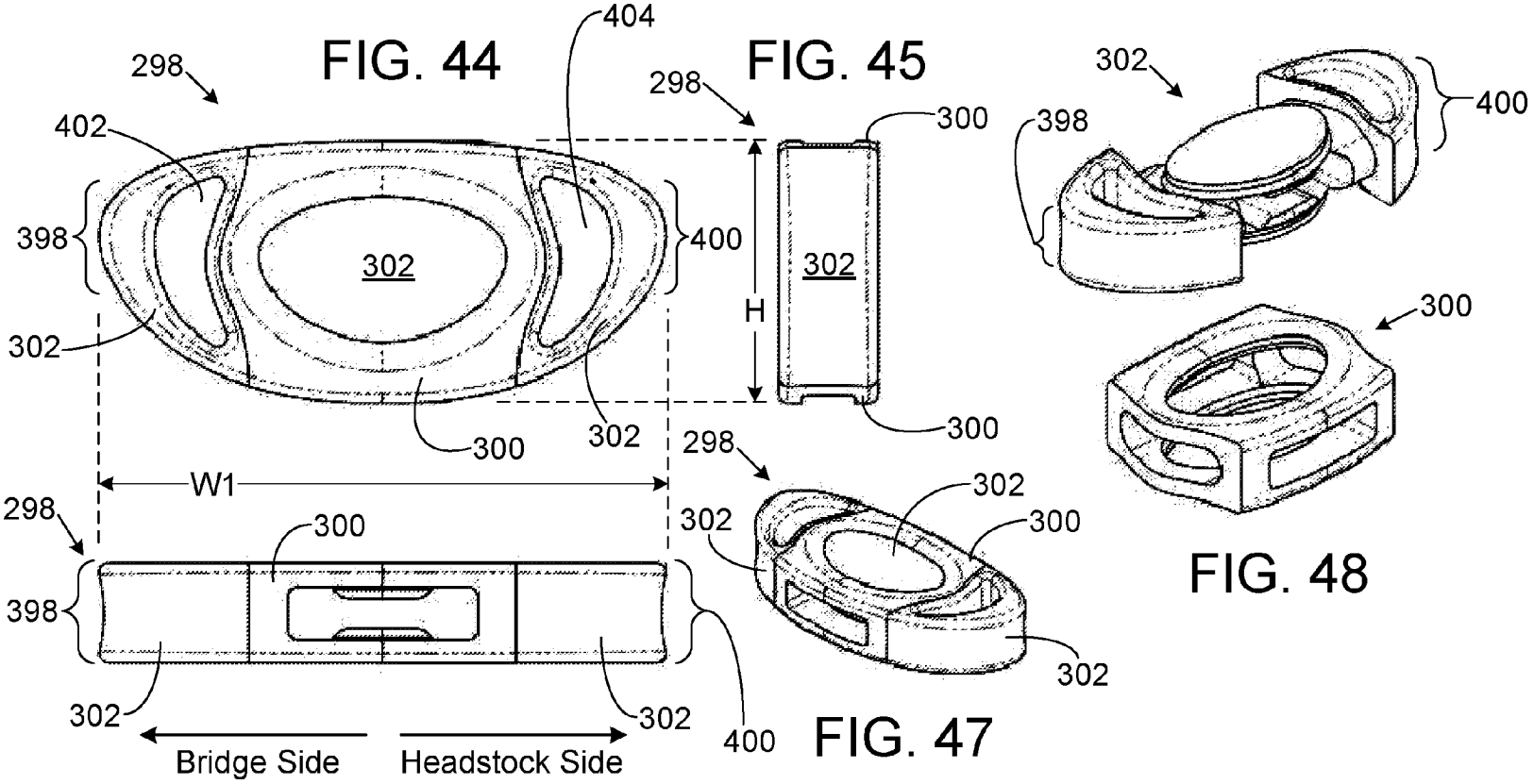
FIG. 44 is a diagram illustrating a standalone plan view, in simplified form, of an exemplary embodiment of an alternate rocker hammer that includes an alternate hammer substrate and an alternate string-contacting hammer element that is securely disposed onto the alternate hammer substrate.
FIG. 45 is a diagram illustrating a plan view, in simplified form, of the alternate rocker hammer of FIG. 44 rotated right 90 degrees.
FIG. 46 is a diagram illustrating a plan view, in simplified form, of the bottom of the alternate rocker hammer of FIG. 44.
FIG. 47 is a diagram illustrating a perspective view, in simplified form, of the alternate rocker hammer of FIG. 44.
FIG. 48 is a diagram illustrating a standalone perspective view, in simplified form, of an exemplary embodiment of the alternate hammer substrate of the alternate rocker hammer of FIG. 44 before the alternate string-contacting hammer element has been securely disposed onto the alternate hammer substrate.
FIG. 49 is a diagram illustrating a standalone perspective view, in simplified form, of an exemplary embodiment of the alternate string-contacting hammer element that is securely disposed onto the alternate hammer substrate.

FIG. 44 illustrates a standalone plan view, in simplified form, of an exemplary embodiment of an alternate rocker hammer 298 that includes an alternate hammer substrate 300 and an alternate string-contacting hammer element 302 that is securely disposed onto the alternate hammer substrate, where this element 302 is durable and resiliently flexible. FIG. 45 illustrates a plan view, in simplified form, of the alternate rocker hammer 298 of FIG. 44 rotated right 90 degrees. FIG. 46 illustrates a plan view, in simplified form, of the bottom of the alternate rocker hammer 298 of FIG. 44. FIG. 47 illustrates a perspective view, in simplified form, of the alternate rocker hammer 298 of FIG. 44. FIG. 48 illustrates a standalone perspective view, in simplified form, of an exemplary embodiment of the alternate hammer substrate 300 of the alternate rocker hammer 298 of FIG. 44 before the alternate string-contacting hammer element 302 has been securely disposed onto the alternate hammer substrate. FIG. 49 illustrates a standalone perspective view, in simplified form, of an exemplary embodiment of the alternate string-contacting hammer element 302 that is securely disposed onto the alternate hammer substrate 300. FIG. 50 illustrates a standalone plan view, in simplified form, of the alternate hammer substrate 300 of FIG. 44. FIG. 51 illustrates a plan view, in simplified form, of the alternate hammer substrate 300 of FIG. 50 rotated right 90 degrees. FIG. 52 illustrates a plan view, in simplified form, of the bottom of the alternate hammer substrate 300 of FIG. 50. FIG. 53 illustrates a perspective view, in simplified form, of the alternate hammer substrate 300 of FIG. 50.

Referring again to FIGS. 34-43 and as exemplified in FIGS. 44-53, the structure and functionality of the alternate rocker hammer 298 is similar to the structure and functionality of the rocker hammer 227 with the following exceptions. Although the alternate rocker hammer 298 and the rocker hammer 227 have substantially the same width W1 and the same height H, the alternate string-contacting hammer element 302 includes two apertures 402 and 404 that horizontally pass completely through the alternate string-contacting hammer element from the left side to the right side thereof (namely a bridge-side aperture 402 and a headstock-side aperture 404). The bridge-side aperture 402 is disposed between the home+1 string-contacting surface 398 of the alternate string-contacting hammer element 302 and the bridge-side edge 406 of the alternate hammer substrate 300. The headstock-side aperture 404 is disposed between the home−1 string-contacting surface 400 of the alternate string-contacting hammer element 302 and the headstock-side edge 408 of the alternate hammer substrate 300. The width W3 of the alternate hammer substrate 300 is less than the width W2 of the hammer substrate 276 in order to accommodate the bridge-side and headstock-side apertures 402 and 404. The existence of aperture 402 is advantageous in that it enhances the pressure sensitivity of the home+1 string-contacting surface 398 and the ability of this surface 398 to apply an appropriate amount of pressure to a given string or course of strings whenever a given string-contacting member is in the home+1 rotational orientation. Similarly, the existence of aperture 404 is advantageous in that it enhances the pressure sensitivity of the home−1 string-contacting surface 400 and the ability of this surface 400 to apply an appropriate amount of pressure to a given string or course of strings whenever a given string-contacting member is in the home−1 rotational orientation.

Referring again to FIGS. 22, 34, 44 and 55 (among other FIGs. in the accompanying drawings), given that the structure and functionality of the alternate rocker hammer 298 is similar to the structure and functionality of the rocker hammer 227 as just described, it will be appreciated that the alternate rocker hammer is slidably and removably disposed onto the elongated upper portion 378 of the arm substrate 280, and the user can use one or more fingers to change/adjust the longitudinal position of the alternate rocker hammer on this upper portion 378 at will.

3.0 Additional Embodiments

While the fully-adjustable capo has been described by specific reference to embodiments thereof, it is understood that variations and modifications thereof can be made without departing from the true spirit and scope of the fully-adjustable capo. For example, rather than the rocker hammer and alternate rocker hammer being slidably and removably disposed onto the elongated upper portion of the arm substrate of the string-contacting member and the user being able to change/adjust the longitudinal position of the rocker hammer and alternate rocker hammer on this elongated upper portion at will, the rocker hammer and alternate rocker hammer can also be rigidly disposed onto a prescribed longitudinal position on this elongated upper portion. Rather than the rocker arm including an arm substrate and a separate string-contacting arm element that is securely disposed onto the bottom of the arm substrate, the string-contacting arm element can be integrated directly into the arm substrate such that the string-contacting arm element and arm substrate form a single component, and the string-contacting arm element is made of the same material as the arm substrate. Rather than the rocker hammer including a hammer substrate and a separate string-contacting hammer element that is securely disposed onto the hammer substrate, the string-contacting hammer element can be integrated directly into the hammer substrate such that the string-contacting hammer element and hammer substrate form a single component, and the string-contacting hammer element is made of the same material as the hammer substrate. Rather than the alternate rocker hammer including an alternate hammer substrate and a separate alternate string-contacting hammer element that is securely disposed onto the alternate hammer substrate, the alternate string-contacting hammer element can be integrated directly into the alternate hammer substrate such that the alternate string-contacting hammer element and alternate hammer substrate form a single component, and the alternate string-contacting hammer element is made of the same material as the alternate hammer substrate.

Figure 84:
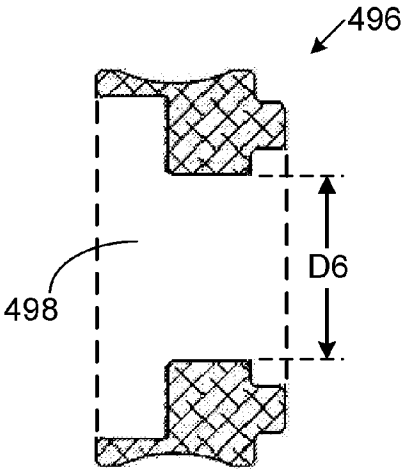
FIG. 84 is a diagram illustrating a cross-sectional view, in simplified form, of the spacer taken along line Q-Q of FIG. 83.
Figure 83:
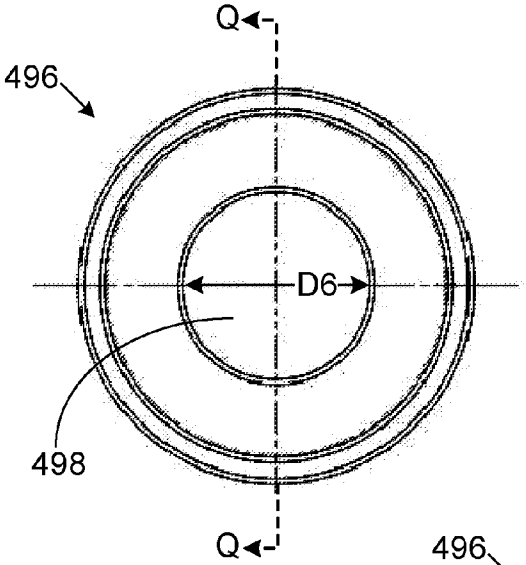
FIG. 83 is a diagram illustrating a plan view, in simplified form, of the front of the spacer of FIG. 82.
Figure 85:
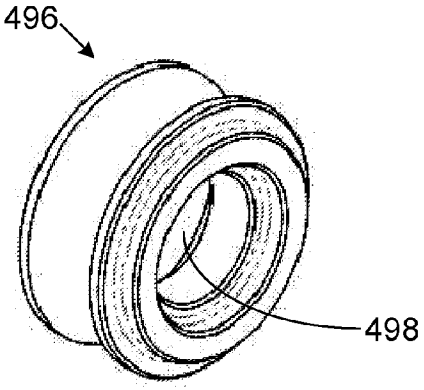
FIG. 85 is a diagram illustrating another perspective view, in simplified form, of the spacer of FIG. 82.
Figure 82:
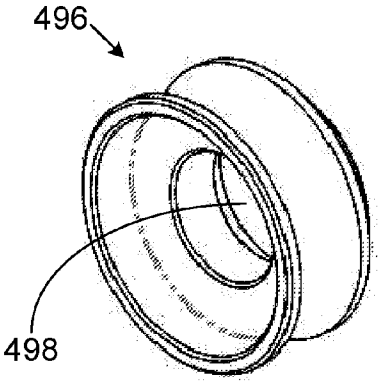
FIG. 82 is a diagram illustrating a standalone perspective view, in simplified form, of an exemplary embodiment of a spacer that can be substituted for the aforementioned left knob in an alternate embodiment of the string-contacting member spacing adjustment mechanism.

Additionally, FIG. 82 illustrates a standalone perspective view, in simplified form, of an exemplary embodiment of a spacer 496 that can be substituted for the left knob 252 in an alternate embodiment of the string-contacting member spacing adjustment mechanism. FIG. 83 illustrates a plan view, in simplified form, of the front of the spacer 496 of FIG. 82. FIG. 84 illustrates a cross-sectional view, in simplified form, of the spacer 496 taken along line Q-Q of FIG. 83. FIG. 85 illustrates another perspective view, in simplified form, of the spacer 496 of FIG. 82.

As exemplified in FIGS. 82-85, and referring again to FIG. 5, the spacer 496 includes a shaft-accepting aperture 498 that horizontally passes completely through the spacer from the left side to the right side thereof. This shaft-accepting aperture 498 has a circular cross-sectional shape and a minimum diameter D6 that is larger than the diameter D3 of the center longitudinal section 310 of the shaft 288 so that the leftmost portion of this center longitudinal section 310 is able to slidably and rotatably pass through the shaft-accepting aperture 498. Given the foregoing, it will be appreciated that the user can adjust the location of the plurality of string-contacting members 202-207 along the longitudinal axis of the center longitudinal section 310 of the shaft 288 by selectively tightening or loosening the right knob 240 on the right-center longitudinal section 316 of the shaft 288.

It is noted that any or all of the aforementioned embodiments throughout the description may be used in any combination desired to form additional hybrid embodiments. In addition, although the fully-adjustable capo embodiments have been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What has been described above includes example embodiments. It is, of course, not possible to describe every conceivable combination of components or methodologies for purposes of describing the claimed subject matter, but one of ordinary skill in the art may recognize that many further combinations and permutations are possible. Accordingly, the claimed subject matter is intended to embrace all such alterations, modifications, and variations that fall within the spirit and scope of the appended claims. In regard to the various functions performed by the above described components and the like, the terms (including a reference to a "means") used to describe such components are intended to correspond, unless otherwise indicated, to any component which performs the specified function of the described component (e.g., a functional equivalent), even though not structurally equivalent to the disclosed structure, which performs the function in the herein illustrated exemplary aspects of the claimed subject matter.

Wherefore, what is claimed is:

1. A tuning apparatus for a musical instrument comprising an elongated neck comprising a front surface over which a plurality of strings is stretched, comprising:

a clamp which is adapted to removably attach to a desired longitudinal position on the neck;

a plurality of string-contacting members, each of the string-contacting members being rotatably supported by the clamp, each of the string-contacting members being adapted to rotate on the clamp independently of the other string-contacting members, said rotation occurring along a plane that is substantially perpendicular to the front surface of the neck, each of the string-contacting members also being adapted to adjustably impinge upon and urge either a given string or course of strings toward a user-selectable one of three different longitudinal positions on said front surface, said positions comprising a home position, a home−1 position that is closer to a headstock end of the neck than the home position, and a home+1 position that is farther from the headstock end of the neck than the home position, each of the string-contacting members comprising a rocker arm and a rocker hammer, the rocker arm comprising an arm substrate comprising an elongated upper portion, and the rocker hammer being adapted to allow it to be slidably disposed onto said upper portion and also allow a user to change its longitudinal position on said upper portion at will, thus allowing the user to adjust the home−1 and home+1 positions; and a string-contacting member spacing adjustment mechanism which is adapted to allow the user to slidably adjust the location of the string-contacting members as a group on the clamp so as to substantially center the plane of rotation of each of the string-contacting members over a different string or course of strings, and to maintain substantially equal spacing between each different adjacent pair of string-contacting members.

* * * * *